US010260757B2

(12) United States Patent
Stewart et al.

(10) Patent No.: US 10,260,757 B2
(45) Date of Patent: Apr. 16, 2019

(54) OVEN RACK ASSEMBLIES WITH RELEASE MECHANISMS AND CATCHES

(71) Applicant: SSW Holding Company, Inc., Fort Smith, AR (US)

(72) Inventors: Brian J. Stewart, Vincennes, IN (US); Jeffrey Alan Ambrose, Evansville, IN (US); Jason Robert Yochum, Haubstadt, IN (US)

(73) Assignee: SSW HOLDING COMPANY, LLC, Dallas, TX (US)

( * ) Notice: Subject to any disclaimer, the term of this patent is extended or adjusted under 35 U.S.C. 154(b) by 0 days.

(21) Appl. No.: 15/883,531

(22) Filed: Jan. 30, 2018

(65) Prior Publication Data

US 2018/0209661 A1 Jul. 26, 2018

Related U.S. Application Data

(62) Division of application No. 13/147,860, filed as application No. PCT/US2010/023510 on Feb. 8, 2010, now Pat. No. 9,920,935.

(60) Provisional application No. 61/154,174, filed on Feb. 20, 2009, provisional application No. 61/150,589, filed on Feb. 6, 2009.

(51) Int. Cl.
*F24C 15/16* (2006.01)

(52) U.S. Cl.
CPC ..... *F24C 15/168* (2013.01)

(58) Field of Classification Search
CPC .. F24C 3/08; F24C 3/122; F24C 3/124; F24C 15/168; F23D 14/06; F23D 14/64; F23D 23/00
USPC ..... 126/337 R, 339, 333
See application file for complete search history.

(56) References Cited

U.S. PATENT DOCUMENTS

| | | | | |
|---|---|---|---|---|
| 6,148,813 A * | 11/2000 | Barnes | F24C 15/168 | 108/143 |
| 6,373,707 B1 * | 4/2002 | Hutchins | G06F 1/183 | 211/41.17 |
| 6,938,617 B2 * | 9/2005 | Le | F24C 15/16 | 126/273 R |
| 2006/0065265 A1 * | 3/2006 | Erdmann | F24C 15/16 | 126/339 |
| 2006/0185661 A1 * | 8/2006 | Metcalf | F24C 15/16 | 126/339 |
| 2008/0237166 A1 * | 10/2008 | Williams | F24C 15/168 | 211/169.1 |

* cited by examiner

*Primary Examiner* — David J Laux
(74) *Attorney, Agent, or Firm* — Marshall, Gerstein & Borun LLP

(57) ABSTRACT

An oven rack assembly (2000) can be used with an oven (128') having sets of liner ribs (1004). The oven rack assembly (2000) includes an oven rack (208), slide system (2018) and subframe (2040). The oven rack assembly (2000) also includes a retention/release assembly (2060) for facilitating retention of a position of the subframe (2040) onto liner ribs (2004) and for facilitating release of the subframe (2040) when a user wishes to remove or move the assembly (2000) from the oven. Attachment plates (2065) can also be included, with the plates (2065) mounted to side stampings (2022). The oven rack assembly (2000) also includes protruding forms (2122) on the subframe (2040) which interact with forms (2124) positioned along the liner ribs (2004) to prevent tipping of the subframe (2040) when the oven rack (2008) is moved to an extended position.

23 Claims, 49 Drawing Sheets

OVEN RACK ASSEMBLIES WITH RELEASE MECHANISMS AND CATCHES

CROSS-REFERENCE TO RELATED APPLICATIONS

This is a divisional of U.S. patent application Ser. No. 13/147,860, filed Oct. 7, 2011, which is the United States national phase of International Patent Application No. PCT/US2010/023510, filed Feb. 8, 2010, which claims priority to U.S. provisional patent application No. 61/154,174, filed Feb. 20, 2009, and U.S. provisional patent application No. 61/150,589, filed Feb. 6, 2009. Each of the foregoing is incorporated herein in its entirety.

BACKGROUND OF THE INVENTION

Field of the Invention

The present invention relates to oven products and, more particularly, to oven rack assemblies having release mechanisms for releasing oven sub-frames and other components from oven liners.

Background Art

Various types of oven racks are well known in the industry. For example, steel wire oven racks are often manufactured from a steel rod which is drawn, so as to form steel wire. These oven racks formed of steel wire products can be coated with various types of materials. Also, oven racks and other oven-related articles can be manufactured from products other than steel. Of course, any type of oven rack or similar product which is positioned within an oven cavity during use must be capable of withstanding normal cooking temperatures which substantially exceed normal cooking temperatures. In addition, for ovens which employ self-cleaning cycles, the oven racks and other oven-related articles located within the oven itself must be capable of being subjected to and withstanding temperatures which substantially exceed normal cooking temperatures. For example, steel wire oven racks may be subjected to temperatures above 900.degree. F. associated with self cleaning cycles, common in today's kitchen ovens.

One difficulty which has existed for a number of years in the industry relates to manipulation of oven racks. In many conventional ovens, the oven racks can be positioned at various vertically disposed positions, and be adjustable among the same. With the oven racks positioned as desired at various vertically adjusted locations, the oven racks often "slide" on ribs or roller bearing mechanisms positioned on the lateral sides of the oven cavity. These ribs, roller bearings or "ledges" may be separately manufactured and assembled components from the surfaces of the oven cavity and oven racks or, alternatively, may be integrated into the lateral surfaces of the oven cavity.

With respect to oven rack assemblies which can be extended, such rack assemblies traditionally fall within one of two types of applications. One particular application comprises an oven rack assembly which interacts directly with ribbed liners on the sidewalls of an oven interior. In a second application, the oven rack assembly interacts with a ladder frame connected to the sidewalls of an oven interior.

As an example, Barnes, et al., U.S. Pat. No. 6,148,813 issued Nov. 21, 2000, discloses a telescoping oven rack assembly for an oven cavity. The assembly includes a rack extendable upon a primary rack frame. In turn, the rack frame is mounted for sliding movement relative to the oven cavity. With this configuration, multiple extensions for the rack are available. The rack is supported upon guides carried by the rack frame, along with multiple sets of rollers. A secondary rack frame can be used to slidably support the primary rack frame, so that a further extension can be made.

Le, et al., U.S. Pat. No. 6,938,617 issued Sep. 6, 2005, discloses an oven rack assembly having full extension slides. The slides are mounted to an oven rack, and oven rack frames or wire racks provide full extension from an oven enclosure. The rack frame is mounted to oven walls or the slides are coupled to wire racks along the oven side walls. This patent discloses the concept of the user of ladder frames.

In accordance with the foregoing, it is known from the prior art to utilize items such as a subframe and/or attachable brackets for the slidable oven rack assembly. In these prior art configurations, the subframe may support the weight of items placed on the oven rack, and keep the assembly in place, relative to the ladder tracks or the ribbed liners. In prior art systems employing attachable brackets, the brackets provide a fixed connection between the oven rack and the ladder racks. However, for various purposes, including cleaning, repair and the like, it is advantageous to provide means for releasing the coupling between the subframe or brackets from the liners.

Still further, when manipulating the subframe, one difficulty which can arise is that the subframe may tend to tip away from a horizontal plane. Accordingly, it would be advantageous to provide means for preventing such undesired movement.

SUMMARY OF THE INVENTION

In accordance with the invention, an oven rack assembly is adapted for use within an oven cavity having a ribbed liner. The oven rack assembly includes an oven rack having means for supporting items to be cooked or otherwise heated within the oven cavity. The oven rack is manually extendable between a retracted position within the oven cavity, and an extended position, where the oven rack has moved forwardly relative to the oven cavity. A slide system is coupled to the oven rack for providing the capability of having the oven rack moved between the retracted position and the extended position.

A subframe is coupled to the slide system, and is normally positioned in a first location within the oven cavity. Retention/release means are provided for facilitating retention of the subframe in the first location within the oven cavity. The retention/release means also facilitates release of the subframe from the first location within the oven cavity, when a user wishes to remove the oven rack assembly from the oven cavity.

A pair of outer side stampings are also provided, with each of the outer side stampings positioned outwardly from adjacent portions of the slide system. In accordance with one aspect of the invention, a pair of attachment plates are also provided. Each of the plates is associated with a corresponding one of the outer side stampings, and is selectively positionable along a series of locations along the length of the associated outer side. The retention/release means are mounted to the attachment plates, so as to be selectively positionable at a series of locations along the lengths of the outer side stampings. Each of the outer side stampings is secured to the subframe.

The retention/release means includes a series of retention/release devices. Each of the devices is connected to a corresponding one of the attachment plates. Each of the devices includes a flipper mechanism having a retainer tab. The retainer tab is pivotable between a retaining position and a release position. The subframe is maintained in the first location within the oven cavity when the retainer tabs are in the retaining position.

Each of the flipper mechanisms also includes attachment plate securing flanges which are connected to or otherwise integral with the corresponding attachment plate. Apertures extend through the securing flanges. Further, each of the flipper mechanisms includes a vertically disposed pin extending through the apertures formed in the attachment plate securing flanges. Still further, each of the flipper mechanisms can include a pair of retainer tab securing flanges. The retainer tab securing flanges form apertures which are aligned with the apertures of the attachment plate securing flanges. The pin extends through the apertures of the retainer tab securing flanges, for purposes of securing the flipper mechanism and corresponding retainer tab to the corresponding attachment plate. Each of the flipper mechanisms is free to rotate with the corresponding pin, when external forces are exerted on the flipper mechanism. Still further, each of the flipper mechanisms includes means for maintaining each of the mechanisms in a retaining position, until such time as a user would exert externally applied forces on the mechanisms. The means for maintaining the flipper mechanism in the retaining position can include a retention spring received around a corresponding one of the pins.

Each of the retention/retainer devices includes a horizontally disclosed guide flange positioned below the retainer tab. The guide flange includes an arcuate shape, with a guide surface associated therewith. A formed release leg is also provided, with the release leg having an actuating user lever, with a pivot arm connected to or otherwise integral with the user lever. The pivot arm is pivotably coupled to the attachment plate through a pivot coupling. Connected to or otherwise integral with one end of the pivot arm is a portion of the release leg forming a guide section. The guide section includes a horizontally disposed leg connected to or otherwise integral with the pivot arm. A downwardly projecting abutment post is connected to or otherwise integral with one end of the horizontal leg. The abutment post is configured so as to contact the guide surface and facilitate actuation of the guide flange.

The subframe can include an outer wire frame having a pair of longitudinally extending side portions. The oven cavity can include a series of liner ribs, with the ribs having a series of protruding forms. When the subframe is releasably secured to the liner ribs of the oven cavity, the protruding forms interact with forms positioned along longitudinally extending side portions of the subframe. The protruding forms provide an abutment with the retainer tabs when the subframe is positioned in a retracted position within the oven cavity.

In accordance with concepts of the invention associated with the retention/release means, each of the flipper mechanisms can be characterized as being rotatable about a vertical axis between a retaining position and a full release position. When the mechanism is in the retaining position, the mechanism abuts one of the liner ribs so as to prevent movement of the subframe within the oven cavity and to maintain the subframe in the first location within the oven cavity, absent application by a user of externally applied forces to the flipper mechanism. Further, each of the retention/release devices includes means for providing a vertical pivot axis about which the flipper mechanism can rotate between a retaining position and a forward release position. The flipper mechanism is rotatable relative to a direct or indirect connection to elements of the outer side stampings. The means for providing the vertical axis can include a vertically disposed pin rotatably secured within apertures of connecting flanges which are directly or indirectly connected to other elements of the outer side stampings.

Each of the retention/release devices can also include means for urging the flipper mechanism toward the retaining position, absent the application of externally applied forces by a user to the flipper mechanism. The means for urging the flipper mechanism to the retaining position can include a retention spring positioned on the pin.

In accordance with other aspects of the retention/release devices, each of the devices can include a formed release leg manually operable by a user. The release leg can be pivotably coupled directly or indirectly to the outer side stampings, and movable by a user between first and second positions. The formed release leg is associated with the flipper mechanism in a manner so that when the user moves a release leg from the first position toward the second position, the release leg causes the flipper mechanism to move from the retaining position toward the full release position.

The release leg is structured so that the leg is not directly connected to any elements of the flipper mechanism, but instead is caused to move the flipper mechanism when the user applies forces to the release leg through an abutment coupling of the release leg to the flipper mechanism. The release leg can be pivotably coupled to the outer side stamping through a vertically disposed post directly or indirectly connected to elements of the outer side stamping.

More specifically, the release leg can include an actuating user lever operable by a user. A pivot arm is connected to or otherwise integral with the user lever. The pivot arm is pivotably coupled to the outer side stamping through a pivot coupling. A guide section is connected to or is otherwise integral with one end of the pivot arm. The guide section includes a downwardly projecting abutment post configured so to contact a guide surface of a guide flange of the flipper mechanism. Each of the retention/release devices can also include one or more metal posts extending downwardly from elements of the subframe, with the posts acting as additional abutment points for the formed release leg. Further, the flipper mechanism can be characterized as having means for causing the retainer tab to move from the forward release position toward the retaining position when the user manually releases forces exerted on the release leg. This means can include a retainer spring.

In accordance with further aspects of the invention, the oven rack assembly can include non-tipping means associated with the subframe and the liner ribs for preventing the oven rack assembly from tipping when the oven rack and slide system are moved between said retracted and said extended position. Each of the oven liners can include a series of liner ribs comprising at least a first liner rib, and a second liner rib positioned below the first line rib. The non-tipping means include a first protrusion extending from the first liner rib. A side form can be positioned on each of the opposing side portions. When the subframe is positioned in the oven cavity so that opposing side portions are supported on the second liner ribs, the side forms of the subframe will interact with protrusions of the first liner ribs, so as to prevent tipping of the oven rack assembly when the oven rack and slide system are moved between said retracted and said extended position. The first protrusions can also provide abutments with elements of the retention/release means when the subframe is positioned in the first, retained position.

BRIEF DESCRIPTION OF THE SEVERAL VIEWS OF THE DRAWING

FIG. 47 is an upper, perspective view of the oven rack assembly shown in FIG. 46, but showing the oven rack in an extended position, while FIG. 46 illustrates the oven rack in a retracted position;

DETAILED DESCRIPTION OF THE INVENTION

The principles of the invention are disclosed, by way of example, in an oven rack assembly 2000 as described herein and illustrated in FIGS. 35-45, and an oven rack assembly 3000 as described herein and illustrated in FIGS. 46-58. In accordance with certain aspects of the invention, the oven rack assemblies disclosed herein may be used with liner ribs or similar liner support elements, with release mechanisms which facilitate release of the oven rack assemblies from the oven liners.

For purposes of describing additional background regarding oven rack assemblies, other embodiments of certain types of oven racks are illustrated in FIGS. 1-34, and described in subsequent paragraphs herein. Some of oven rack embodiments are disclosed in commonly assigned International PCT Patent Application entitled "Full and Partial Extension Oven Rack Assembly" and filed Nov. 30, 2006. Following the description of the oven racks as illustrated in FIGS. 1-34, the principles of the current invention will be described with respect to FIGS. 35-58.

Figure 2:
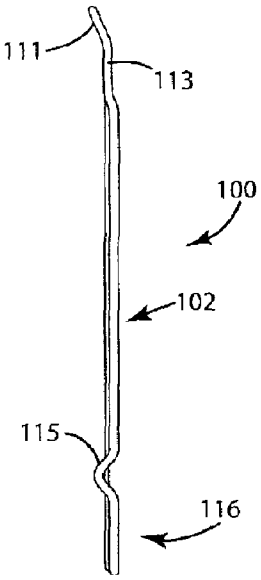
FIG. 2 is a side elevational view of the oven rack and handle of FIG. 1.
Figure 1:
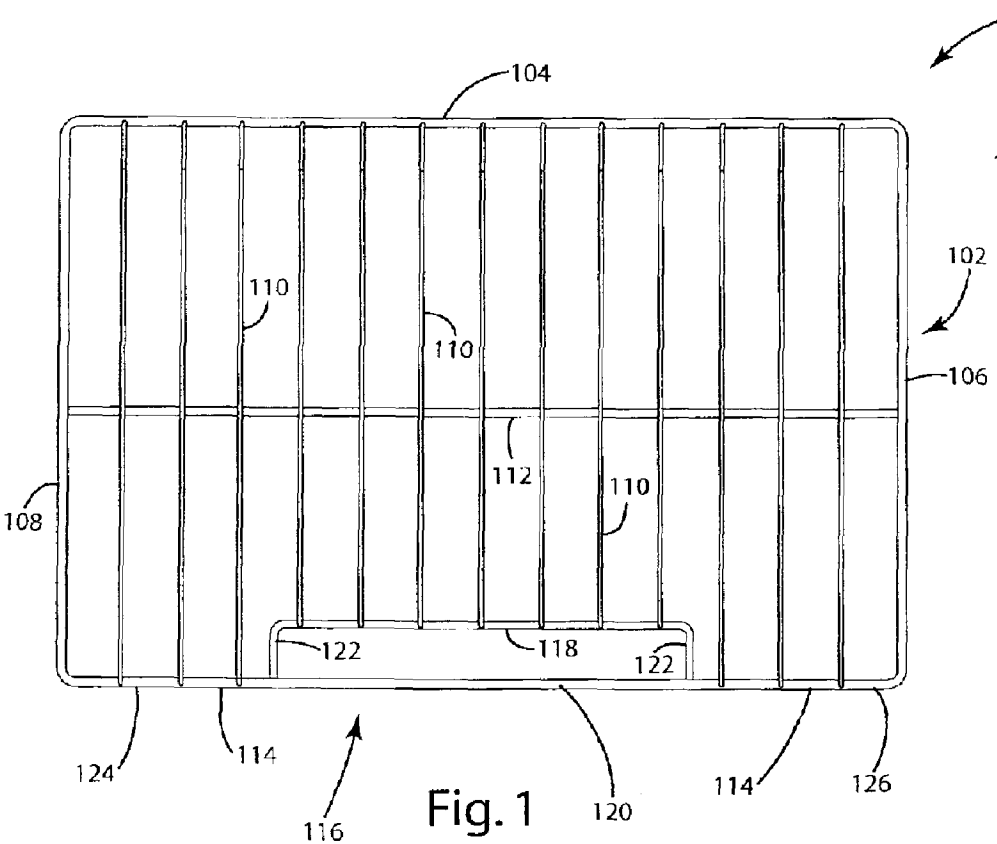
FIG. 1 is a plan view of a prior art oven rack having a handle.

More specifically, and first primarily with respect to FIGS. 1 and 2, a handle rack 100 is illustrated. The handle rack 100 includes an oven rack 102. The oven rack 102 is in part a substantially conventional oven rack, with the exception of the handle 116 as described in subsequent paragraphs herein. The oven rack 102 includes an elongated rear brace 104 which is positioned adjacent the rear of the oven cavity when the oven rack 102 is in its retracted and normal position within the oven cavity (not shown). The rear brace 104 and other components of the oven rack 102 can be manufactured in a conventional manner of steel wire products or the like. Alternatively, other types of materials and structures may be utilized for the rear brace and other components of the oven rack.

Interconnected or otherwise integral with the rear brace 104 is a right brace 106 which extends perpendicular to the rear brace 104. The right brace 106 extends between the forward and the rear sections of the oven rack 102, and essentially acts as a support brace for other elements of the oven rack 102. Also, when the oven rack 102 is placed within the oven cavity, the right brace 106 will typically rest or otherwise be releasably secured on a rib or other conventional element of the oven cavity. Corresponding to the right brace 106, the oven rack 102 also includes a left brace 108. The left brace 108 is parallel to the right brace 106 and is interconnected to or otherwise integral with the rear brace 104. As with the right brace 106, the left brace 108 extends between the rear and front portions of the oven rack 102. As with the right brace 106, the left brace 108 rests upon or is otherwise releasably secured to a rib or similar component of the oven cavity (not shown).

Positioned intermediate the right brace 106 and the left brace 108 are a series of parallel and longitudinally extending elongated support members 110. The support members 110 act as the principal support members of the oven rack 102 for supporting items to be heated and cooked within the oven cavity. The rear ends of the support members 110 are connected to the rear brace 104 by suitable means, such as welding or the like. As illustrated in FIG. 2, the right brace 106, left brace 108 and the support members 110 include a series of intermediate forms 113 located near the rear portions of the braces 106, 108 and support members 110. The intermediate forms 113 are connected to or are otherwise integral with angled forms 111 also shown in FIG. 2. The angled configuration of the forms 111 assist in preventing items placed on the support members 110 from falling off of the oven rack 102 over the rear brace 104.

The oven rack 102 also includes a central brace 112, extending perpendicular to the right brace 106 and the left brace 108. The central brace 112 is also positioned substantially intermediate from the rear brace 104 and the front brace 114. The central brace 112 provides for additional support for items placed on the oven rack 102 for purposes of heating or cooking. The central brace 112 may be connected to the support members 110, right brace 106 and left brace 108 in any conventional manner. For example, welding may be utilized.

In addition to the foregoing, the oven rack 102 also includes a front brace 114. The front brace 114, with reference to the illustration in FIG. 1, includes a left portion 124 and a right portion 126. The front brace 114, comprising left and right portions 124, 126, respectively, provides a forward bracing means for the oven rack 102. As illustrated in FIG. 1, three of the support members 110 are interconnected to the left portion 124 of the front brace 114, while three of the support members 110 are also interconnected to the right portion 126 of the front brace 114.

The handle rack 100 comprises not only the oven rack 102, but also the handle 116. The handle 116 is primarily illustrated in FIG. 1. More specifically, the handle 116 includes a rear handle brace 118 having an elongated configuration as shown in FIG. 1. The rear handle brace 118 extends parallel to the rear brace 104 and the central brace 112. As illustrated in FIG. 1, the intermediate seven support members 110 have one end of each of the same interconnected to the rear handle brace 118. Interconnected to or otherwise integral with the rear handle brace 118 are a pair of handle sides 122. The handle sides 122 extend substantially parallel to the support members 110, right brace 106 and left brace 108. Correspondingly, the handle 116 also includes a front handle brace 120. The front handle brace 120, as illustrated in FIG. 1, is elongated and is positioned substantially parallel to the rear handle brace 118. The handle sides 122 are integral with or otherwise appropriately interconnected to the front handle brace 120. Also, if desired the front handle brace 120 can actually be a brace which is integral with the front brace 114 comprising the left portion 124 and the right portion 126.

With the configuration of the handle rack 100' comprising the oven rack 102 and the handle 116 as described in the foregoing paragraphs, a handle is provided for purposes of manual manipulation in extending and retracting the oven rack 102 from an oven cavity (not shown). More specifically, with the oven rack 102 in a normal position within an oven cavity, the user may open an oven door (not shown). The handle 116 will be adjacent the oven door. For purposes of extending the oven rack 102 out of the oven cavity, the user may manually grip the front handle brace 120, and exert forces in a direction corresponding to the perpendicular direction from the rear brace 104 to the front handle brace 120. These forces will cause the oven rack 102 to be extended outwardly from the oven cavity.

As primarily illustrated in FIG. 2, the oven rack 102 also includes a pair of bosses 115 which are located within the right brace 106 and the left brace 108. The bosses 115 are conventional in many oven racks, and comprise a means for providing some securing forces when the oven rack is in its conventional position within the oven cavity. That is, the bosses 115 will typically "mate" with corresponding indents located in ribs or ledges on each side surface of the oven cavity. With this type of mating relationship, the user may need to exert partially 375 upwardly directed forces so as to lift the bosses 115 out of the indents when extending the oven rack 102 out of the oven cavity.

In accordance with the foregoing, the handle rack 100 provides not only the oven rack 102, but also provides a handle 116 for facilitating manual movement of the oven rack 102 between extended and retracted positions relative to the oven cavity (not shown). As earlier 380 mentioned, the handle 116 can be utilized to extend the oven rack 102 out of the oven cavity. Correspondingly, a user may manually grip the front handle brace 120 and exert forces rearwardly against the oven rack 102 for purposes of retracting the oven rack 102 in to the oven cavity.

The handle rack 100 also includes means for supporting the handle rack within the oven cavity. Means are also provided for supporting items to be cooked or otherwise heated within the oven cavity, and the handle is secured to the oven rack at a front portion of the rack, positioned adjacent the oven door. Also in accordance with the foregoing, the handle is sized and configured so that an opening is formed between a front portion of the handle, and a front portion of the oven rack. In accordance with the foregoing, the opening is a side sufficient so that a user can readily grip the front portion of the handle, so that the oven rack can be extended from or retracted into the oven cavity. For this purpose, the opening formed between the front handle brace 120 and the rear handle brace 118 should be sufficient so that a user is capable of gripping the front handle brace 120 in a convenient manner, for purposes of extending or retracting the oven rack 102. That is, the opening between the front and rear braces 120, 118 should permit a users hand to fit therethrough, so as to conveniently grip the brace 120.

Figure 4:
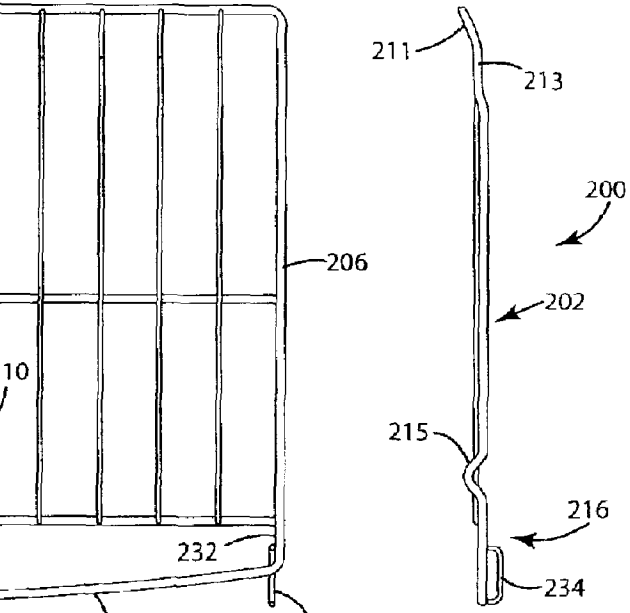
FIG. 4 is a side elevational view of the second embodiment of the oven rack and handle illustrated in FIG. 3.
Figure 3:
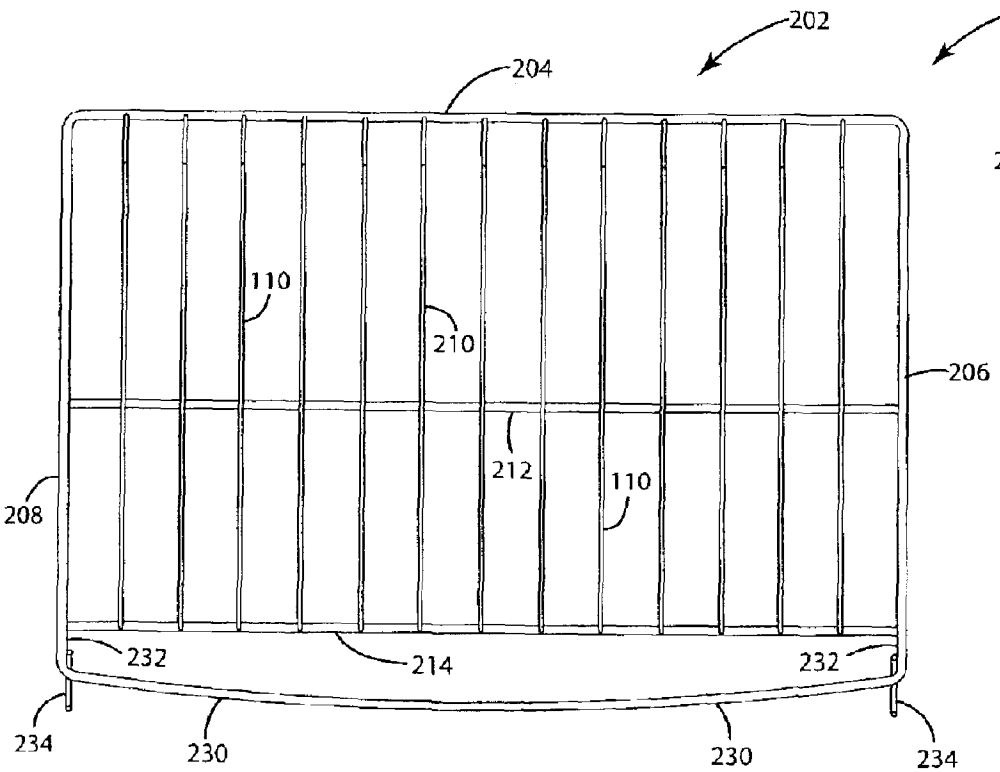
FIG. 3 is a plan view of a second embodiment of a prior art oven rack and handle.

A second embodiment of a handle rack is illustrated in FIGS. 3 and 4 as handle rack 200. The handle rack 200 includes an oven rack 202. The oven rack 202 is in part a substantially conventional oven rack, with the exception of the handle 216 as described in sub sequent paragraphs herein. as with the oven rack 102, the oven rack 202 includes an elongated rear brace 204 positioned adjacent the rear of the oven cavity when the oven rack 202 is in its retracted and normal position within the oven cavity (not shown).

Interconnected or otherwise integral with the rear brace 204 is a right brace 206 which extends perpendicular to the rear brace 204. The right brace 206 extends between the forward and rear sections of the oven rack 202, and essentially acts as a support brace for other elements of the oven rack 202. Also, when the oven rack 202 is placed within the oven cavity, the right brace 206 will typically rest or otherwise be releasably secured on a rib or other conventional element of the oven cavity. Corresponding to the right brace 206, the oven rack 202 also includes a left brace 208. The left brace 208 is parallel to the right brace 206 and is interconnected or otherwise integral with the rear brace 204. As with the right brace 206, the left brace 208 extends between the rear and front portions of the oven rack 202. As with the right brace 206, the left brace 208 rests upon nor is otherwise releasably secured to a rib or similar component of the oven cavity (not shown).

Positioned intermediate the right brace 206 and the left brace 208 are a series of parallel and longitudinally extending elongated support members 210. The support members 210 act as the principal support members of the oven rack 202 for supporting items to be heated and cooked within the oven cavity. The rear ends of the support members 210 are connected to the rear brace 204 by suitable means, such as welding or the like, as illustrated in FIG. 4, the right brace 206, left brace 208 and the support members 210 include a series of intermediate forms 213 located near the rear portions of the braces 206, 208 and support members 210. The intermediate forms 213 are connected to or are otherwise integral with angled forms 211 also shown in FIG. 4. The angled configuration of the forms 211 assist in preventing items placed on the support members 210 from falling off of the oven rack 202 over the rear brace 204. The oven rack 202 also includes a central brace 212, extending perpendicular to the right brace 206 and the left brace 208. The central brace 212 is also positioned substantially intermediate from the rear brace 204 and the front brace 214. The central brace 212 provides for additional support for items place don the oven rack 202 for purposes of heating or cooking. The central brace 212 may be connected to the support members 210, right brace 206 and left brace 208 in any conventional manner. For example, welding may be utilized.

In addition to the foregoing, the oven rack 202 also includes a front brace 214. The front brace 214 provides a forward bracing means for the oven rack 202. As illustrated in FIG. 3, each of the support members 210 is interconnected at the ends thereof to the front brace 214.

The handle rack 200 not only comprises the oven rack 202, but also the handle 216. The handle 216 includes a curved front section 230 as primarily shown in FIG. 3. The front section 230 extends across the entirety of the front portion of the oven rack 202. The front section 230 includes a single element having a rounded and elongated configuration, and provides a means for a user to manually grip a portion of the handle rack 200, for purposes of extending and retracting the oven rack 202. Integral with or otherwise connected to the front section 230 are a pair of opposing side portions 232. As illustrated in FIG. 3, and if desired, the side portions 232 can be made integral with the right brace 106 and the left brace 108, as well as the front section 230.

As with the handle rack 100, manual forces may be exerted on the oven rack 202 through the handle 216 for purposes of extending and retracting the oven rack 202 from an oven cavity. Also, as with the oven rack 102 previously described herein and having a pair of bosses 115, the oven rack 202 can also have a pair of bosses 215 having the same functions as the bosses 115.

Figure 6:
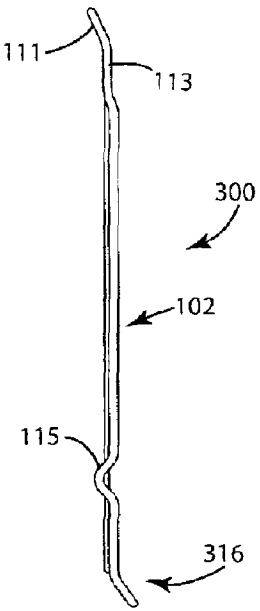
FIG. 6 is a partial side elevational view of the oven rack and handle illustrated in FIG. 5.
Figure 5:
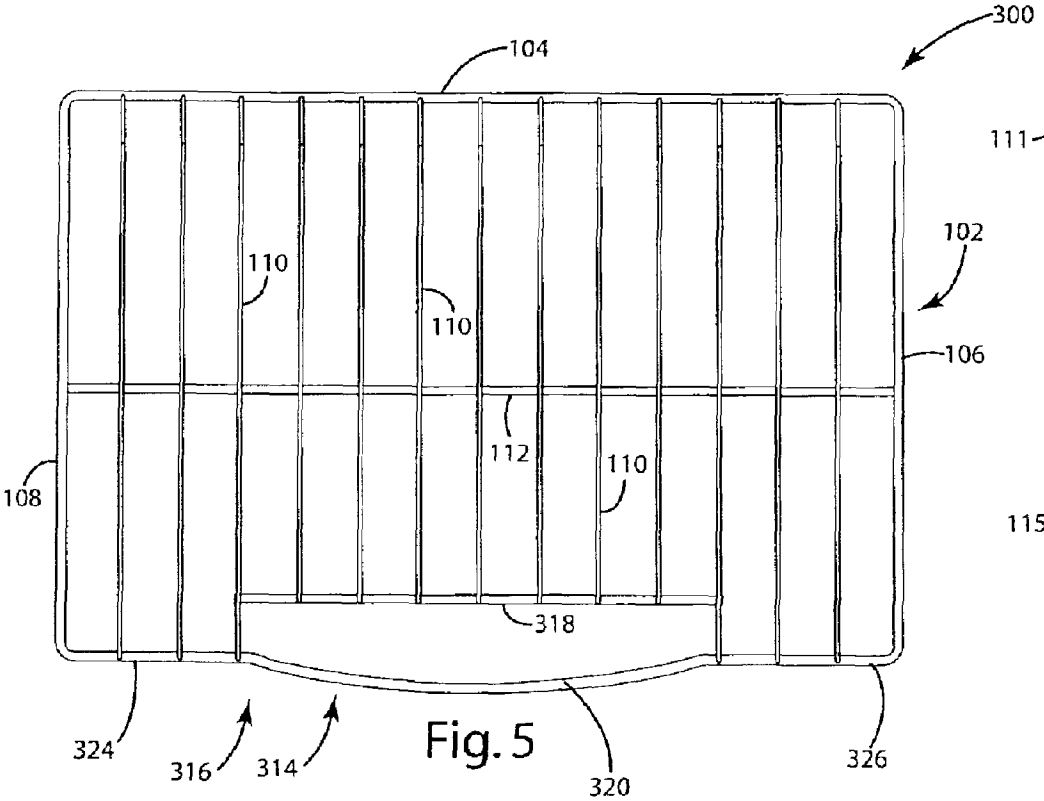
FIG. 5 is a plan view of a third embodiment of a prior art oven rack and handle.

A third embodiment of a handle rack is illustrated in FIGS. 5 and 6 as handle rack 300. For purposes of brevity, elements of handle rack 300 which correspond to elements of handle rack 100 are shown by numerical references which correspond to identically structured and identically functional elements numerically referenced in FIGS. 1 and 2. However, in accordance with the third embodiment of the invention, the handle rack 300 comprises not only the oven rack 102 but also the handle 316. More specifically, the handle 316 includes a rear handle brace 318 having an elongated configuration as illustrated in FIG. 5. The rear handle brace 318 extends parallel to the rear brace 104 and the central brace 112. As illustrated in FIG. 5, the intermediate seven support members 110 have one end of each of the same interconnected to the rear handle brace 318. Also, each opposing end of the rear handle brace 318 is preferably interconnected to one of the support members 110, again as illustrated in FIG. 5.

In addition to the foregoing, the oven rack 102 illustrated inn FIG. 5 also includes a front brace 314. The front brace 314, with reference to the illustration in FIG. 5, includes a left portion 324 and a right portion 326. The front brace 314, comprising left and right portions 324, 326, respectively, provides a forward bracing means for the oven rack 102. As illustrated in FIG. 5, three of the support members 110 are interconnected to the left portion 324 of the front handle brace 314, while three of the support members 110 are also interconnected to the right portion 326 of the front handle brace 314. The handle rack 300 comprises not only the oven rack 102, but also the handle 316. The handle 316 is primarily illustrated in FIG. 5. More specifically, the handle 316 includes the rear handle brace 318 previously described herein. Also, the handle 316 includes a front handle brace 320. The front handle brace 320, as illustrated in FIG. 5, is elongated and is positioned in a manner so as to have a curved configuration. In addition, as illustrated primarily in FIG. 6, the front handle brace 320 may be angled downwardly. If desired, the front handle brace 320 can actually be a brace which is integral with the front brace 314 comprising the left portion 324 and the right portion 326.

With the configuration of the handle rack 300 comprising the oven rack 102 and the handle 316 as described in the foregoing paragraphs, a handle is provided for purposes of manual manipulation and extending and retracting the oven rack 102 from an oven cavity (not shown). More specifically, with the oven rack 102 in a normal position within an oven cavity, the user may open an oven door (not shown). The handle 316 will be adjacent the oven door. For purposes of extending the oven rack 102 out of the oven cavity, the user may manually grip the front handle brace 320, and exert forces in a direction corresponding to the perpendicular direction from rear brace 104 to front handle brace 320. These forces will cause the oven rack 102 to be extended outwardly from the oven cavity. Correspondingly, a user may manually grip the front handle brace 320 and exert forces rearwardly against the oven rack 102 for purposes of retracting the oven rack 102 into the oven cavity.

Figure 8:
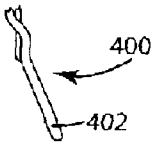
FIG. 8 is a side elevational view of the oven rack and handle illustrated in FIG. 7.
Figure 7:
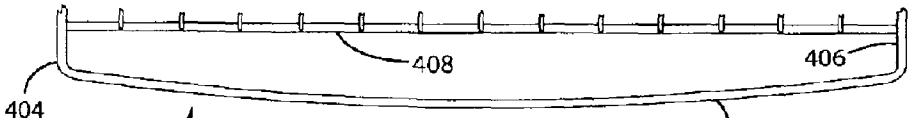
FIG. 7 is a partial plan view of a fourth embodiment of a prior art oven rack and handle.

A fourth embodiment of a handle is illustrated as handle 400 in FIGS. 7 and 8. In this configuration, the handle 400 includes a curved front handle brace 402 having side portions 404, 406. The front handle brace 402 has a curved configuration that extends across the entirety of the width of an interconnected oven rack (not shown). The side portions 404, 406 may be interconnected to or otherwise integral with the front handle brace 402 and/or left and right side braces of the interconnected oven rack. Also, the side portions 404, 406 and the front handle brace 402 may be angled downwardly as illustrated in FIG. 8. Still further, the handle 400 may include a front brace 408 positioned rearwardly of the front handle brace 402. The front brace 408 may provide a bracing and supporting means for interconnected support members of the oven rack (not shown).

Figure 10:
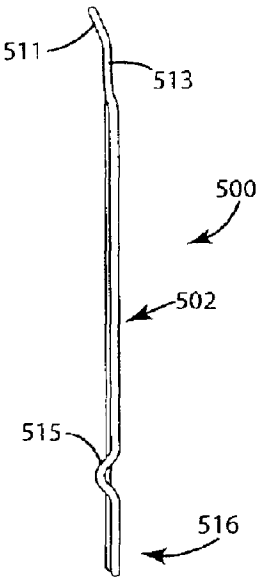
FIG. 10 is a side view of the oven rack illustrated in FIG. 9.
Figure 9:
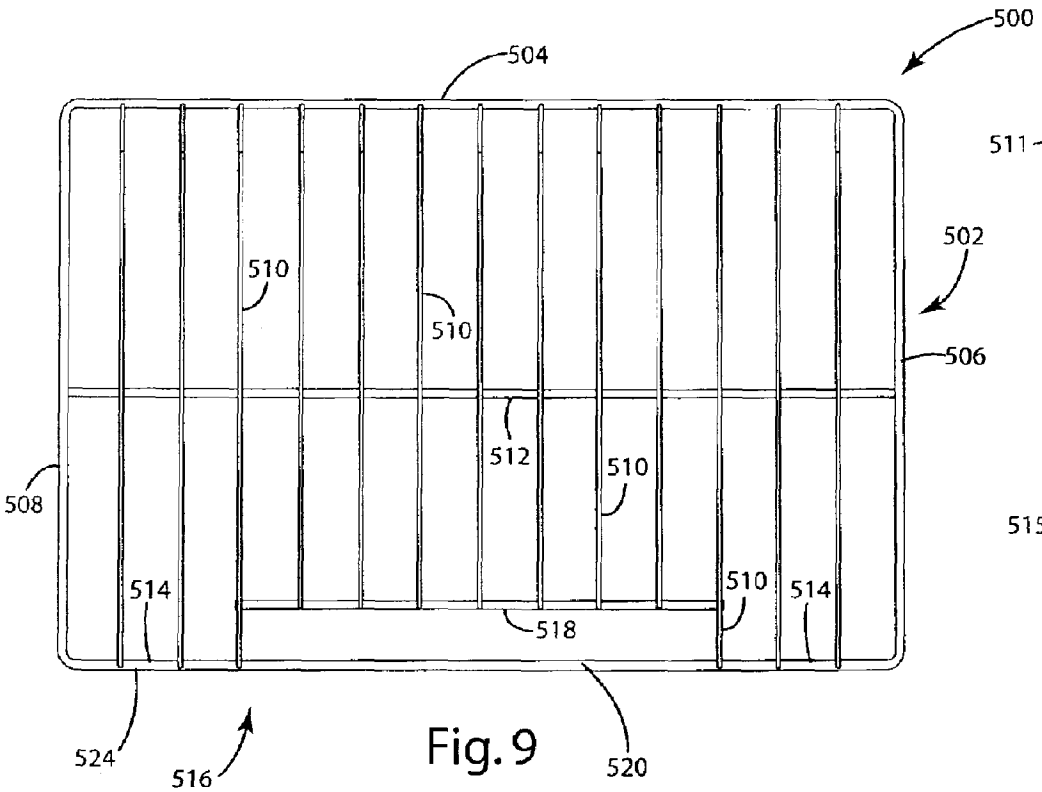
FIG. 9 illustrates a plan view of a fifth embodiment of a prior art oven rack and handle.

A fifth embodiment of a handle rack is illustrated as handle rack 500 in FIGS. 9 and 10. The handle rack 500 has a configuration which is similar to the handle rack 100 illustrated and described herein with respect to FIGS. 1 and 2. More specifically, the handle rack 500 includes an oven rack 502 with a handle 516. The oven rack 502 includes an elongated rear brace 504, positioned adjacent the rear of the oven cavity when the oven rack 502 is in its retracted and normal position. Interconnected to or otherwise integral with the rear brace 504 is a right brace 506 extending perpendicular to the rear brace 504. The right brace 506 extends between the forward and rear sections of the oven rack 502, and essentially acts as a support brace for other elements of the oven rack 502. Also, when the oven rack 502 is placed within the oven cavity, the right brace 506 will typically rest or otherwise be releasably secured on a rib or other conventional element of the oven cavity. The oven rack 502 also includes a left brace 508, parallel to the right brace 506 and interconnected to or otherwise integral with the rear brace 504. As with the right brace 506, the left brace 508 extends between the rear and front portions of the oven rack 502. The left brace 508 rests upon or is otherwise releasably secured to a rib or similar component of the oven cavity.

Positioned intermediate the right brace 506 and left brace 508 are a series of parallel and longitudinally extending elongated support members 510. The support members 510 act as the principal support members of the oven rack 502 for supporting items to be heated and cooked within the oven cavity. The rear ends of support members 510 are connected to the rear brace 504 by suitable means, such as welding or the like. As illustrated in FIG. 10, the right brace 506, left brace 508 and supported members 510 include a series of intermediate forms 513 located near the rear portions of the braces 506, 508 and support members 510. The intermediate forms 513 are connected to or are otherwise integral with angled forms 511 also shown in FIG. 10. The angled configuration of the forms 511 assists in preventing items placed on the support members 510 from falling off of the oven rack 502 over the rear brace 504.

The oven rack 502 also includes a central brace 512, extending perpendicular to the right brace 506 and left brace 508. The central brace 512 is also positioned intermediate the rear brace 504 and front brace 514. The central brace 512 provides for additional support for items placed on the oven rack 502 for purposes of heating or cooking. The central brace 512 may be connected to the support members 510, right brace 506 and left brace 508 in any conventional manner. For example, welding may be utilized.

The oven rack 502 also includes a front brace 514. The front brace 514, with reference to FIG. 9, includes a left portion 524 and a right portion 526. The front brace 514 provides a forward-bracing means for the oven rack 502. As illustrated in FIG. 9, three of the support members 510 are interconnected to the left portion 524 of the front brace 514, while three others of the support members 510 are interconnected to the right portion 526 of the front brace 514.

The handle rack 500 comprises not only the oven rack 502, but also the handle 516. The handle 516 is primarily illustrated in FIG. 9. More specifically, the handle 516 includes a rear handle brace 518, having an elongated configuration as shown in FIG. 9. The rear handle brace 518 extends parallel to the rear brace 504 and the central brace 512. As illustrated in FIG. 9, seven of the intermediate support members 510 have one end of each of the same interconnected to the rear handle brace 518.

In the handle rack 100 illustrated in FIGS. 1 and 2, as previously described herein, the handle 116 included a pair of handle sides 122 which are integral with a rear handle brace 118. In the particular handle rack 500 illustrated in FIGS. 9 and 10, although similar to the handle rack 100, the handle rack 500 does not includes any separate elements which could be characterized as "handle sides" separate and apart from the support members 510. Instead, the sides of the opening formed in the handle 516 comprise forward most sections of each of a pair of the supporting elements 510. That is, as specifically shown in FIG. 9, two of the supporting elements 510 extend from the rear brace 504 to the front brace 514, and also form the sides of the opening of the handle 516. In this regard, handle 516 also includes a front handle brace 520. The front handle brace 520, as illustrated in FIG. 9, is elongated and positioned substantially parallel to the rear handle brace 518. If desired, the front handle brace 520 can actually be a brace which is integral with the front brace 114 comprising the left portion 524 and the right portion 526.

The operation of the handle rack 500 substantially corresponds to the operation of the handle rack 100 previously described herein. That is, the user may manually grip the front handle brace 520, and exert forces in a direction corresponding to a perpendicular direction between the rear brace 504 and the front handle brace 520. These forces will cause the oven rack 502 to be extended outwardly or retracted inwardly relative to the oven cavity.

Figure 12:
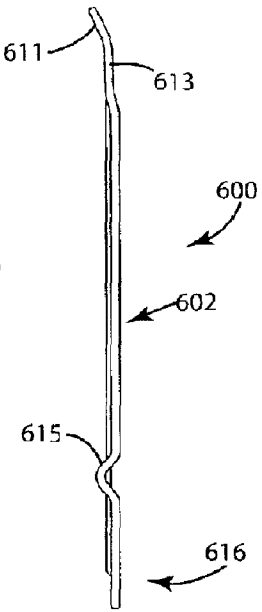
FIG. 12 is a side view of the oven rack illustrated in FIG. 11.
Figure 11:
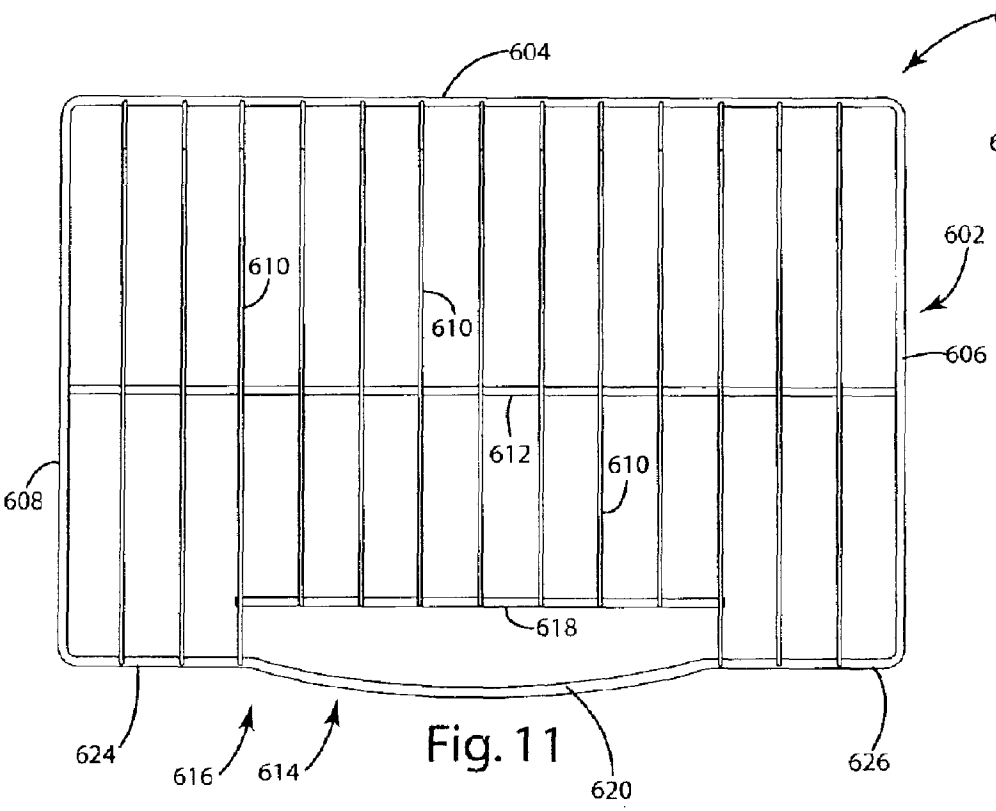
FIG. 11 is a still further embodiment of a prior art oven rack, comprising an oven rack and a handle.

A still further embodiment of a handle rack is illustrated as handle rack 600 in FIGS. 11 and 12. The handle rack 600 has a configuration which is relatively similar to the handle rack 300 previously described herein with respect to FIGS. 5 and 6. More specifically, the handle rack 600 includes an oven rack 602 and a handle 616. The oven rack 602 includes an elongated rear brace 604, right brace 606 and left brace 608. In addition, positioned intermediate the right brace 606 and left brace 608 are parallel support members 610. Intermediate forms 613 are connected to or otherwise integral with angled forms 611. A central brace 612 is also provided, positioned intermediate the rear brace 604 and a front brace 614. The front brace 614 includes a left portion 624 and a right portion 626. The handle 616 includes a rear handle brace 618 extends parallel to the rear brace 604 and the central brace 612. Seven of the intermediate support members 610 have one end of each of the same interconnected to the rear handle brace 618. Also, each opposing end of the rear handle brace 618 is interconnected to one of the support members 610, again as illustrated in FIG. 11.

In addition to the foregoing, the oven rack 602 includes a front brace 614. The front brace 614, with reference to FIG. 11, includes the left portion 624 and right portion 626. The front brace 614 provides a forward bracing means for the oven rack 602. Three of the support members 610 are interconnected to the left portion 624 of the front handle brace 614, while three others of the members 610 are interconnected to the right portion 626 of the front handle brace 614. The handle 616 includes the rear handle brace 618 as previously described herein. Also, the handle 616 includes a front handle brace 620. The front handle brace 620, as illustrated in FIGS. 11 and 12, is elongated and positioned in a manner so as to have a curved 575 configuration. If desired, the front handle brace 620 can actually be a brace which is integral with the front brace 314 comprising the left portion 624 and the right portion 626.

With the handle rack 300 illustrated in FIGS. 5 and 6, the front handle brace 320 of the handle rack 300 is angled downwardly. In contrast, with the handle rack 600, the front handle brace 620 of the handle 616 is not angled downwardly, and is essentially on the same horizontal plane as the main body of the oven rack 602.

Figure 13:
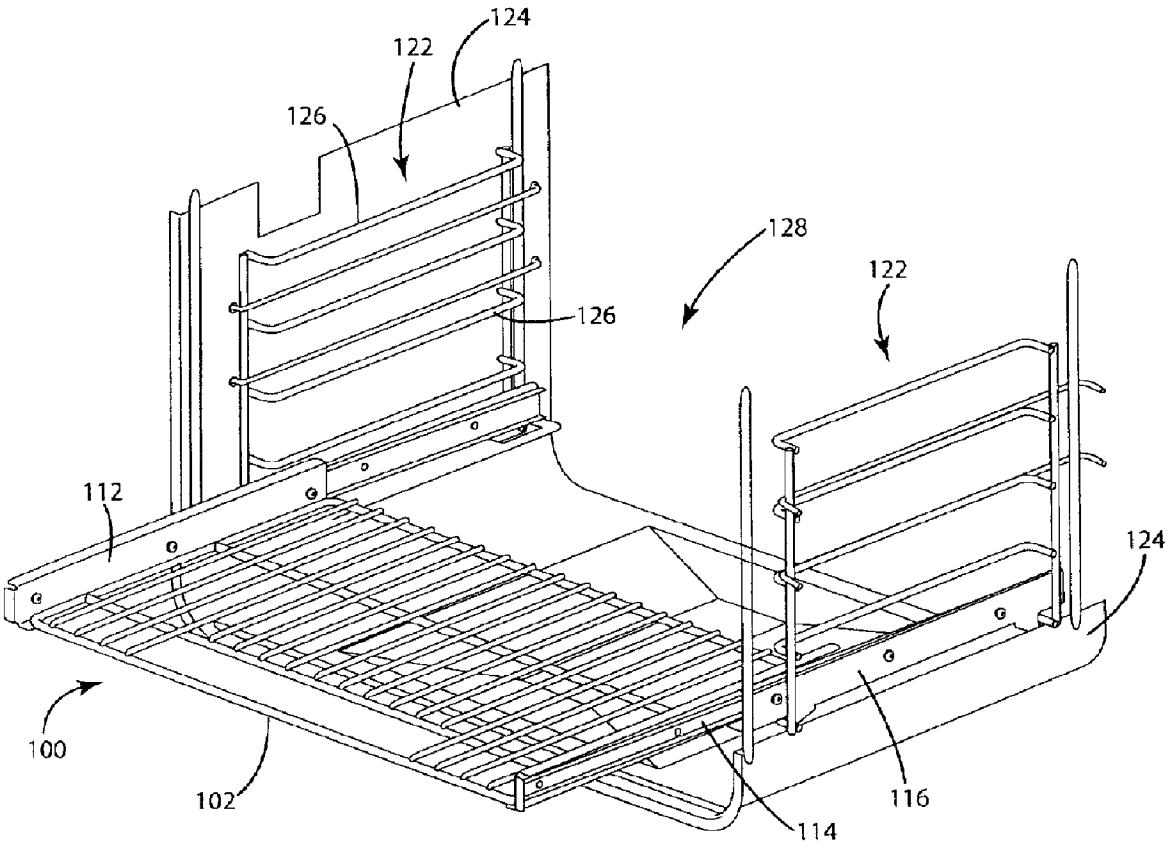
FIG. 13 is a perspective view of a further embodiment of an oven rack assembly, showing an oven interior with ladder frames.
Figure 14:
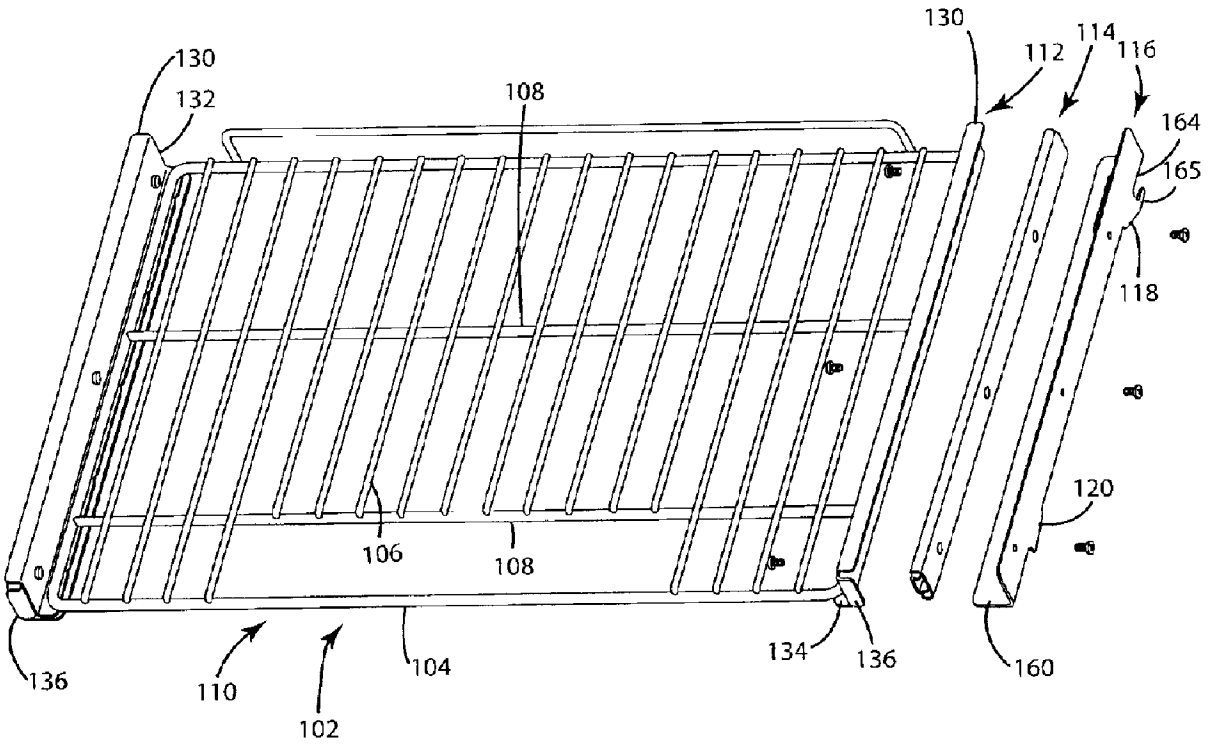
FIG. 14 is an exploded view of the oven rack assembly illustrated in FIG. 13.

The extension oven rack assembly 100', will now be described with respect to FIGS. 13-18. Turning to FIG. 13, the oven rack 100' assembly is utilized within an oven 128', having oven interior surfaces 124'. Mounted in any suitable manner to the sides of the oven interior surfaces 124' are a pair of ladder frames 122'. As shown in FIG. 13, each of the ladder frames 122' includes a series of parallel and horizontally positioned rack position tracks 126'. The ladder frames 122' are conventional in nature. As illustrated in FIG. 14 in an exploded format, the oven rack assembly 100' includes an oven rack 102'. The oven rack 102' includes a formed wire which comprises a continuous outer frame wire 104' for the oven rack 102'. The outer frame wire 104' forms the front, sides and rear of the surface area of the oven rack 102'. The oven rack 102' also includes a series of parallel and spaced apart transverse wires 106'. The surface of the oven rack 102' is also formed by a set of parallel and spaced apart cross wires 108'. The cross wires 108' may be preferably welded to the sides of the outer frame 104'. Correspondingly, the transverse wires 106' may be welded or otherwise secured to the front and rear portions of the outer frame 104', and also to intersecting transverse wires 106'. If desired, a handle 110' can be formed at the front portion of the oven rack 102'

Figure 18:
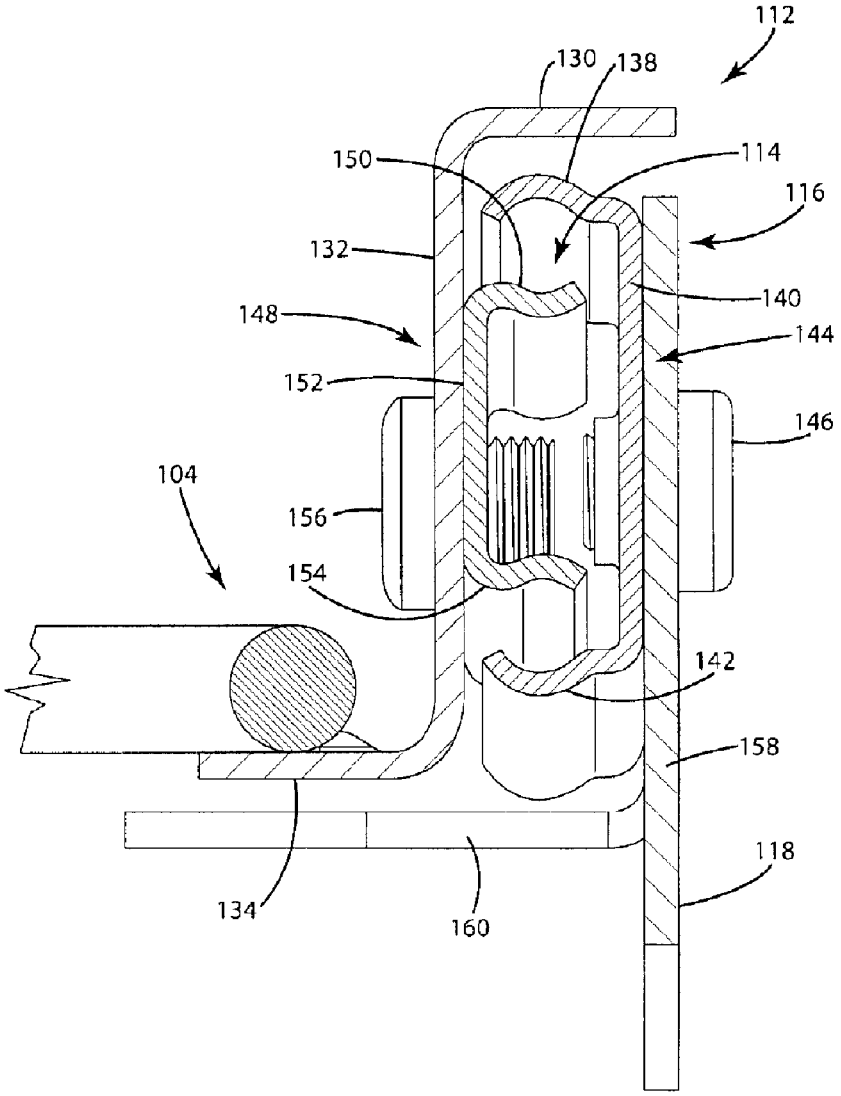
FIG. 18 is a cross section of the oven rack assembly illustrated in FIG. 13, in accordance with the invention.

With reference primarily to FIGS. 14 and 18, the oven rack assembly 100' further includes a Z-shaped support stamping 112'. The stamping 112' includes a horizontally disposed top portion 130', vertically disposed side portion 132' and horizontally disposed lower portion 134'. These elements are primarily shown in FIG. 18. As shown in FIG. 14, the support stamping 112' may also include a front face portion 136. The support stamping 112', as primarily illustrated in FIG. 18, is preferably welded to the outer frame 104' of the oven rack 102'. In FIG. 18, the lower portion 134 of the support stamping 112' is shown as being welded to the frame 104'. In this manner, when the oven rack 102' is moved between retracted and extended positions, the support stamping 112' will move in unison with the rack 102'. The support stamping 112' provides support for the oven rack. In this manner, the support stamping 112' removes the need for any type of subframe, as required in prior art systems.

Still further, the oven rack assembly 100' includes a ball bearing slide 114'. The ball bearing slide 114' is also primarily illustrated in FIGS. 14 and 18. The ball bearing slide 114', as primarily shown in FIG. 18, includes an upper portion 138, side portion 140 and lower portion 142. This portion of the ball bearing slide 114' forms an outer bracket 144 which is secured to an L-shaped connection stamping 116' described in subsequent paragraphs herein. The connection can be made through screws 146 or similar connection means. Still further, the ball bearing slide 114', as with conventional slides, includes an inner, slidable bracket 148. The bracket 148 includes an upper portion 150, side portion 152 and lower portion 154. This inner bracket 148 is secured to the Z-shaped support stamping 112', through the use of screws 156 or similar connecting means.

Again primarily with respect to FIGS. 14 and 18, the oven rack assembly 100' includes the L-shaped connection stamping 116'. The L-shaped connection stamping 116' includes a vertically disposed side section 158' and an integral, horizontally disposed lower section 160'. The lower section 160' turns inwardly toward the oven rack 102', relative to the side section 158'. As earlier described, the side section 158' is secured to the outer bracket 144' of the ball bearing slide 114'. As also earlier described, this connection can be made by the use of screws 146' or similar connection means.

Figure 15:
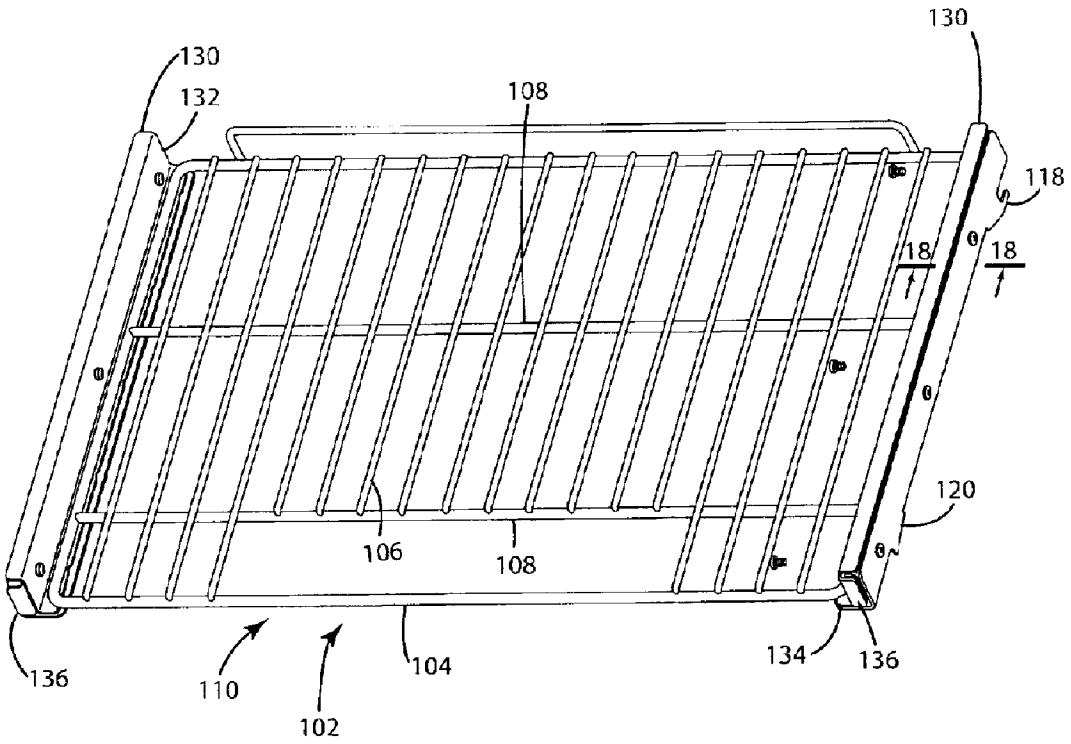
FIG. 15 is a perspective view of the oven rack assembly illustrated in FIG. 14, showing the oven rack assembly in an assembled state.

The L-shaped connection stamping 116' also includes a pair of catches 118', 120'. More specifically, the connection stamping 116' includes a rear tab catch 118' which is integral with the side section 158 and depends downwardly therefrom. As shown in FIGS. 14 and 15, the rear tab catch 118' includes a rearwardly extending finger 162'. The finger 162' acts so as to form a slot 164'. As described in subsequent paragraphs herein, the slot 164' is utilized to capture a rack position track 126' during use of the oven rack assembly 100'. The catches 118', 120' also include a front stamped tab catch 120'. As with the rear stamped tab catch 118', the front catch 120' depends downwardly from and is integral with the side section 158' of the connection stamping 116'. As apparent from the drawings, particularly FIGS. 13, 14 and 15, the support stamping 112', bearing slide 114' and connection stamping 116' are appropriately positioned on each side of the oven rack 102', and coupled to each side of the oven interior surfaces 124' through the rack position tracks 126'. It is apparent from the foregoing that the connection stamping 116', through the tab catches 118', 120', provides a connection means between the oven rack 102' and the rack position tracks 126'.

In operation, the pair of connection stampings 116' can be coupled to desired rack position tracks 126' (at a particular desired height) through the use of tabs 118', 120'. More specifically, the slot 164' of each of the rear tabs 118' is utilized to capture opposing rack position tracks 126'. As shown in both FIGS. 16 and 17, the front tab catch 120' is positioned relative to the rack position tracks 126' so as to prevent any forward movement of the connection stamping 116'. It is also apparent that when a user wishes to move the connection stamping 116' and associated oven rack assembly 100' to a different set of tracks 126', the front portion of the connection stamping 116' can be rotated upwardly, so that the front tab catch 120' is removed from horizontal alignment with the rack position track 126'. The rack position track 126', at its rear portion, can then be removed from capture by the slot 164 of the rear tab catch 118', thereby removing the connection stamping 116' from the particularly rack position track 126'.

Figure 16:
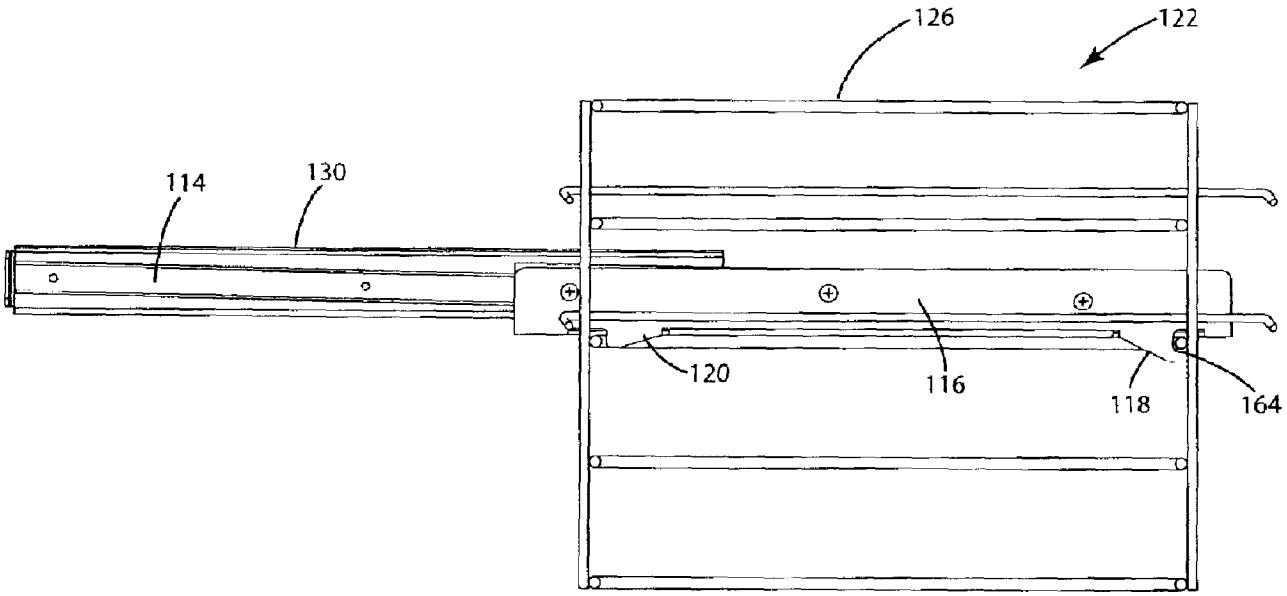
FIG. 16 is a side view of the oven rack assembly illustrated in FIG. 15, showing the oven rack in an extended state.
Figure 17:
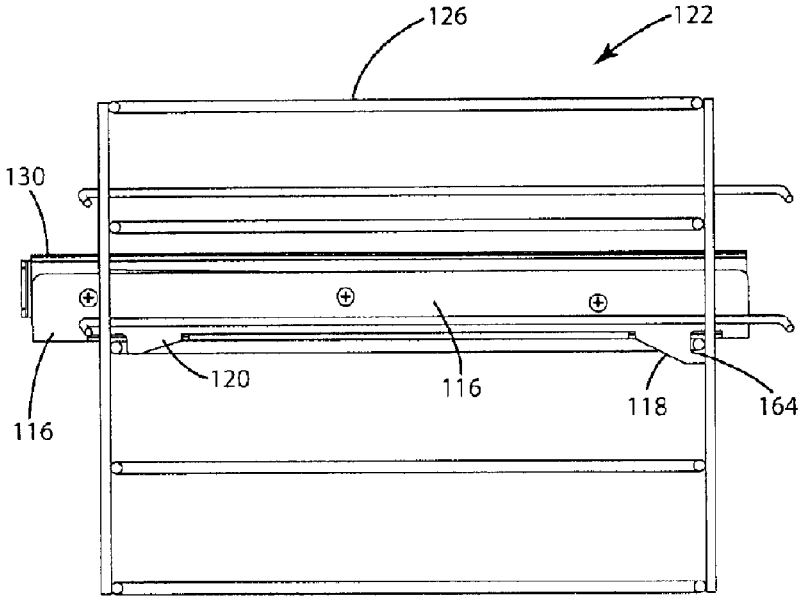
FIG. 17 is a side view of the oven rack assembly illustrated in FIG. 15, but showing the rack assembly in an unextended or retracted state.

FIG. 17 illustrates the oven rack assembly 100' in a retracted or unextended position. When it is desired to extend the oven rack 102' of the oven rack assembly 100', the user can exert forwardly directed forces (through the handle 110') on the oven rack 102'. The ball bearing slide 114' will then act so as to move forwardly relative to the connection stamping 116'. With the inner bracket 148' of the ball bearing slide 116' being coupled to the oven rack 102', this part of the ball bearing slide 114' and the oven rack 102' will move forwardly, in unison, to an extended position. Dependent upon the particular type of ball bearing slide utilized, the oven rack 102' can be permitted to move to a fully extended position (such as shown in FIG. 16), or can be limited to forward movement only to a partially extended position (not shown).

When it is desired to retract the oven rack 102', the user can exert rearwardly directed forces on the oven rack 102', and the oven rack 102' and inner bracket 144' of the ball bearing slide 114' will then move back to retracted position, as illustrated in FIG. 17.

Although the oven rack assembly 100' is shown in use with a ladder frame application in FIGS. 13-18, it is apparent that an oven rack assembly may also be utilized with ribbed liners or the like. As further apparent from the description of the oven rack assembly 100', the assembly 100' utilizes two different metal stampings, which provide support and act as a connection means between the oven rack and the ladder tracks. One stamping, namely the support stamping 112', may be welded or otherwise secured to the oven rack 102'. The other stamping, namely the connection stamping 116', provides a connection means (through the use of the tab catches 118', 120') between the oven rack 102' and the ladder tracks 126'. Also, as earlier stated, ball bearing slides 114' may be utilized, and may be of either a "full extension" or "partial extension" type. The ball bearing slides 114' are attached between the support stamping 112' and the connection stamping 116' to complete the oven rack assembly 100'.

Still further, the oven rack assemblies may utilize a porcelain coating, thereby allowing the oven rack assemblies to be left within the oven during self clean cycles. Also, other types of coatings may also be utilized, such as nickel or chrome plating.

The oven rack assembly 1000 will now be described with respect to FIGS. 19-24. A number of components of known oven rack assemblies and related oven elements have been previously described herein with respect to the handle rack 100 and oven rack assembly 100'. Accordingly, such elements will not be described in any substantial detail in subsequent paragraphs herein with respect to the oven rack assembly 1000 or other oven rack assemblies in accordance with the invention.

Figure 19:
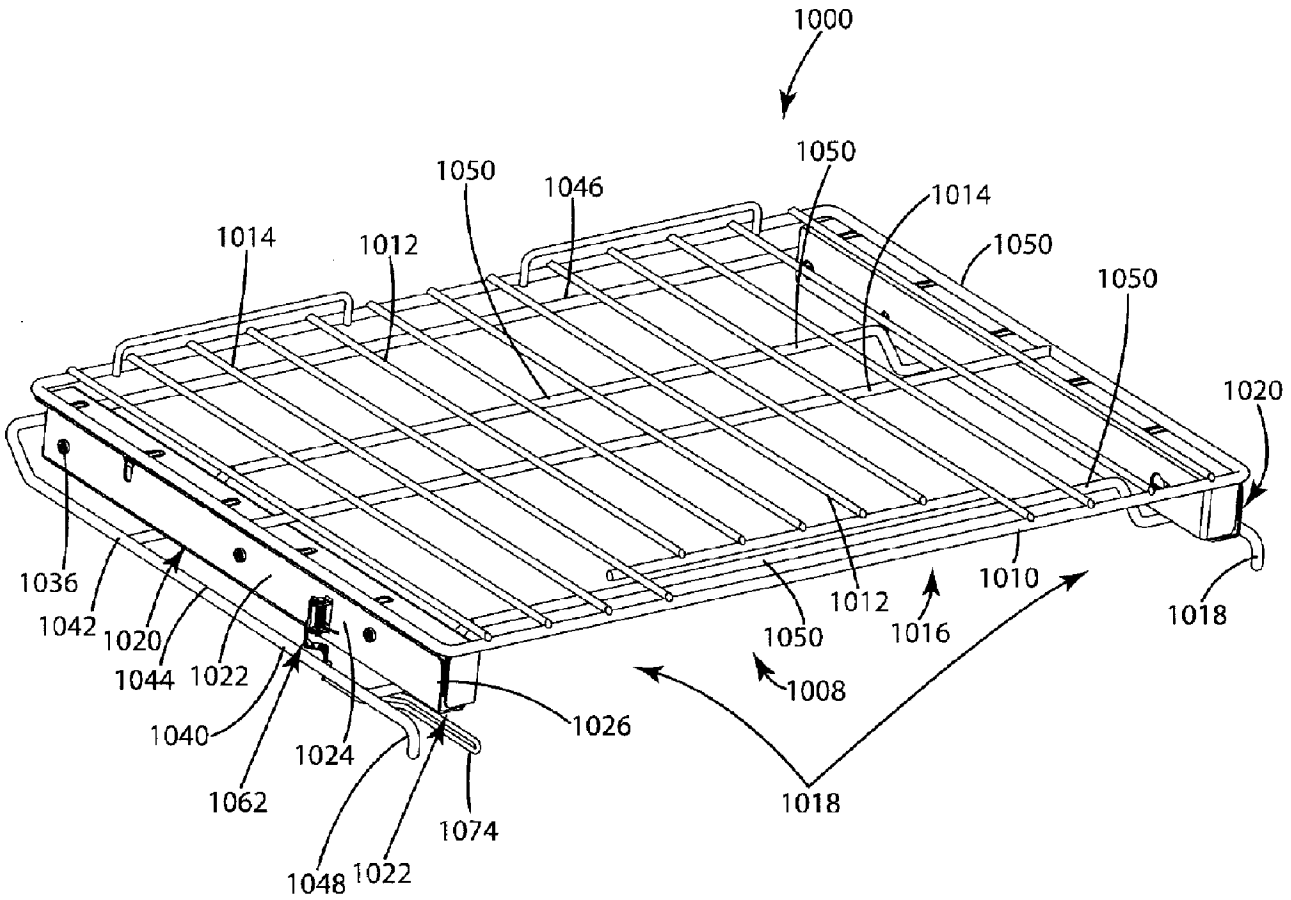
FIG. 19 is a perspective view of an oven rack assembly having a release mechanism in accordance with the invention.
Figure 23:
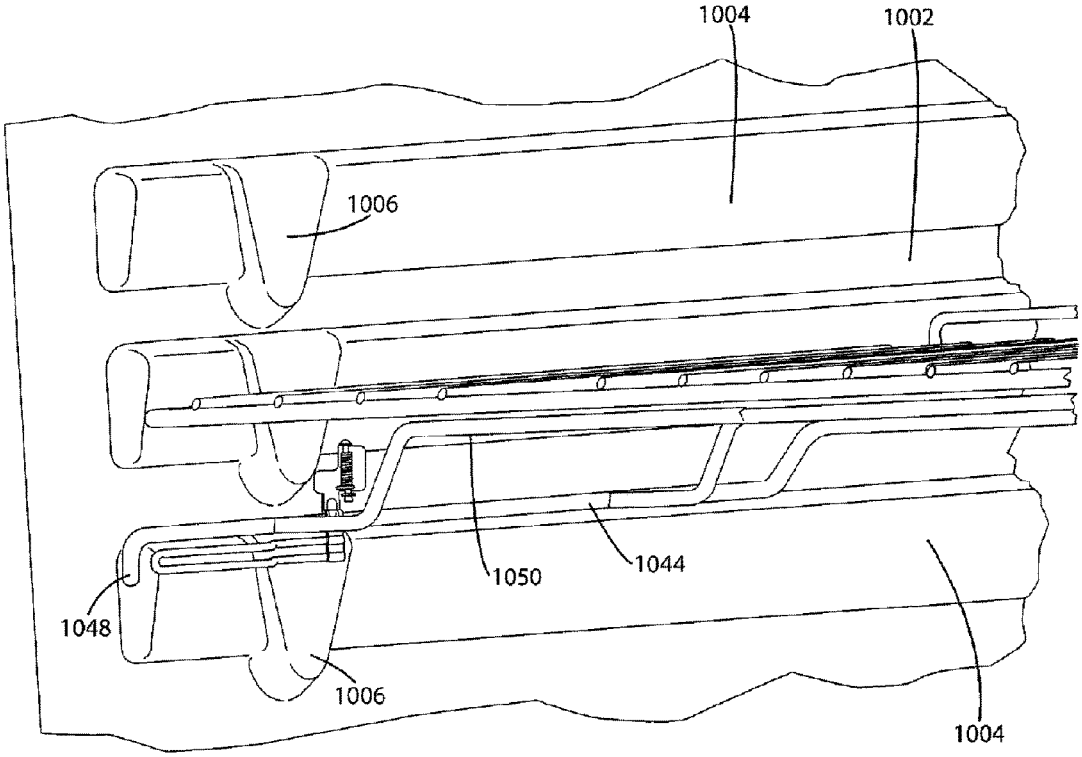
FIG. 23 is a view showing the relationship of the subframe and release mechanism of the oven rack assembly to the ribs of the oven liner, when the oven rack assembly is releasably coupled to the oven liner.
Figure 24:
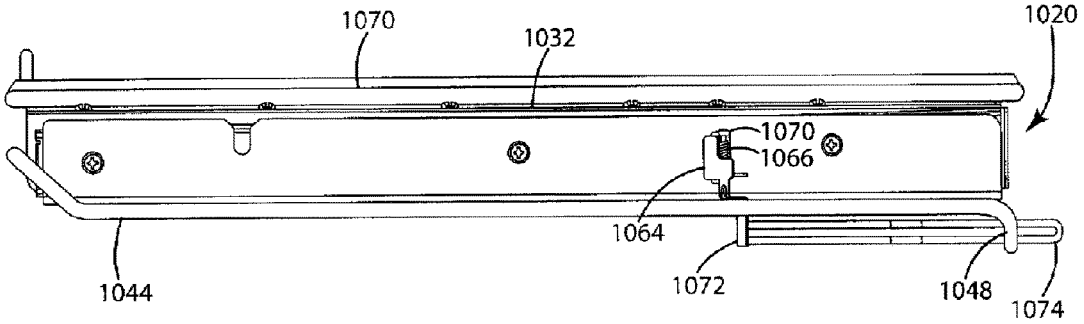
FIG. 24 is a side, elevation view similar to FIG. 21, but showing the entirety of one side of the oven rack assembly in accordance with the invention.

Turning first to FIG. 19, the oven rack assembly 1000 can be used within a conventional oven, such as the oven 128' previously described herein with respect to the oven rack assembly 100'. The oven 128' can include oven interior surfaces, such as the oven interior side surface 1002 shown in FIG. 23. Integral with or otherwise mounted in any suitable manner to the side oven interior surface 1002 are a set of liner ribs 1004 projecting therefrom, as also shown in FIG. 23. The liner ribs 1004 may be vertically stacked, as further shown in FIG. 23, for purposes of providing the capability of adjusting the height of the oven rack assembly 1000 within the oven 128'. As still further shown in FIG. 23, each of the liner ribs 1004 may be configured so as to provide for a downwardly extending nodule 1006. As will be described in subsequent paragraphs herein, and in accordance with the invention, the nodules 1006 act in cooperation with release mechanisms (subsequently described herein) so as to maintain the oven rack assembly 1000 in a stationary state, until a user wishes to remove the rack from the oven 128'.

With reference back to FIG. 19, the oven rack assembly 1000 includes an oven rack 1008. The oven rack 1008 includes a formed wire which comprises a continuous outer wire frame 1010. The outer wire frame 1010 forms a front, sides and rear of the surface area of the oven rack 1008. The oven rack 1008 also includes a series of parallel and spaced apart transverse wires 1012. The surface of the oven rack 1008 is also formed by a set of parallel and spaced apart cross wires 1014. The cross wires 1014 may be preferably welded to the sides of the outer wire frame 1010. Correspondingly, the transverse wires 1012 may be welded or otherwise secured to the front and rear portions of the outer frame 1010, and also to intersecting transverse wires 2012. If desired, a handle 1016 can be formed at the front portion of the oven rack 1008.

Figure 20:
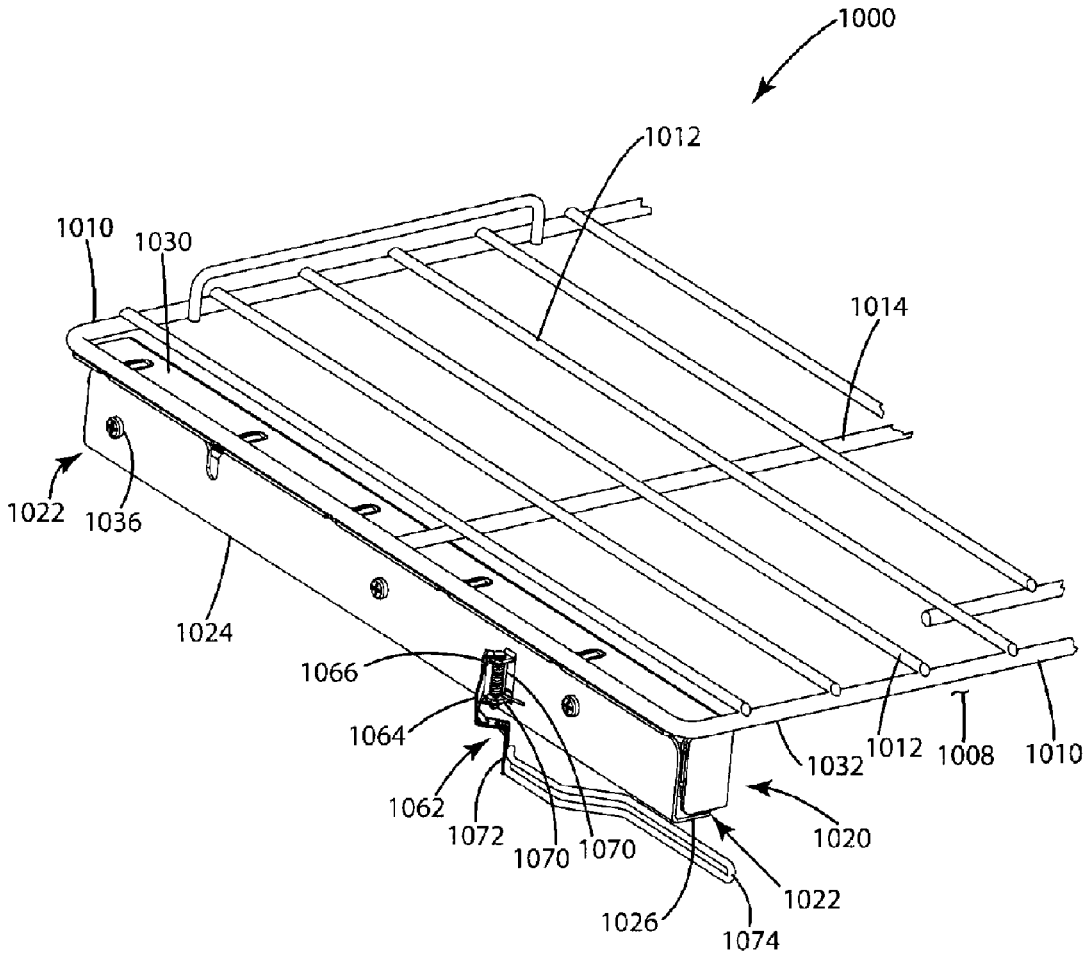
FIG. 20 is a perspective and close up view illustrating the oven rack assembly shown in FIG. 19, but with FIG. 20 only showing one side of the assembly, and with FIG. 20 showing elements of the oven rack assembly absent the subframe.
Figure 22:
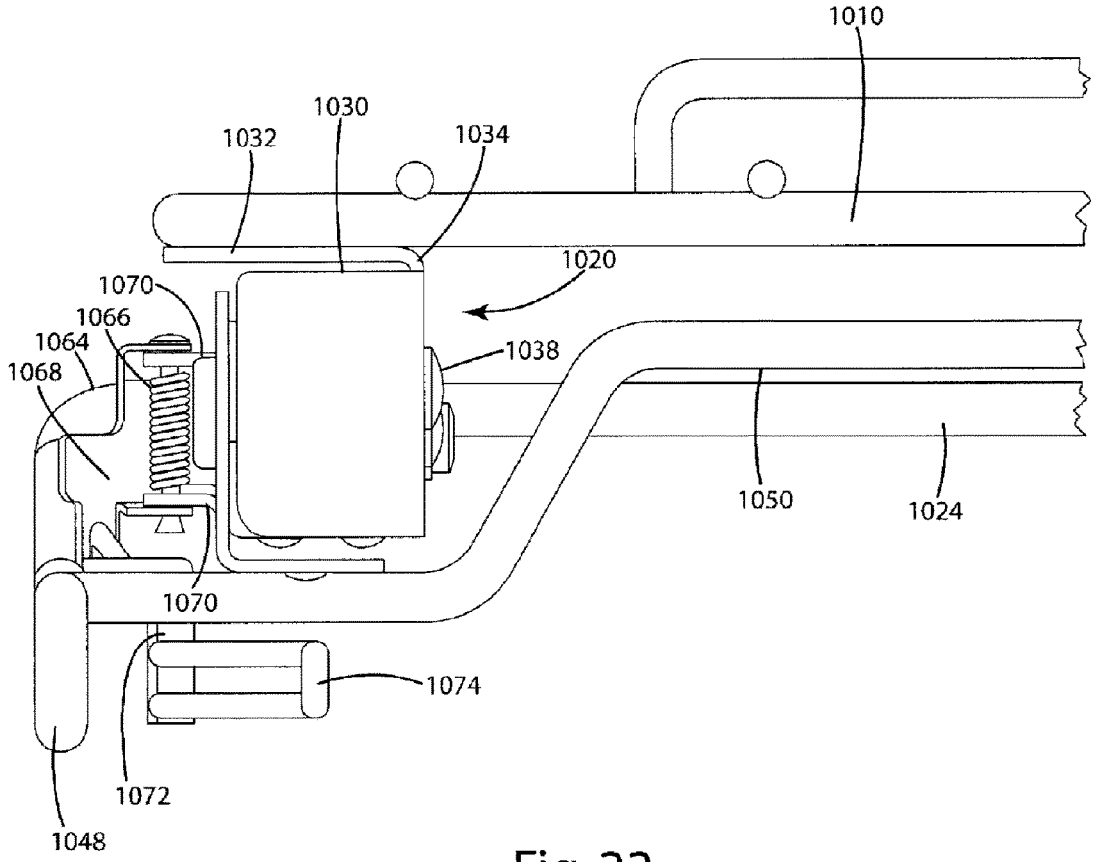
FIG. 22 is a front elevation view in relative close up showing the release mechanism of one side of the oven rack assembly, and its positioning relative to the slide system.

Still further, the oven rack assembly 1000 includes a slide system 1018. With reference primarily to FIGS. 19, 20 and 22, the slide system 1018 includes a pair of slide devices 1020 positioned at opposing sides of the oven rack 1008 as primarily illustrated in FIG. 19. Each of the slide devices 1020 includes an L-shaped outer side stamping 1022. Each side stamping 1022 includes a vertically disposed side portion 1024 and a lower horizontally disposed portion 1026 (primarily shown in FIGS. 20 and 22). In addition to the outer side stamping 1022, each of the slide devices 1020 also includes a ball bearing slide 1028, which is only slightly visible in FIGS. 20 and 22. The ball bearing slide 1028 can be substantially similar to the ball bearing slide 114' previously described in detail herein, and illustrated in FIG. 18. The ball bearing slide 1028 can be coupled in part to the side portion 1024 of the outer side stamping 1022 through the use of screws 1036, which could also be rivets or the like.

Each of the slide devices 1020 further includes an inner L-shaped stamping 1030, shown in part primarily in FIGS. 20 and 22. Each of the inner L-shaped stampings 1030 can include a top horizontal portion 1032 and a vertically extending side portion 1034. One of the side portions 1034 is partially visible in FIGS. 20 and 22. Certain elements of the ball bearing slide 1028 can be coupled to the vertical side portion 1034 of the inner stamping 1030 through the use of screws 1038, which could also be rivets or the like. Again, the details of the ball bearing slide 1028 can substantially correspond to those previously described herein with respect to the ball bearing slide 114' illustrated in FIG. 18.

In addition to the aforedescribed elements, the oven rack assembly 1000 also includes a subframe 1040. The subframe 1040 and portions thereof are primarily shown in FIGS. 19 and 21-24. More specifically, the subframe 1040 is primarily formed as a rectangle with an outer wire frame 1042. The outer wire frame 1042 includes a pair of opposing side portions 1044 and a rear portion 1046 integral therewith. At the forwardmost sections of the side portions 1044, a pair of front and downwardly depending hooks 1048 are formed. In addition, the subframe 1040 also includes a pair of cross-bars 1050 extending transversely between the opposing side portions 1044 of the frame 1042. The cross-bars 1050 provide rigidity and support for the subframe, and may be welded or otherwise connected to the side portions 1044. When the oven rack assembly 1000 is positioned in place within the oven, each of the side portions 1044 of the wire frame 1042 is supported on the top of a liner rib 1004. The relationship between one of the side portions 1044 and one of the liner ribs 1004 is shown in detail in FIG. 23. With this configuration, it is apparent from FIG. 23 that the downwardly depending front hooks 1048 of the side portions 1044 are positioned at the front ends of the liner ribs 1004. Still further, the subframe 1040 can be securely connected to the slide system 1018 through weldments or other securing means connecting the cross-bars 1050 to the lower horizontal portions 1026 of the outer side stampings 1022. With these couplings between the subframe 1040 and the slide system 1018, and the oven rack 1008 and the slide system 1018, the oven rack 1008 can be extended and retracted through operation of the ball bearing slides 1028, with the L-shaped outer side stampings 1022 and the subframe 1040 remaining in place.

In addition to the aforedescribed elements of the oven rack assembly 1000, and in accordance with the invention, the oven rack assembly 1000 further includes a retention/release assembly 1060 which provides means for facilitating retention of the position of the subframe 1040 on the liner ribs 1004, and also facilitating release of the subframe 1040 from the liner ribs 1004, when a user wishes to remove the subframe from the oven. The retention/release assembly 1060 includes a pair of retention/release devices 1062, one of which is mounted on each of the opposing sides of the oven rack assembly 1000. Because the retention/release devices 1062 are substantially identical and basically comprise "mirror" images of each other, only one of the retention/release devices 1062 is shown in most of the drawings, and only one will be described herein.

Still further, with respect to the retention/release devices 1062, the disclosure herein describes (and the drawings illustrate) one embodiment of the devices 1062. In this particular embodiment, each of the retention/release devices 1062 includes a retention spring 1066, as described in subsequent paragraphs herein. As also further described herein, each of the retention/release devices 1062 is mounted to the subframe 1040. The use of the retention springs 1066 and the mounting of the devices 1062 to the subframe 1040 are being particularly noted prior to detailed disclosure of the same herein, because of their respective relationships to the principal concepts of the invention. That is, although the devices 1062 are shown with the retention springs 1066, retention/release devices functioning in accordance with the invention do not necessarily require the retention springs 1066. Instead, the function performed by the retention springs 1066 could be achieved through the use of similar types of elements mounted elsewhere on the oven rack assembly 1000, or the spring function can be eliminated entirely. More specifically, and as described in greater detail herein, each of the retention/release devices 1062 is mounted or otherwise connected to elements of the subframe 1040. It is this relationship between the retention/release devices 1062 and the subframe 1040 which forms a principal concept of the invention.

Figure 21:
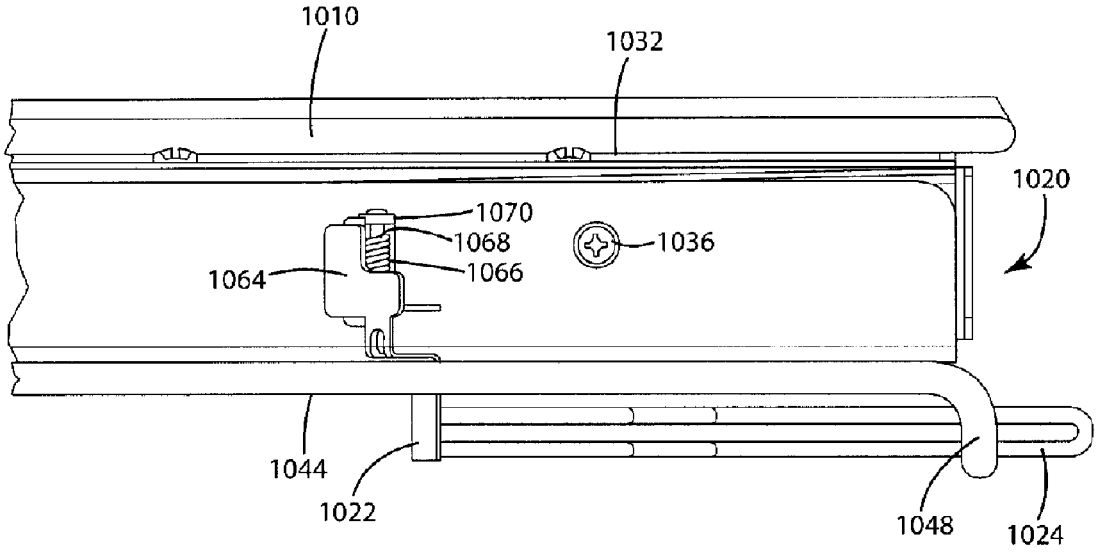
FIG. 21 is a partial, elevation view of the oven rack assembly illustrated in FIG. 19, showing relatively greater detail with respect to the release mechanism.

More specifically, and primarily with reference to FIGS. 20-24, each of the retention/release devices 1062 may include a retainer tab 1064 having a vertically disposed configuration and a shape as primarily shown in FIGS. 20, 21 and 22. As described subsequently herein, the retainer tab 1064 on each of the retention/release devices 1062 operates so as to provide a means for retaining the subframe 1040 in a particular stationary position, relative to the liner ribs 1004. Each retainer tab 1064 is at least partially rotatable, and may be coupled to a vertically disposed retention spring 1066. The retention spring 1066, in turn, is mounted in any suitable manner to the outer surface of a vertically disposed axle 1068. In turn, the axle 1068 is rotatably mounted to a bracket 1070 having bracket arms with apertures therethrough, so as to rotatably receive the axle 1068. The bracket 1070 is rigidly secured to the side portion 1024 of the corresponding L-shaped outer side stamping 1022 of the slide device 1020.

Still further, each of the retention/release devices 1062 may include a lever bracket 1072 integral with or otherwise coupled to its corresponding retainer tab 1064. As shown primarily in FIGS. 20-22, the lever bracket 1072 depends partially downwardly and is connected in any suitable manner to a lever 1074 operable by a user and having the configuration shown particularly in FIG. 20.

In operation, when there are no forces externally exerted on the lever 1074, the relative position of the retention spring 1066 and retainer tab 1064 will be one which causes the retainer tab 1064 to be directed laterally, as shown in both FIGS. 20 and 22. However, if the user exerts forces on the lever 1074 so as to cause the lever 1074 to move inwardly (i.e. toward the center of the oven rack 1008), the action of lever 1074 through the lever bracket 1072 will exert rotational forces on the retainer tab 1064. The coupling of the retainer tab 1064 to the retention spring 1066, and the capability of the retention spring 1066 to rotate on the axle 1068, will cause the retainer tab 1064 to rotate so that the tab is no longer projecting directly and laterally outwardly from the corresponding side portion 1024 of the outer side stamping 1022.

With respect to operation of the retention/release assembly 1060 and its interaction with the liner ribs 1004, reference is made primarily to FIGS. 19 and 23. When the subframe 1040 is positioned within the oven, the retainer tab 1064 on each side of the oven rack assembly 1000 will be positioned as primarily shown in FIG. 23. That is, the retainer tab 1064 will essentially abut one of the nodules 1006 associated with a corresponding one of the liner ribs 1004. That is, the retainer tab 1064 will be extended outwardly, and no forces are exerted on the lever 1074. When it is desired to remove the subframe from the oven, the user can exert inwardly directed forces on both of the retention/release devices 1062 associated with the oven rack assembly 1000. As earlier described, such exertion of forces will result in the retainer tabs 1064 being rotated away from their outwardly projecting configuration. When the retainer tabs 1064 have been rotated, the tabs 1064 are freed from abutment with the corresponding liner ribs 1004. The subframe 1040 can then be pulled forwardly for purposes of removal from the oven. It should be noted that with the interaction of the retainer tab 1064 and the retention spring 1066 of each device 1062, the retainer tab 1064 may move back into a configuration where it projects laterally outwardly, after external forces have been removed from the corresponding lever 1074. Also, as earlier described herein, the desired functional operation of the retention/release assembly 1060 may be achieved without the necessity of the retention springs 1066 or any elements functionally equivalent thereto. Still further, it is apparent from the forgoing description that when it is desired to place the subframe 1040 on the liner ribs 1004, the user can again exert inwardly directed forces on the levers 1074, so as to cause the retainer tabs 1064 to move away from an outwardly projecting configuration. The subframe 1040 can then be moved into an appropriate position and desired height within the oven, and the user can release the forces exerted on the levers 1074. This release of forces on the levers 1074 will cause the retainer tabs 1064 to again project laterally outwardly, and abut the nodules 1006 of the liner ribs 1004.

Notwithstanding the immediately foregoing description of the operation of the retention/release devices 1062, it should again be emphasized that retention/release devices can be utilized in accordance with the invention in the absence of the retention springs 1066 or other functionally equivalent elements. For example, the foregoing disclosure describes the concept of the retainer tabs 1064 moving "back" into a configuration where they project laterally outwardly, when external forces are removed from the corresponding levers 1074. However, without departing from the principal concepts of the invention, the retention springs 1066 and their associated functions can be removed, and the retainer tables 1064 and corresponding levers 1074 may remain in stationary positions, absent any forces externally applied to the levers 1074. Accordingly, the user would exert forces on the levers 1074 not only when it is desired to removed the subframe from the oven, but also when it is desired to again extend the retainer tabs 1064 laterally outward. Still further, it is apparent from the disclosure herein that devices other than the levers 1074 may be utilized, without departing from the principal concepts of the invention.

Another concept of oven rack assemblies in accordance with the invention is embodied within an oven rack assembly 1200 as illustrated in FIGS. 25-32. In brief summary, the oven rack assembly 1200 in accordance with the invention provides for the use of rearwardly located catches for purposes of supporting a subframe of the assembly 1200, and preventing "tipping" of the assembly 1200 which may result from cantilever forces occurring as a result of the oven rack assembly 1200 being extended. Still further, the use of the rearwardly located catches serves to hold the subframe in place, and facilitates sliding movement of the associated slide devices and oven rack.

Figure 25:
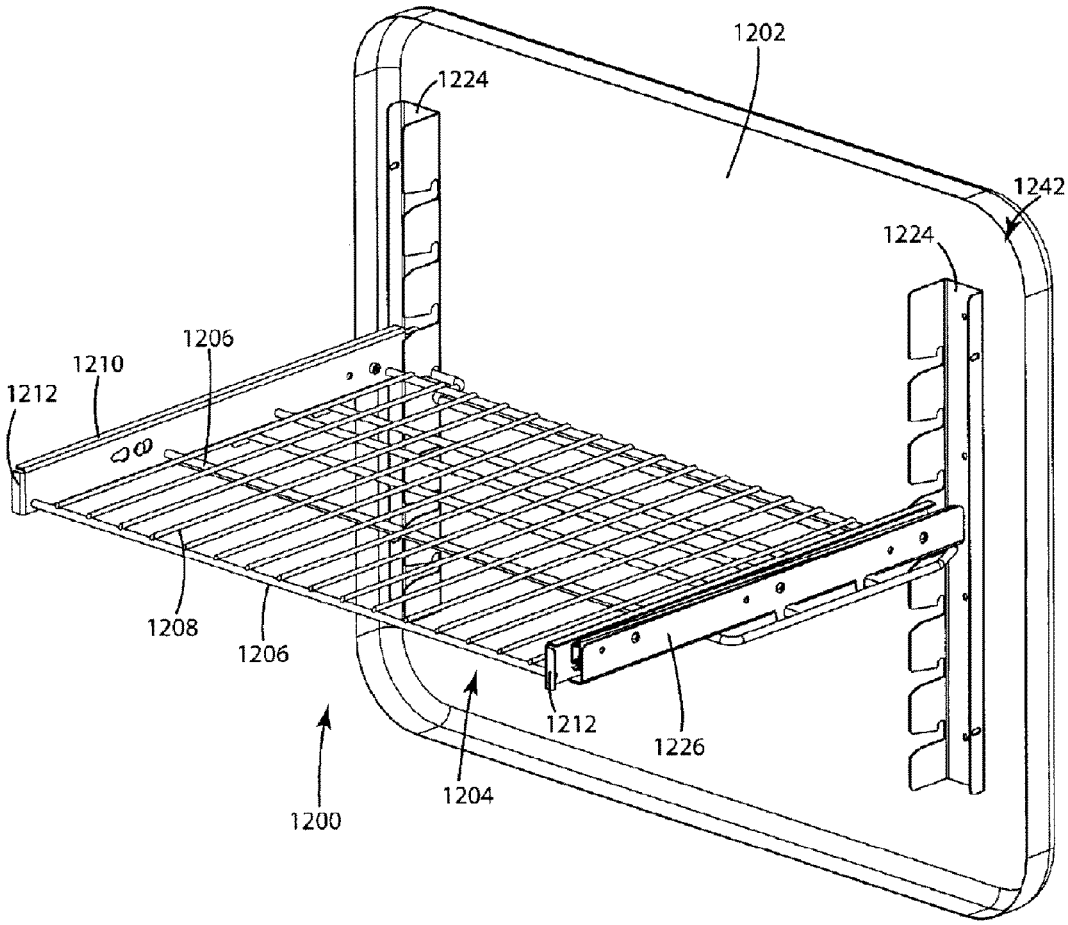
FIG. 25 is a further embodiment of an oven rack assembly in accordance with the invention, showing the coupling of the subframe of the oven rack assembly to rear ladder catches.
Figure 26:
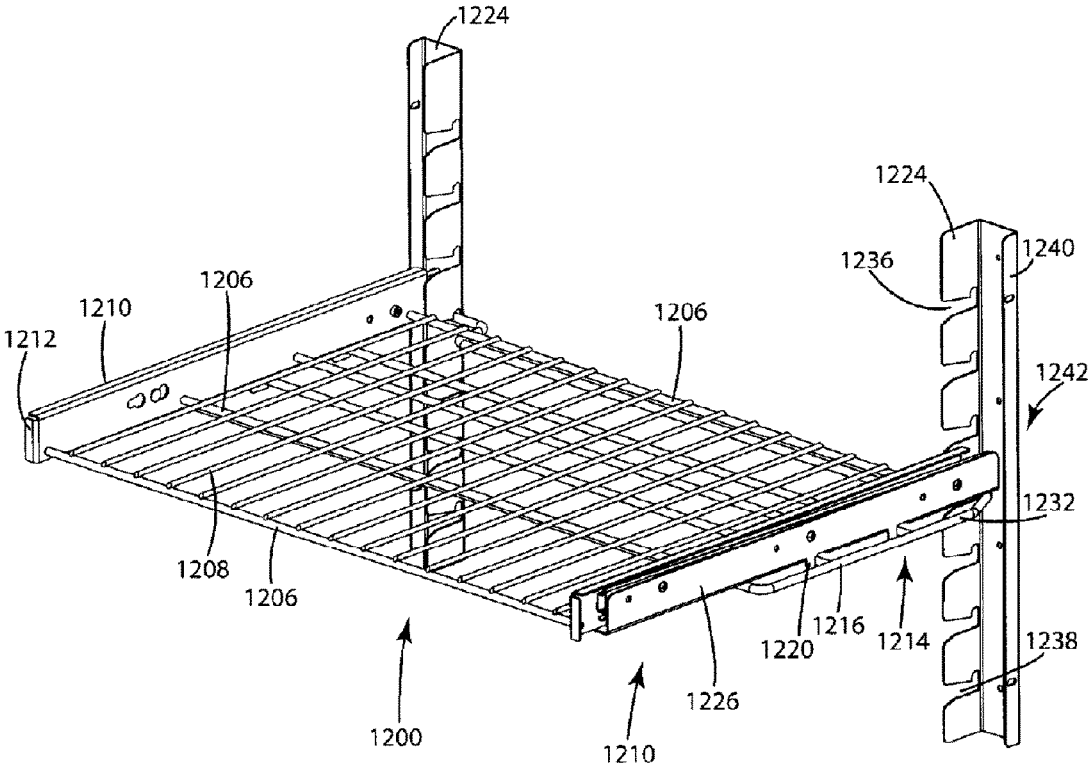
FIG. 26 is a perspective and close up view (relative to FIG. 25) showing the rear ladder catches of FIG. 25 absent the rear wall of the oven liner.
Figure 27:
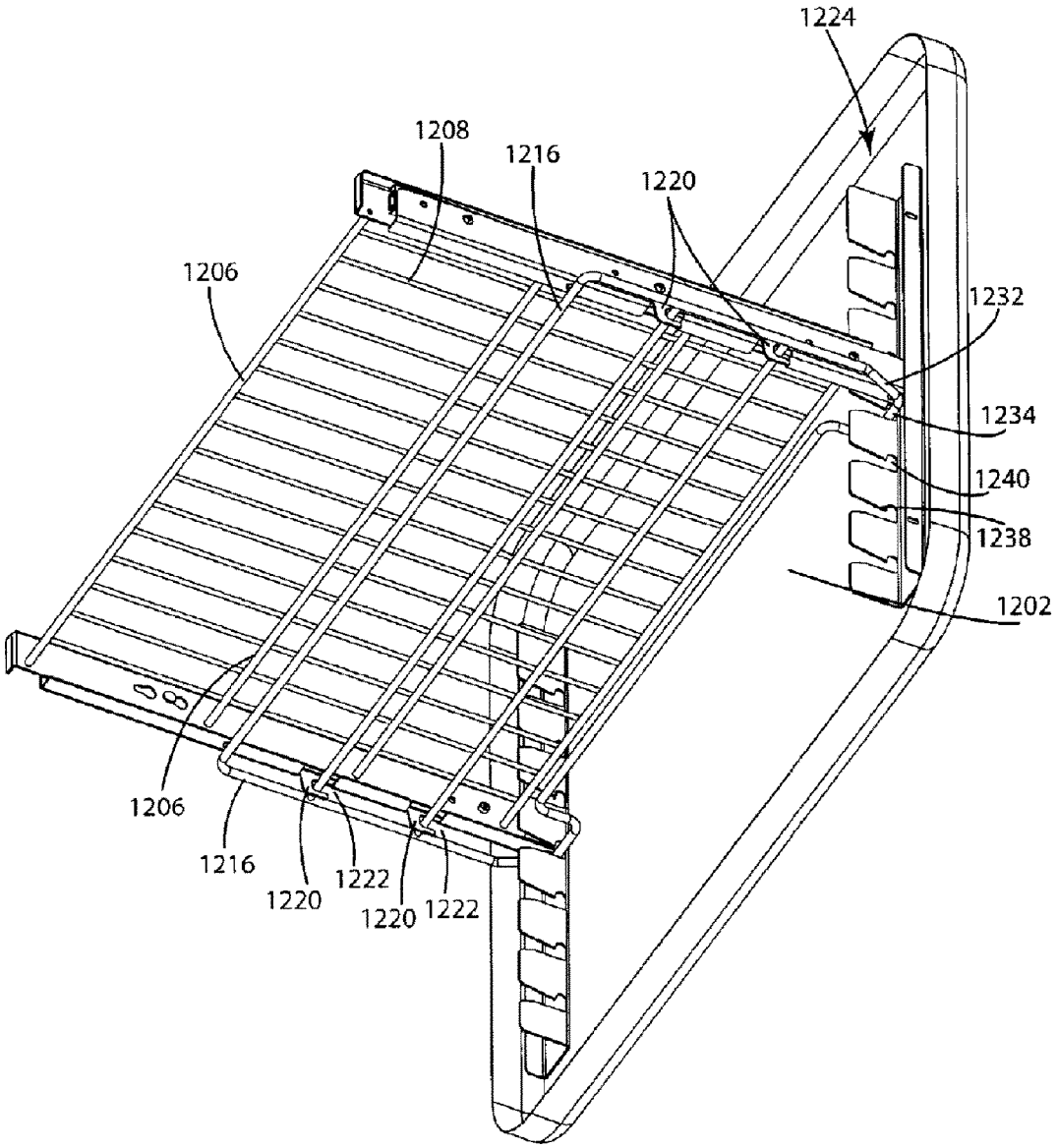
FIG. 27 is an underside, perspective view of the further embodiment of the oven rack assembly in accordance with the invention, showing various elements of the assembly, including the rear ladder catches.

Turning to the drawings, and first with respect primarily to FIGS. 25-29, the oven rack assembly 1200 is supported (as described in greater detail herein) through a pair of ladder catches 1224 vertically mounted on an oven interior rear surface 1202 (FIGS. 25 and 27). At this point in the disclosure, it should be noted that most of the subsequent disclosure herein includes description of the ladder catches 1224 as being mounted to a rear surface of the oven interior. However, without departing from the principal concepts of the invention, the ladder catches can also be mounted to both the rear and the sides of the oven interior, or to only the sides of the oven interior. The oven rack assembly 1200 itself includes a number of components similar to those previously described herein with respect to the oven rack assembly 1000. Such components will not be described in any significant detail in subsequent paragraphs herein. More specifically, the oven rack assembly 1200 can be used with a conventional oven, such as the oven 128' previously described herein with respect to the oven rack assembly 1000 and the oven rack assembly 100'. The oven interior rear surface 1202 comprises an interior surface of the oven. Although not shown in FIGS. 25-32, the oven can also include side surfaces, such as the side oven interior surfaces 1002 previously described herein with respect to the oven rack assembly 1000. Correspondingly, such side oven interior surfaces 1002 can also include sets of liner ribs 1004 projecting therefrom, as shown in FIG. 23 with respect to the oven rack assembly 1000. Further, however, other types of oven side elements can be utilized, in substitution for the liner ribs 1004. Also, and as earlier described herein, side oven interior surfaces 1002 may be utilized to mount ladder catches in accordance with the invention.

The oven rack assembly 1200 includes an oven rack 1204. As shown in the drawings, the oven rack 1204 includes a set of parallel and spaced apart cross wires 1206. Welded to or otherwise connected to the cross wires 1206 are a set of parallel and spaced apart 865 transverse wires 1208. The transverse wires 1208 essentially provide the oven rack surface.

The spaced apart cross wires 1206 can each be connected at their respective ends to a pair of opposing slide devices 1210. The slide devices 1210 can be substantially similar to the slide devices 1020 previously described herein with respect to the rack assembly 1000. That is, the slide devices 1210 can each include an outer stamping 1226 and ball bearing slide 1212. The ends of the cross wires 1206 can be coupled into the ball bearing slides 1212 in any suitable manner.

Figure 32:
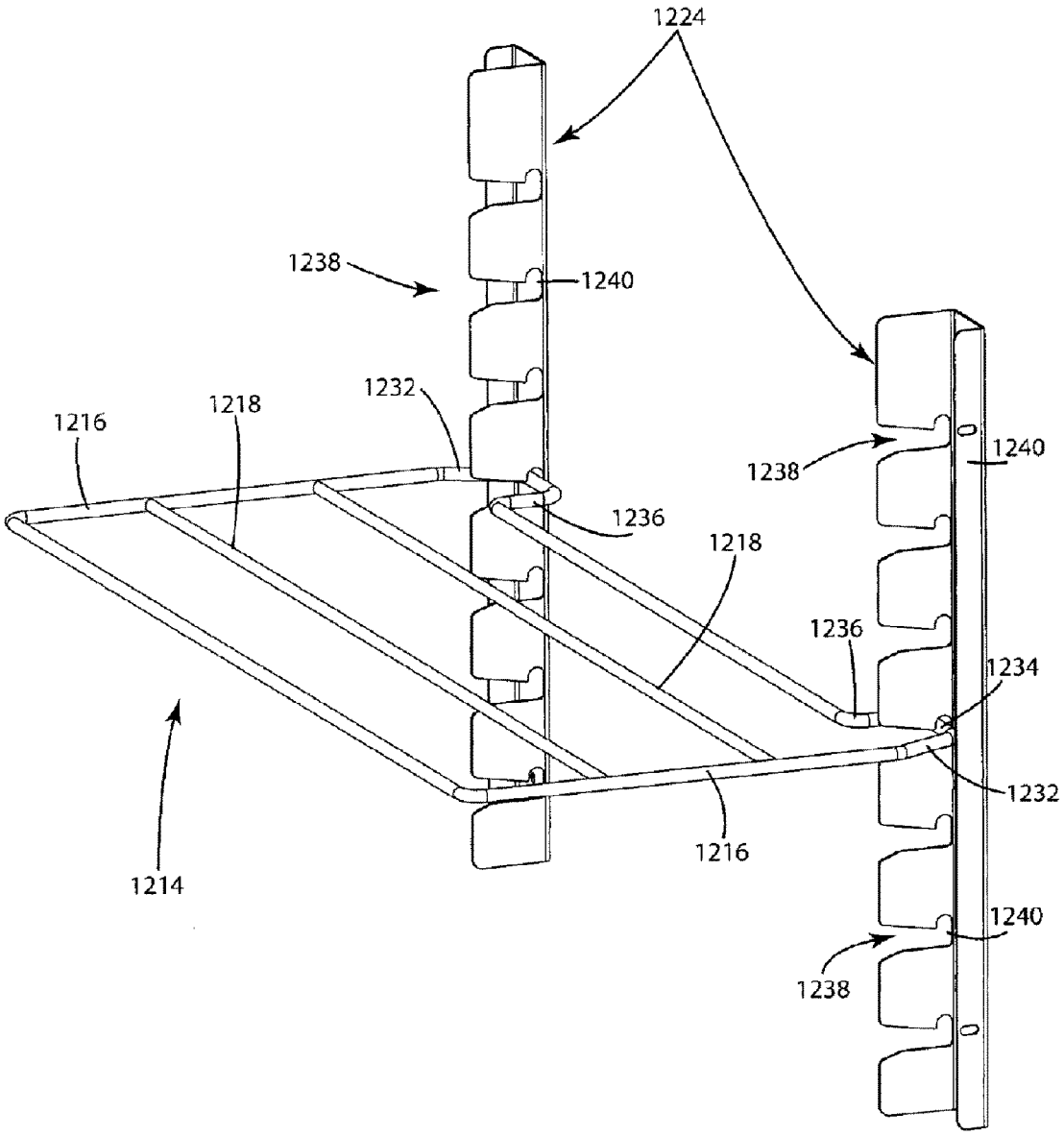
FIG. 32 is a perspective and stand-alone view, showing the positionable relationship of the subframe and the pair of rear ladder catches, when the subframe is releasably coupled to the ladder catches.

In addition to the oven rack 1204, the oven rack assembly 1200 also includes a subframe 1214. The subframe 1214 is particularly shown in a stand alone configuration (i.e., independent of the oven rack 1204 and slides devices 1210) in FIG. 32. With reference to FIG. 32 and others of the drawings, the subframe 1214 includes a continuous outer wire frame 1216 having the shape and configuration again primarily shown in FIG. 32. A pair of parallel and spaced apart cross wires 1218 extend between opposing sides of the outer wire frame 1216, and can be welded or otherwise suitably connected to the wire frame 1216.

Reference is now made to FIG. 27, with respect to certain elements of the coupling between the subframe 1214, slide devices 1210 and oven rack 1204. With reference thereto, each of these slide devices 1210 includes a pair of tabs 1220 extending vertically downward from the bottom surfaces of the slide devices 1210. These tabs 1220 can be coupled to the slide devices 1210 in any suitable manner. It should be noted that the tabs 1220 will be coupled to portions of the slide devices 1210 which remain stationary when the ball bearing slides 1212 are operated so as to extend the oven rack 1204 outwardly from the oven interior. As further shown in FIG. 27, each of the tabs 1220 includes a slot 1222 which opens toward the oven interior rear surface 1202. As still further shown in FIG. 27, when the subframe 1214 is coupled to the oven rack 1204 and slide devices 1210, each of the cross wires 1218 of the subframe 1214 will have one end captured within the slots 1222 of the tabs 1220. This slot capture will assist in supporting the oven rack 1204 on the subframe 1214. Still further, the tabs 1220 function so as to facilitate relative positioning of the subframe 1214 and remaining portions of the oven rack assembly 1200. Also, it should be noted that the slide devices 1210 may, if desired, be welded or otherwise fixedly connected to the subframe 1214. Still further, and although not specifically shown in the drawings, the sides of the outer wire frame 1216, when the subframe 1214 is positioned within the oven interior, will preferably rest on oven liner ribs, such as the liner ribs 1004 previously described herein with respect to the oven rack assembly 1000.

Figure 28:
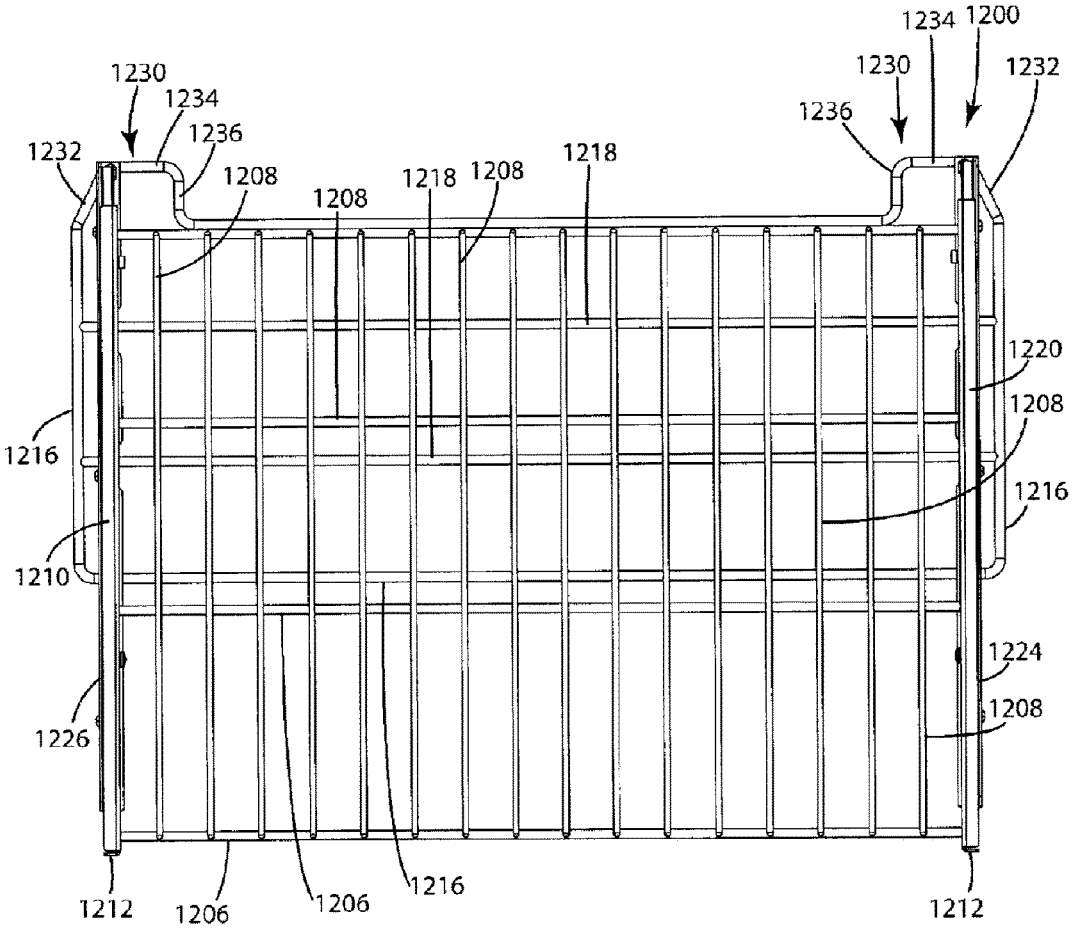
FIG. 28 is a top, plan view of various elements of the further embodiment of the oven rack assembly in accordance with the invention.
Figure 29:
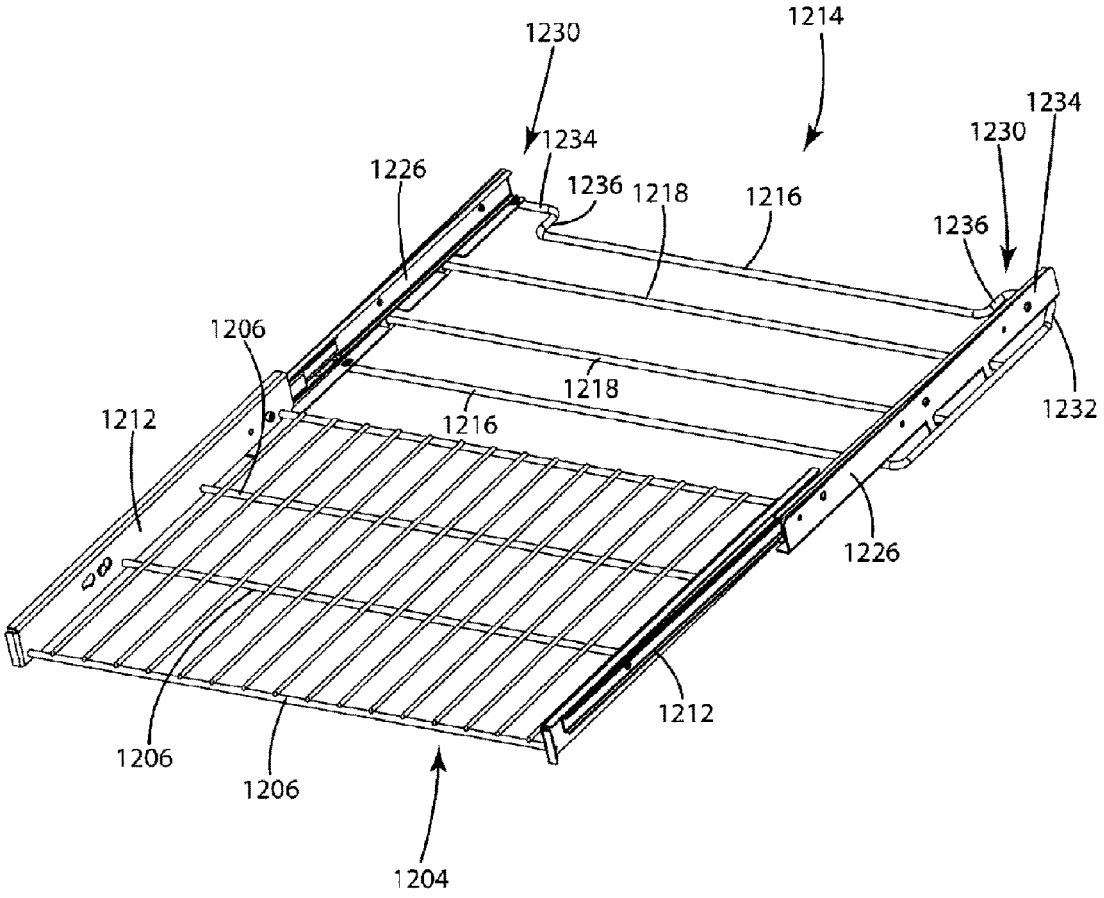
FIG. 29 is a perspective and stand-alone view of the oven rack and slide system used with the rear ladder catches, with the oven rack in an extended position.

In addition to the aforedescribed elements of the oven rack assembly 1200, the assembly 1200 also includes a rear ladder catch system 1242. The rear ladder catch system 1242 incorporates certain principal concepts in accordance with the invention. For purposes of the description, reference is first made back to elements of the subframe 1214. With reference primarily to FIGS. 28 and 32, and as previously described herein, the subframe 1214 includes an outer wire frame 1216. As particularly shown in FIG. 28, located to the rear and to the corners of the subframe 1214 are a pair of opposing outer frame catch sections 1230. These catch sections 1230 preferably form continuous sections of the outer wire frame 1216. More specifically, and again referring primarily to FIGS. 28 and 32, each of the outer frame catch sections 1230 includes an angled portion 1232 extending rearwardly from a corresponding side of the frame section 1216. Formed integral with the angled portion 1232 is a catch portion 1234 which essentially extends laterally relative to the front and rear of the oven. Projecting forwardly from one end of the catch portion 1234, essentially at a right angle thereto, is a longitudinal portion 1236. The longitudinal portion 1236 is integral with the laterally extending rear portion of the wire frame 1216.

In addition to the outer frame catch section 1230, the rear ladder catch system 1242 also includes a pair of vertically oriented ladder catches 1224, having a shape and configuration as primarily shown in FIGS. 26 and 30-32. With reference thereto, each of the rear ladder catches may be fixedly attached to the oven interior surface 1202 (as shown in the drawings or, alternatively, may be additionally or alternatively attached to side walls of the oven. The purpose of the ladder catches 1224 is to hold a rear portion of the subframe 1214 in place, through interaction with the outer frame catch sections 1230. The use of the rear ladder catch system 1242 may be advantageously substituted for the use of any type of release mechanisms involving tabs or other devices which interact with ribs or similar elements on oven side liners. With the rear ladder catch system 1242 in accordance with the invention, the subframe 1214 design is relatively less complicated, and relatively easier to manufacture.

Further, and in accordance with prior descriptions herein, the oven rack assembly 1200 is one which incorporates an oven rack which can be extended outwardly through the use of ball bearing slides. With such extension, cantilever forces are exerted on the subframe, which is to remain stationary during oven rack extension. Such cantilever forces can facilitate the tendency of the subframe to "tip" downwardly at its front portion. However, the rear ladder catch system 1242 in accordance with the invention essentially provides an "anti-tip" feature for the subframe.

Turning now to the specifics of the ladder catches 1224, each of the rear ladder catches may be a stamped metal part. Each ladder catch 1224 is vertically disposed and includes a series of spaced apart ladder catch openings 1238 as particularly shown in FIGS. 26 and 30-32. Each ladder catch opening 1238 is open toward the front of the oven rack assembly 1200. Located at the rear of each ladder catch opening 1238, and positioned upwardly therefrom, is a ladder catch slot 1240. Each ladder catch slot 1240 opens downwardly toward its corresponding ladder catch opening 1238.

Figure 30:
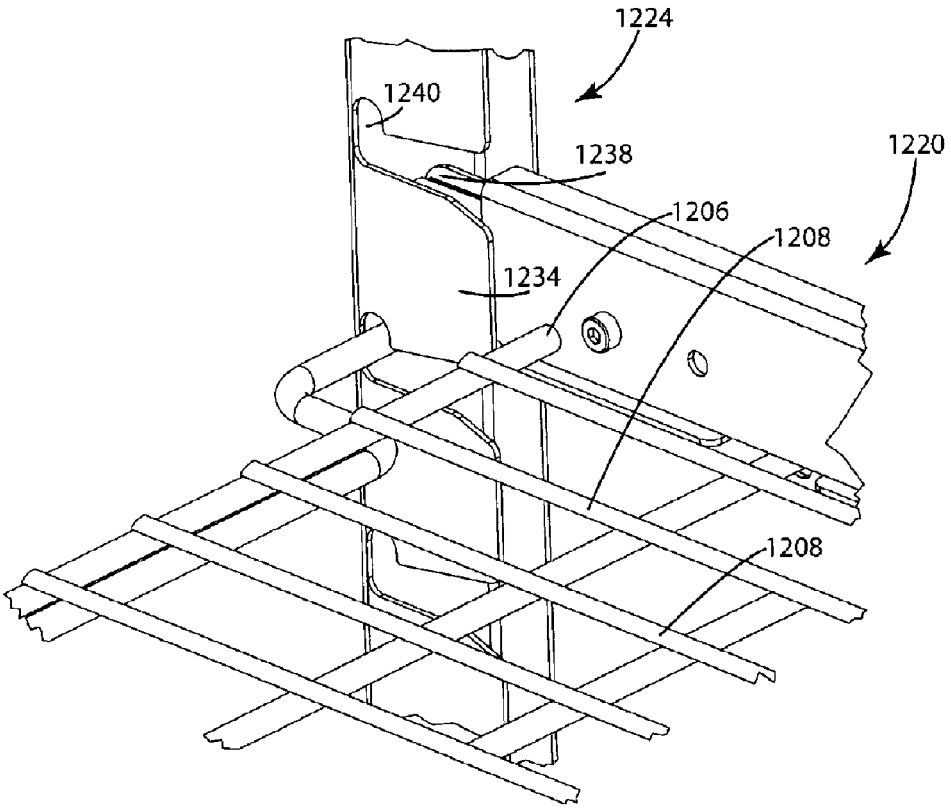
FIG. 30 is a perspective and close up view showing the releasable coupling of one portion of the oven rack with one of the rear ladder catches.
Figure 31:
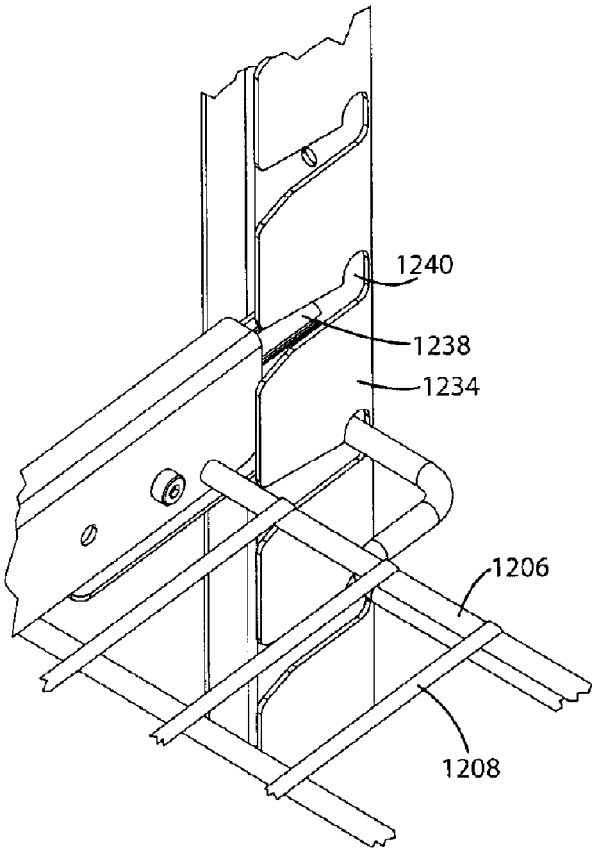
FIG. 31 is a perspective and close up view similar to FIG. 30, but showing a portion of the oven rack as it is releasably coupled to the other rear ladder catch.

As shown particularly in FIGS. 30-32, the subframe 1214 can be mounted to the rear ladder catches 1224 by inserting the catch portion 1234 of the outer frame catch sections 1230 into the ladder catch openings 1238. When the catch portions 1234 are fully inserted into the catch openings 1238, the catch portions 1234 can be received within the ladder catch slots 1240. With the configuration of the subframe 1214 and the weight of its components forward of the catch portions 1234, the catch portions 1234 will move partially upwardly into the catch slots 1240. Correspondingly, the opposing sides of the outer wire frame 1216 can rest on oven liner ribs or similar components associated with the sides of the oven liner (not shown in FIGS. 30-32). The oven rack 1204 and the associated slide devices 1210 can be removably coupled to the subframe 1214 as described in previous paragraphs herein.

The prior description of the rear ladder catch system 1242 has included disclosure with respect to the use of a full-sized oven rack. However, the concept of the rear ladder catch system 1242 can also be utilized with other types of oven racks, such as the half-rack assembly 1400 illustrated in FIGS. 33 and 34. The concepts of the use of ladder catches 1224 as previously described with regard to oven rack assembly 1200 are substantially identical to the concepts and elements associated with the use of ladder catches with half-rack assembly 1400. Accordingly, neither FIG. 33 nor FIG. 34 illustrates any type of ladder catch, since the assembly 1400 can be utilized with the ladder catches 1224 previously described herein.

Figure 33:
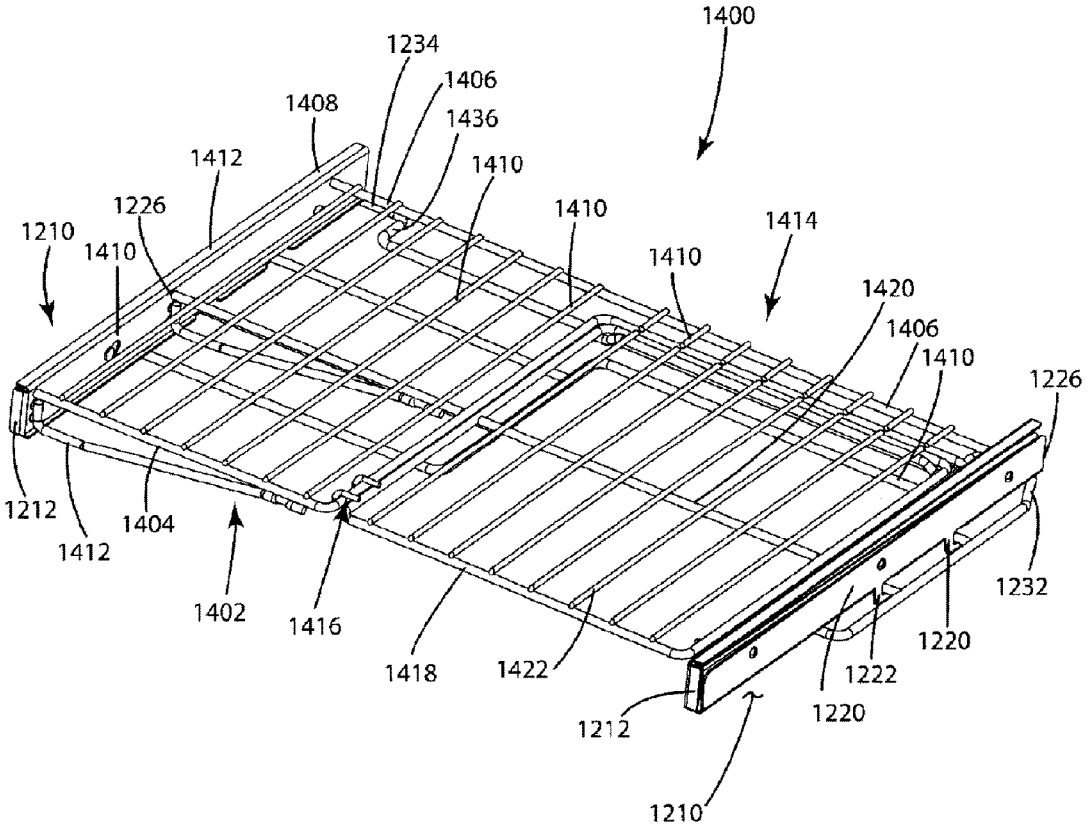
FIG. 33 is a perspective view of an alternative embodiment of an oven rack assembly and ladder catches in accordance with the invention, showing a stand alone view of a half rack and the slide system associated therewith.
Figure 34:
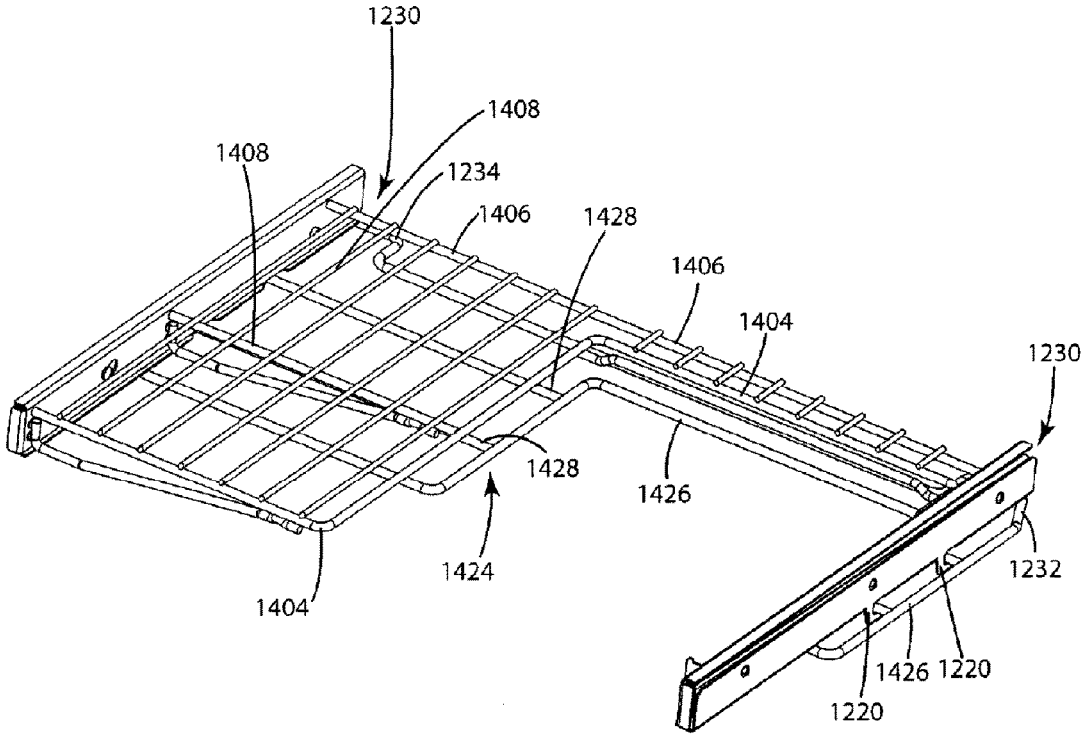
FIG. 34 is a perspective and stand alone view similar to FIG. 33, but showing the oven rack assembly with the half rack removed from the assembly.

With reference to FIGS. 33 and 34, a half-rack assembly 1400 is shown, having a permanent rack 1402 and a removable half-rack 1414. The concept of removable half-rack assemblies is known in the art. The permanent rack 1402 includes an elongated front wire frame 1404 having the configuration primarily shown in FIG. 34. The rack 1402 also includes a rear wire 1406. Cross wires 1408 also form part of the permanent rack 1402. The ends of the wire frame 1404, rear wire 1406 and cross wires 1408 are connected either to the slide devices 1210 or, in the case of the cross wires 1408, to both a slide device 1210 and to the front wire frame 1404. Correspondingly, the permanent rack 1402 also includes a series of parallel and spaced apart transverse wires 1410. These wires extend from the front to the rear of the permanent rack 1402. Still further, the permanent rack 1402 also includes a series of support braces 1412. As shown in FIGS. 33 and 34, one end of each support brace 1412 is welded or otherwise connected to a slide device 1210, while the other end of each support brace 1412 is welded or otherwise connected to the front wire frame 1404 or the cross wire 1408.

As with the oven rack assembly 1200, the half-rack assembly 1400 also includes the slide devices 1210, with each slide device having a ball bearing slide 1212 and an outer stamping 1226. Extending downwardly from each slide device 1210 are a set of tabs 1220, with slots 1222 opening toward the rear of the half-rack assembly 1400. The half-rack assembly 1400 also includes a removable half-rack 1414, as illustrated in FIG. 33. The removable half-rack 1414 includes a rack connector 1416 utilized to connect to and to obtain support from the permanent rack 1402. The half-rack 1414 also includes an outer wire frame 1418, along with a cross wire 1420. Transverse wires 1422 extend between front and rear portions of the outer wire frame 1418. In addition to the foregoing components, the half-rack assembly 1400 also includes a subframe 1424. The subframe 1424 is best illustrated in FIG. 34. As shown therein, the subframe 1424 includes an outer wire 1426 which is continuous and forms a periphery of the subframe 1424. A series of cross wires 1428 extend between opposing legs of the outer wire 1426. As with the subframe 1214 previously described with the oven rack assembly 1200, the subframe 1424 also includes, as portions of the outer wire 1426, outer frame catch sections 1230, located at the rear and opposing corners of the half-rack assembly 1400. Each of the outer frame catch sections 1230 includes an angled portion 1232, catch portion 1234 and longitudinal portion 1236. These portions of the catch section 1230 function in the identical manner as those previously described herein with respect to the oven rack assembly 1200. That is, the catch portions 1234 of the subframe 1424 are captured within openings and slots of rear ladders.

The oven rack assembly 2000, in accordance with the invention, will now be described with respect to FIGS. 35-45. A number of components of known oven rack assemblies and related oven elements have been previously described herein. Accordingly, such elements will not be described in any substantial detail in subsequent paragraphs herein with respect to the oven rack assembly 2000 or other oven rack assemblies in accordance with the invention.

Figure 35:
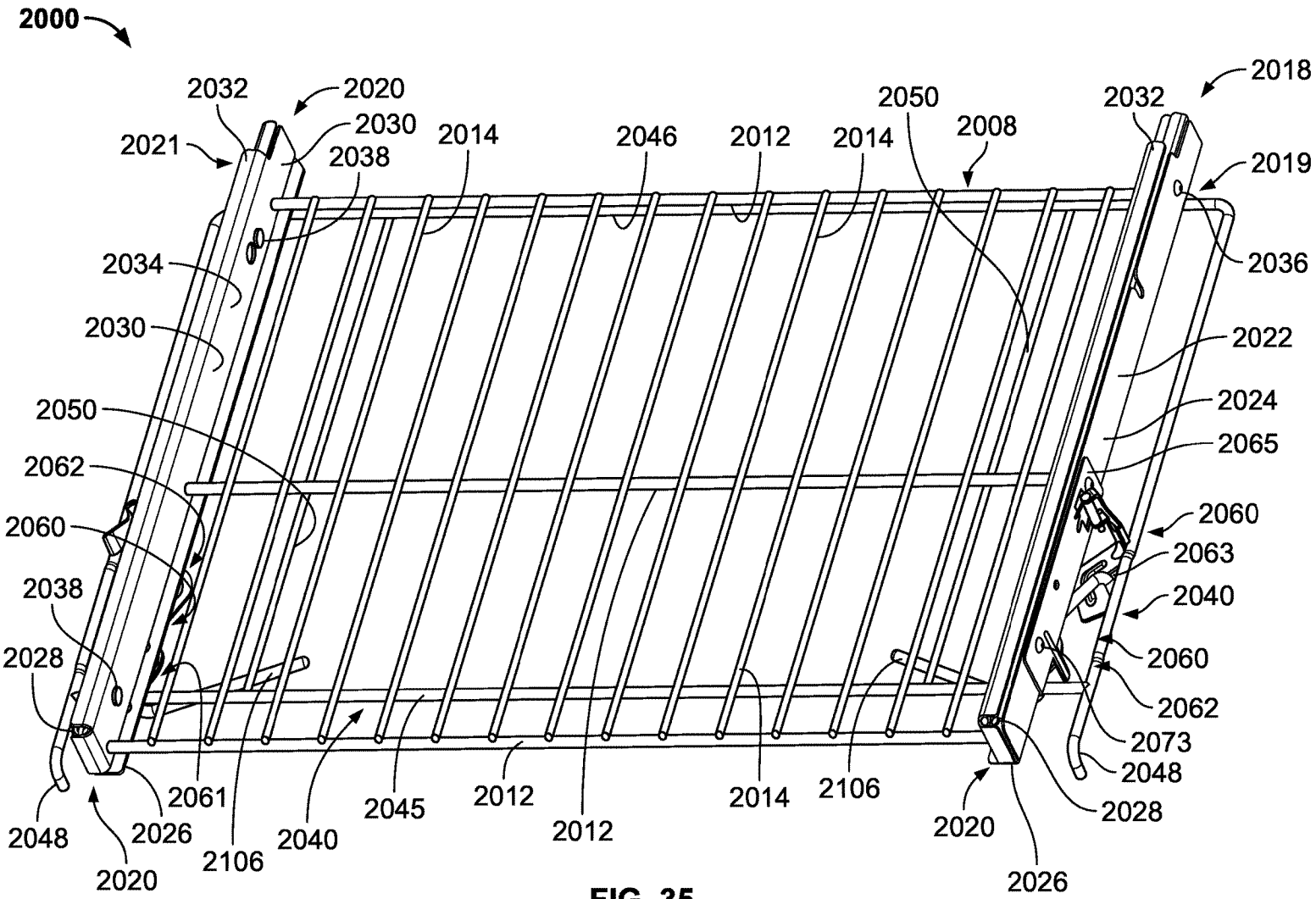
FIG. 35 is a perspective view of a first embodiment of an oven rack assembly having a release mechanism in accordance with the invention.

Turning first to FIG. 35, the oven rack assembly 2000 can be used with a conventional oven, such as the oven 128' previously described herein with respect to the oven rack assembly 100'. The oven 128' can include oven interior surfaces, such as the oven interior surface 1002 shown in FIG. 23. Integral with or otherwise mounted in any suitable manner to the side of an interior surface 1002, are a set of liner ribs 1004 projecting therefrom as also shown in FIG. 23. These liner ribs 1004 can be vertically stacked, for purposes of providing the capability of adjusting the height of the oven rack assembly 2000 within the oven 128'.

With reference back to FIG. 35, the oven rack assembly 2000 can include an oven rack 2008. The oven rack 2008 can include a series of parallel and spaced apart transverse wires 2012. The surface of the oven rack 2008 is also formed by a set of parallel and spaced apart cross wires 2014. The cross wires 2014 may be preferably welded or otherwise secured to the transverse wires 2012. Correspondingly, the transverse wires 2012 may be welded or otherwise secured to inner L-shaped stampings 2030 of slide devices 2020, described in subsequent paragraphs herein. If desired, and although not shown in the drawings, a handle or a similar device can be formed at the front portion of the oven rack 2008. The oven rack 2008, spaced apart transverse wires 2012 and cross wires 2014 are all illustrated in their entirety in FIGS. 35, 36 and 37.

Figure 36:
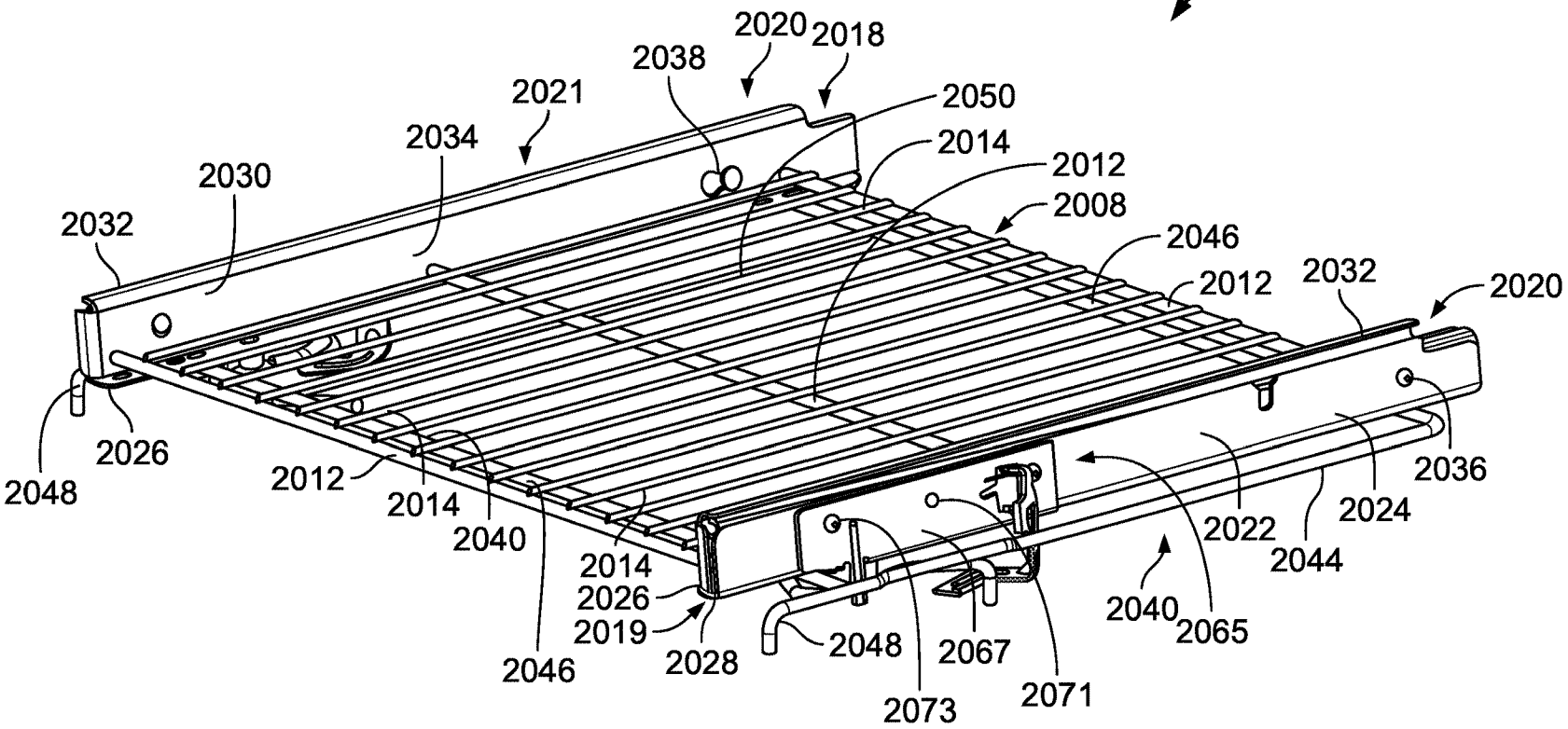
FIG. 36 is a perspective view similar to FIG. 35, but showing the oven rack assembly from a right-side perspective view.
Figure 37:
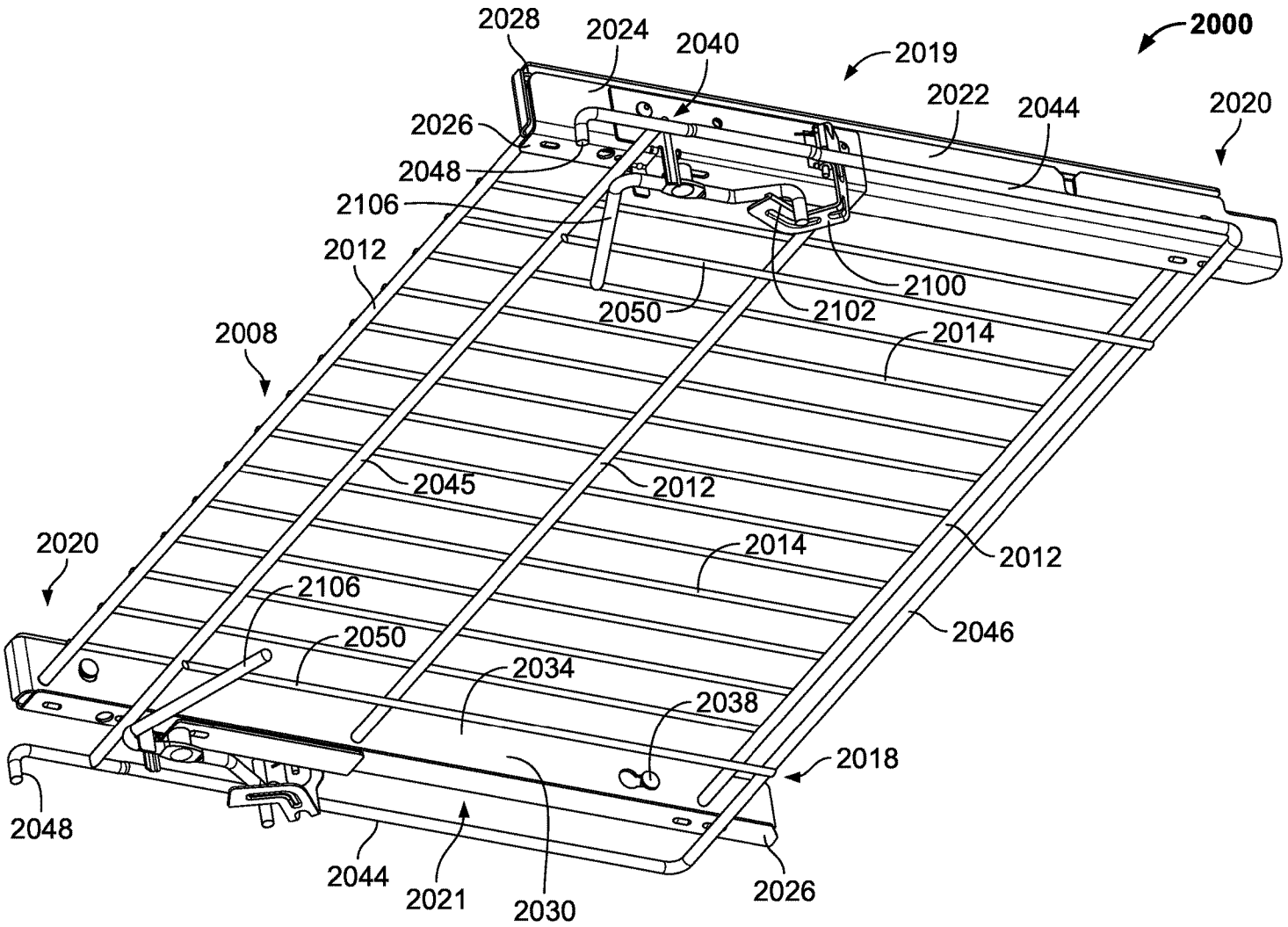
FIG. 37 is an underside, perspective view of the oven rack assembly shown in FIG. 35.

Still further, the oven rack assembly 2000 includes a slide system 2018. With reference primarily to FIGS. 35, 36 and 37, the slide system 2018 includes a pair of slide devices 2020 positioned at opposing sides of the oven rack 2008. The slide devices 2020 are separately referred to as the left slide device 2021 and the right slide device 2019. It should be emphasized that the references to "right" and "left" as set forth herein do not have any specific meaning with respect to a requisite orientation of the oven rack assembly 2000 or any other oven rack assemblies in accordance with the invention. The references are merely for facilitating description.

Again with reference to FIGS. 35, 36 and 37, each of the slide devices 2020 includes an L-shaped outer side stamping 2022. Each side stamping 2022 includes a vertically disposed side portion 2024 and a lower horizontally disposed portion 2026. The outer side stamping 2022 is primarily shown in FIGS. 35, 36, 37, 40 and 42. In addition to the outer side stamping 2022, each of the slide devices 2020 also includes a ball bearing slide 2028. The ball bearing slide 2028 is slightly visible in a number of the drawings, including FIGS. 35 and 36. The ball bearing slide 2028 can be substantially similar to the ball bearing slide 1028 briefly described herein and also substantially similar to the ball bearing slide 114' previously described in detail herein, and illustrated in FIG. 18. The ball bearing slide 2028 can be coupled in part to the vertically disposed side portion 2024 of the outer side stamping 2022 through the use of screws 2036, which could also be rivets or the like.

Each of the slide devices 2020 can further include an inner L-shaped stamping 2030. The L-shaped stampings 2030 are shown at least in part primarily in FIGS. 35, 36, 37, 41 and 42. Each of the inner L-shaped stampings 2030 can include a top horizontally disposed portion 2032 and a vertically disposed side portion 2034. Certain elements of the ball bearing slides 2028 can be coupled to the vertical side portions 2034 of the inner stampings 2030 through the use of screws or rivets 2038, which could also be other types of connecting means. As earlier described, the details of the ball bearing slide 2028 can substantially correspond to the ball bearing slide 114' illustrated in FIG. 18.

In addition to the afore-described elements, the oven rack assembly 2000 can also include a subframe 2040. The subframe 2040 and components thereof are primarily shown in FIGS. 35, 36, 37, 41, 42, 43 and 44. More specifically, the subframe 2040 is primarily formed as a rectangle with an outer wire frame 2042. The outer wire frame 2042 includes a pair of longitudinally extending opposing side portions 2044. Integral with or otherwise welded to the side portions 2044 are a front portion 2045 and a rear portion 2046. The front and rear portions 2045 and 2046 are parallel to each other and extend transversely across the oven rack assembly 2000. At the forward-most sections of the side portions 2044, a pair of front and downwardly depending hooks 2048 are formed. Further, the subframe 2040 also includes a pair of longitudinally extending cross bars 2050 which extend between the front portion 2045 and the rear portion 2046 of the subframe 2040. The cross bars 2050 provide rigidity and support for the subframe 2040, and may be welded or otherwise connected to the front and rear portions 2045, 2046, respectively.

Figure 43:
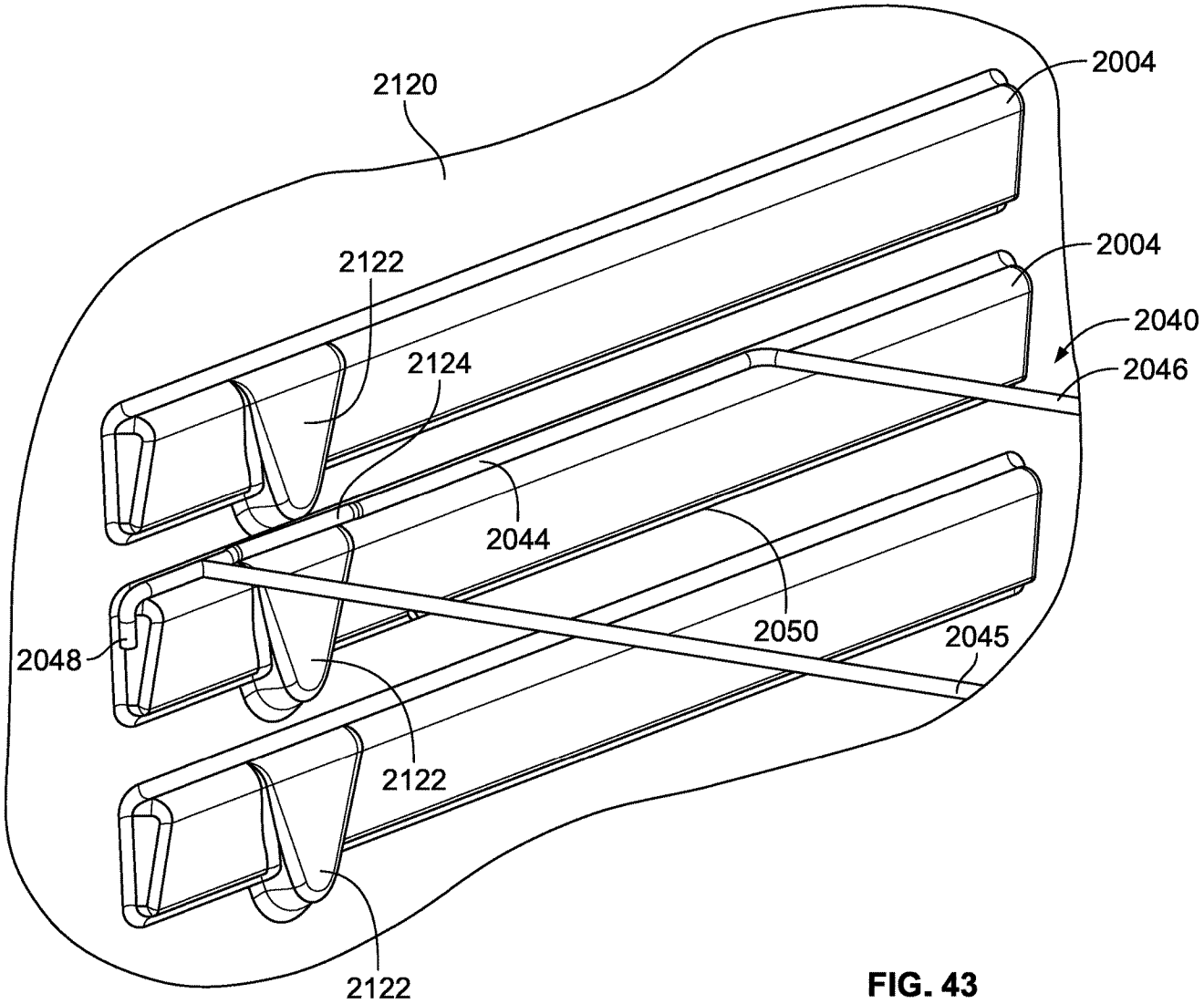
FIG. 43 is a perspective view showing one side of an oven liner having a catch mechanism associated therewith.
Figure 44:
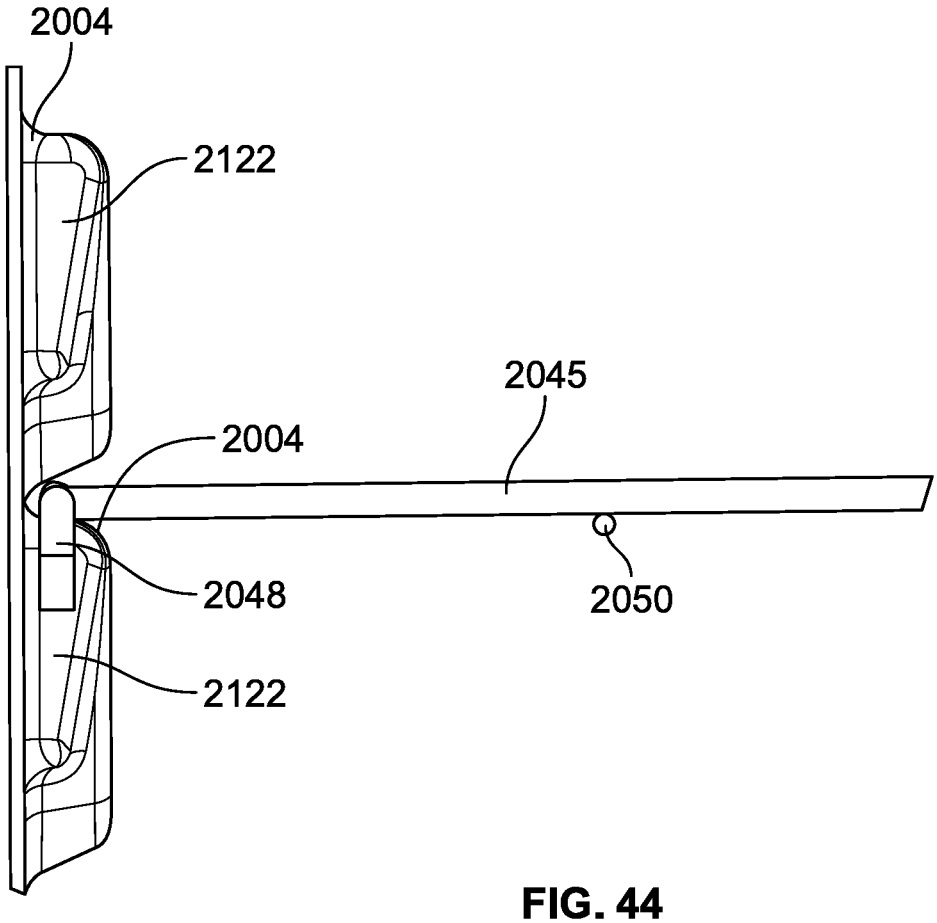
FIG. 44 is a partial and front, elevation view of the mechanisms shown in FIG. 43.
Figure 45:
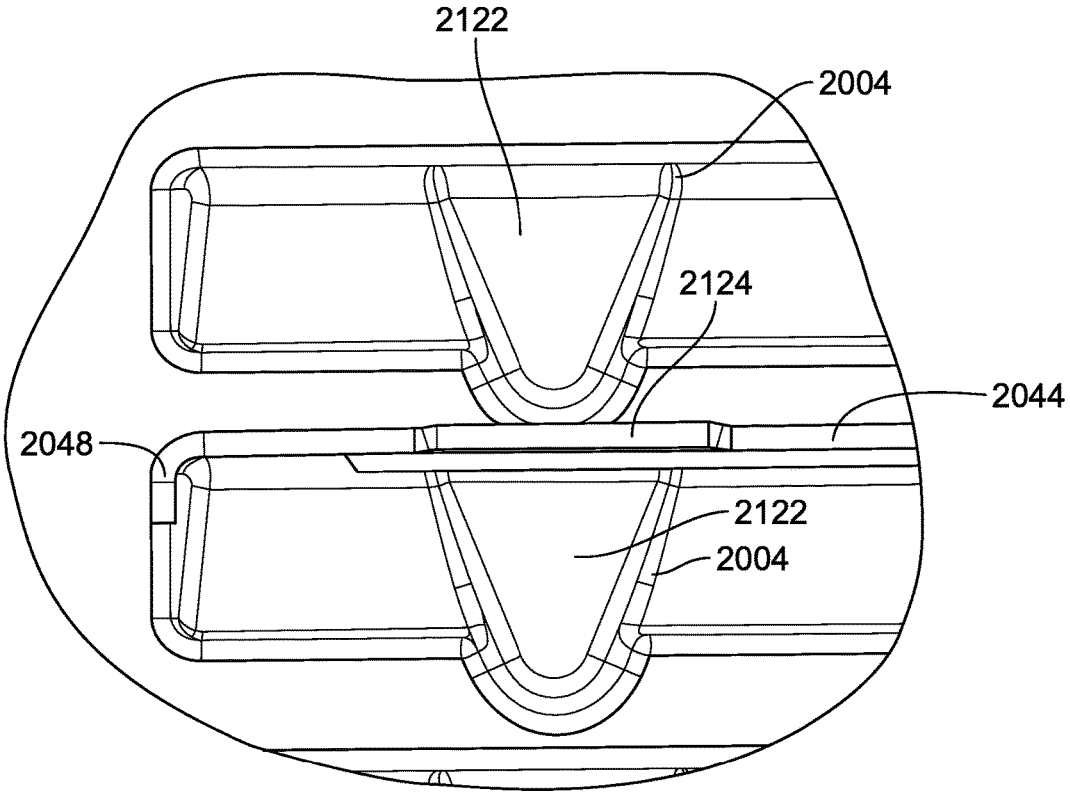
FIG. 45 is an enlarged view of the mechanisms shown in FIG. 43.

When the oven rack assembly 2000 is positioned in place within the oven, each of the side portions 2044 of the subframe 2040 is supported on the top of a liner rib 2004 as primarily shown in FIGS. 43, 44 and 45. The liner ribs 2004 are also configured so as to provide for a retention of the subframe 2040 in a manner so as to prevent the same from "tipping" or "tilting" as a result of cantilever-type forces exerted on the subframe 2040 by the weight of the oven rack 2008 (and items placed on top of the same) when the oven rack 2008 is extended outwardly from the subframe 2040. Still further, with this configuration, it is apparent from FIGS. 43, 44 and 45 that the downwardly depending front hooks 2048 of the side portions 2044 are positioned at the front ends of the liner ribs 2004. In addition to the foregoing, the subframe 2040 can be securely connected to the components of the slide system 2018 through weldments or other securing means connecting the front portion 2045 and the rear portion 2046 to the lower horizontal portions 2026 of the outer side stampings 2022. With these couplings between the subframe 2040 and the slide system 2018, and the oven rack 2008 and the slide system 2018, the oven rack 2008 can be extended and retracted through operation of the ball bearing slides 2028, with the L-shaped outer side stampings 2022 and the subframe 2040 remaining in place.

In addition to the afore-described elements of the oven rack assembly 2000, and in accordance with the invention, the oven rack assembly 2000 further includes a retention/release assembly 2060 which provides means for facilitating retention of the position of the subframe 2040 on the liner ribs 2004, and also facilitating release of the subframe 2040 from the liner ribs 2004 when a user wishes to remove the subframe 2040 from the oven.

The retention/release assembly 2060 includes a pair of retention/release devices 2062, one of which is mounted on each of the opposing sides of the oven rack assembly 2000. Because the retention/release devices 2062 are substantially identical and basically comprise "mirror" images of each other, only one of the retention/release devices 2062 will be described in detail herein. More specifically, each of the retention/release devices 2062 interacts with and catches on a sidewall of an oven liner. This action prevents the sliding oven rack 2008 from essentially "falling out" of the interior of the oven itself. By manual activation of each of the retention/release devices 2062, the subframe 2040 can be placed in a retaining or release position within the oven liner.

As shown in a number of the drawings, including FIGS. 35-39, each of the retention/release devices 2062 can be integrated or otherwise connected to a formed or stamped attachment plate 2065. As shown primarily in FIGS. 38 and 39, each of the attachment plates 2065 includes a vertically disposed portion 2067 and a lower horizontally disposed section 2069. The section 2069 can be integral with or otherwise connected to the vertically disposed portion 2067. As further shown in FIGS. 38 and 39, the attachment plates 2065 have a series of apertures 2071 extending horizontally through the vertically disposed portions 2067. The apertures 2071 can be used to receive screws 2073 or similar connecting means, so as to connect the attachment plates 2065 to the vertically disposed portions 2024 of the L-shaped outer side stampings 2022 of the slide devices 2020. In addition to the screws 2073, the attachment plates 2065 can be secured to the side stampings 2022 through the use of weldments, rivets or similar connection means. If attachment plates 2065 are not utilized, and such absence of utilization can exist without departing from the principal concepts of the invention, the retention/release devices 2062 can be attached or integrated directly as a part of the outer side stampings 2022 of the slide system 2018. Still further, the outer side stampings 2022 can be attached to the subframe 2040 as previously stated herein. For example, each of the lower horizontally disposed portions 2026 of the side stampings 2022 can be welded or otherwise secured to the front portion 2045 and rear portion 2046 of the subframe 2040.

The structure and operation of the retention/release assembly 2060 will now be described with respect to one of the retention/release devices 2062. For purposes of understanding and description, the retention/release devices 2062 will be described as used in association with attachment plates 2065. With reference in particular to FIGS. 38-42, each of the retention/release devices 2062 includes a flipper mechanism 2080. As shown particularly in FIGS. 38-40, the flipper mechanism 2080 can be described as having an upper securing flange 2084 with an aperture extending therethrough. The mechanism 2080 also includes a lower and horizontally disposed securing flange 2086 also having an aperture extending vertically therethrough. The aperture in the upper securing flange 2084 is coaxial with the aperture in the lower securing flange 2086. As further shown in FIG. 40, extending outwardly from the attachment plate 2065 is a pair of horizontal flanges 2082, which include an upper horizontal flange 2088 and a lower horizontal flange 2090. Each of these flanges 2082 also include apertures therein. For purposes of securing the flipper mechanism 2080 to the attachment plate 2065, the apertures in the upper and lower securing flanges 2084, 2086, respectively of the flipper mechanism 2080 can be aligned with the apertures in the upper horizontal flange 2088 and lower horizontal flange 2090 of the horizontal flanges 2082, again as primarily shown in FIG. 40. A pin 2092 can then be received within the apertures of the aforedescribed flanges. Still further, a retention spring 2094 can be secured and received around the pin 2092. The retention spring 2094 is positioned between the upper horizontal flange 2088 and the lower horizontal flange 2090 of the horizontal flanges 2082. As will be apparent from description herein, the retention spring 2094 is utilized to provide continuous forces to be exerted on the flipper mechanism 2080 so as to maintain the flipper mechanism 2080 in a "retaining position" until such time as a user would exert external forces so as to rotate the flipper mechanism 2080 to a position where the subframe 2040 could be extended and removed from the oven liner. It should be noted that although the flipper mechanisms 2080 are shown with the retention springs 2094, retention/release devices functioning in accordance with a number of the concepts of the invention do not necessarily require the retention springs 2094. Instead, the functions performed by the retention springs 2094 could be achieved through the use of similar types of elements mounted elsewhere on the oven rack assembly 2000, or the spring function could possibly be eliminated entirely.

In describing the remaining components of the retention/release devices 2062, it should be emphasized that with the configuration of the horizontal flanges 2082 associated with the attachment plate 2065 and the upper and lower securing flanges 2084, 2086, respectively of the flipper mechanism 2080, the flipper mechanism 2080 is free to rotate with the pin 2092 when forces are exerted on the flipper mechanism 2080. However, as earlier described, the retention spring 2094 exerts forces on the flipper mechanism 2080 so as to maintain the mechanism 2080 in the position shown in FIGS. 38-40, absent forces externally applied by a user. In this position, the flipper mechanism will abut the oven liner in a manner so as to prevent the subframe 2040 from being removed from the oven liner.

Figure 38:
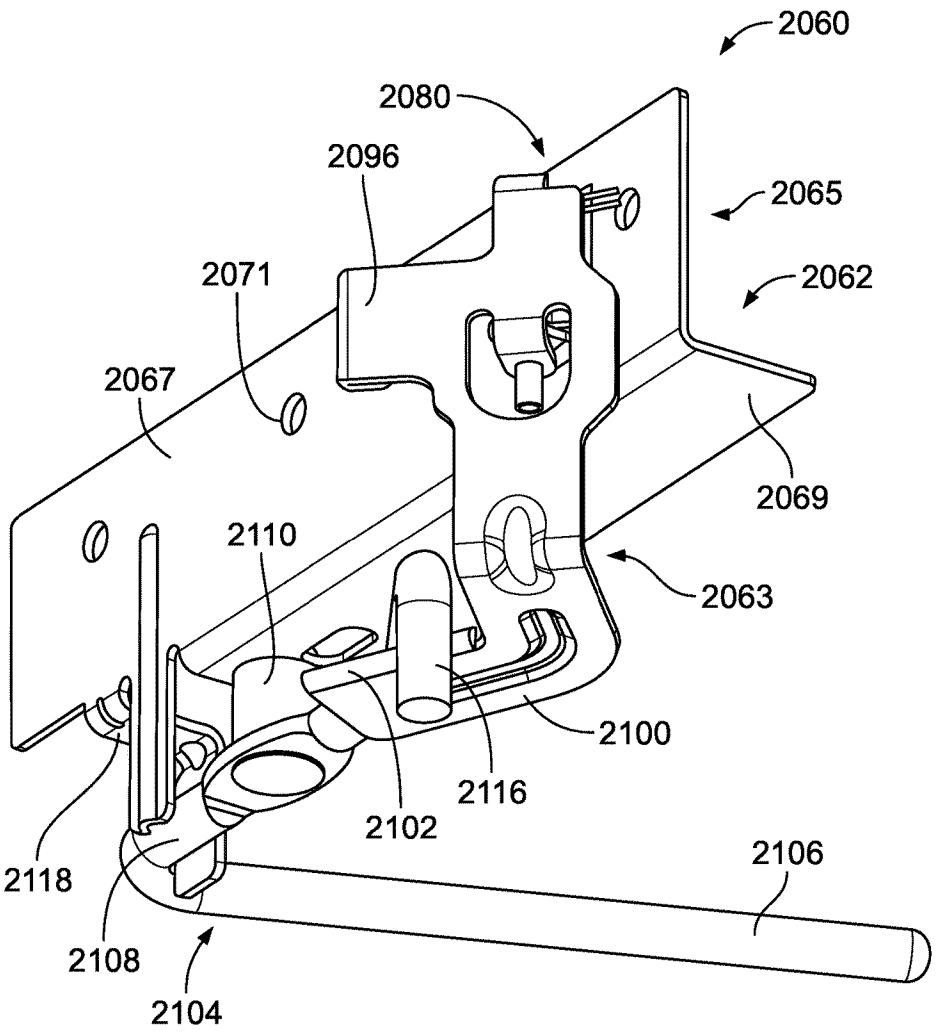
FIG. 38 is an underside, perspective view showing one of the release mechanisms used in the oven rack assembly shown on FIG. 35.
Figure 40:
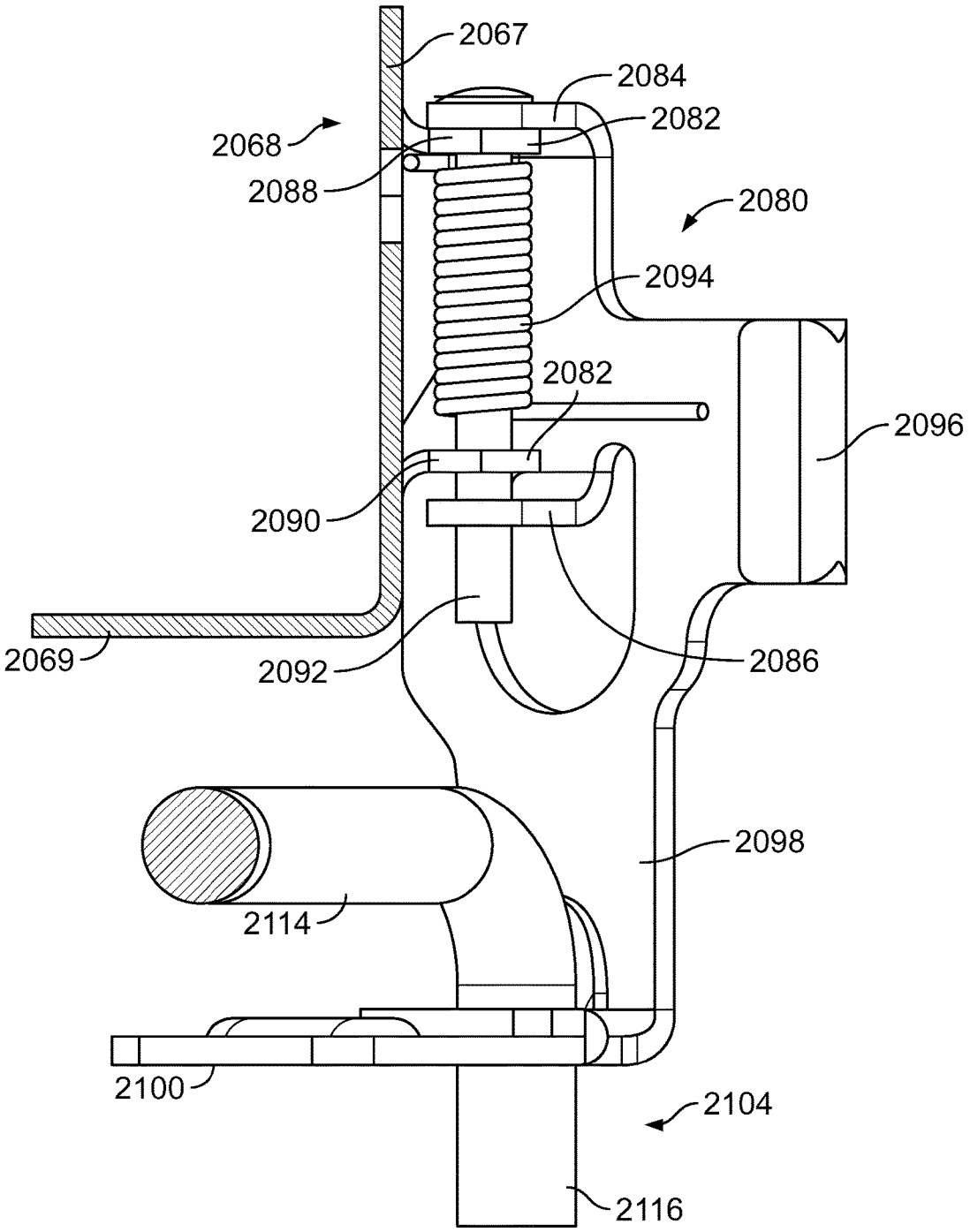
FIG. 40 is a sectional view showing certain of the internal elements of the release mechanism shown in FIG. 38.
Figure 41:
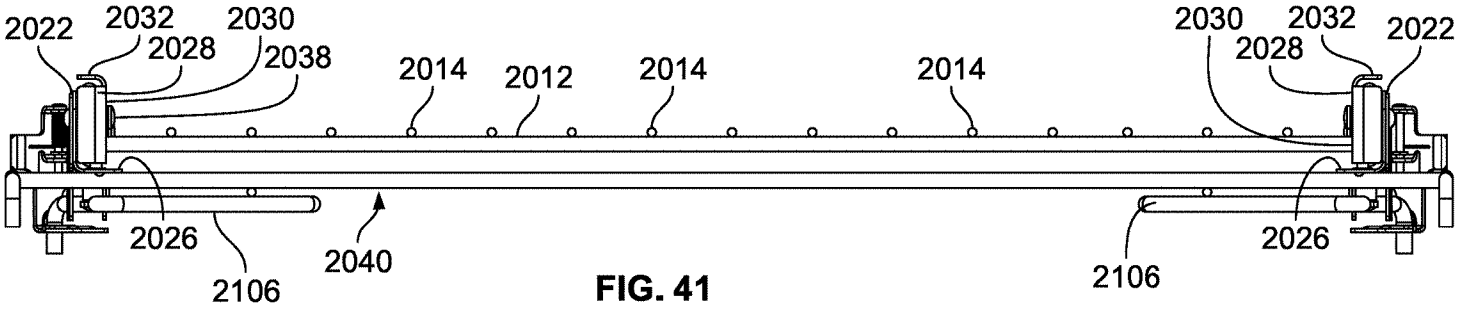
FIG. 41 is a front, elevation view of the oven rack assembly shown in FIG. 35.
Figure 42:
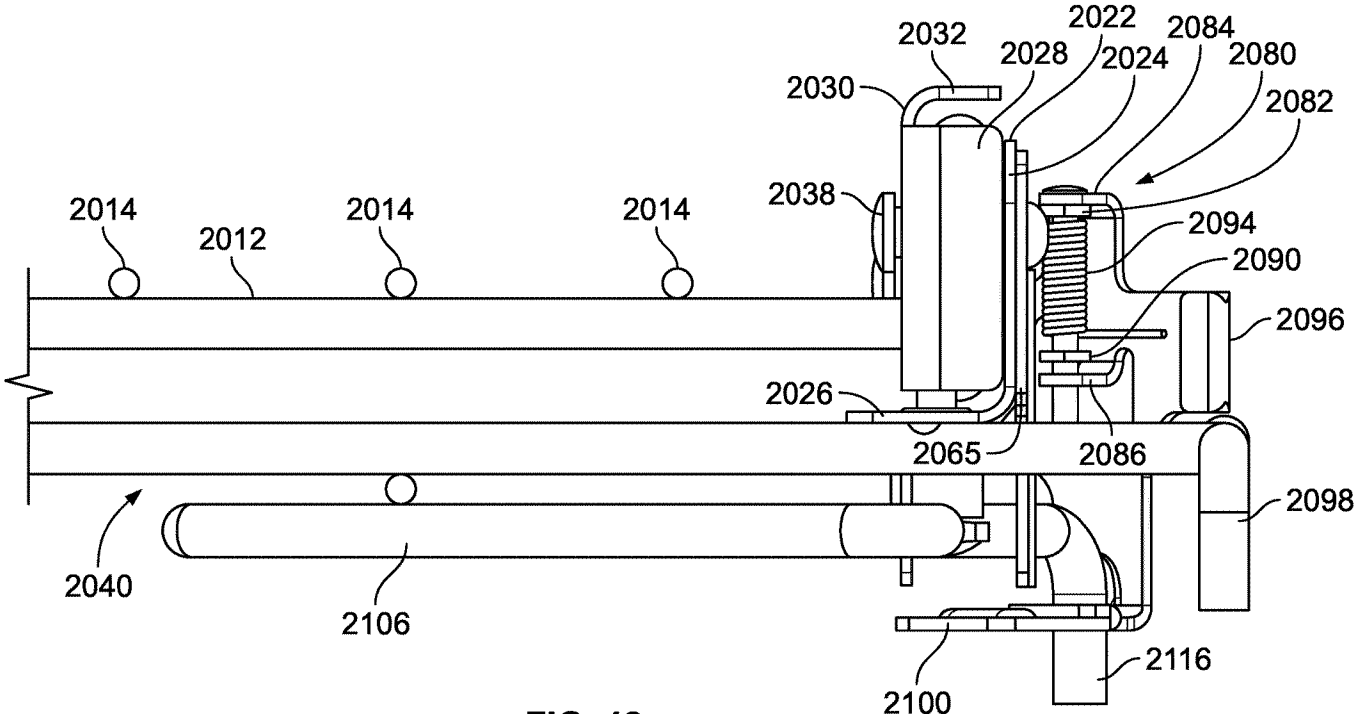
FIG. 42 is an enlarged and partial elevation view of the oven rack assembly shown in FIG. 41.

Integral with or otherwise connected to the upper securing flange 2084 and lower securing flange 2086 is a retainer tab 2096 having the shape and configuration primarily shown in FIGS. 38 and 40. The retainer tabs 2096 are the actual components which abut the oven liner so as to prevent movement of the subframe 2040 from a retracted position within the oven liner.

As further shown in FIGS. 38-42, positioned below the retainer tab 2096 is a lower and vertically disposed section 2098 of the flipper mechanism 2080. Integral with or otherwise connected to the lower vertical section 2098 is a lower and horizontally disposed component which can be characterized as a guide flange 2100. The guide flange 2100 has a arcuate shape and configuration as primarily shown in FIGS. 37, 38 and 39. The guide flange 2100 includes what can further be characterized as a guide surface 2102. The relevance of the guide surface will be explained in subsequent paragraphs herein.

Figure 39:
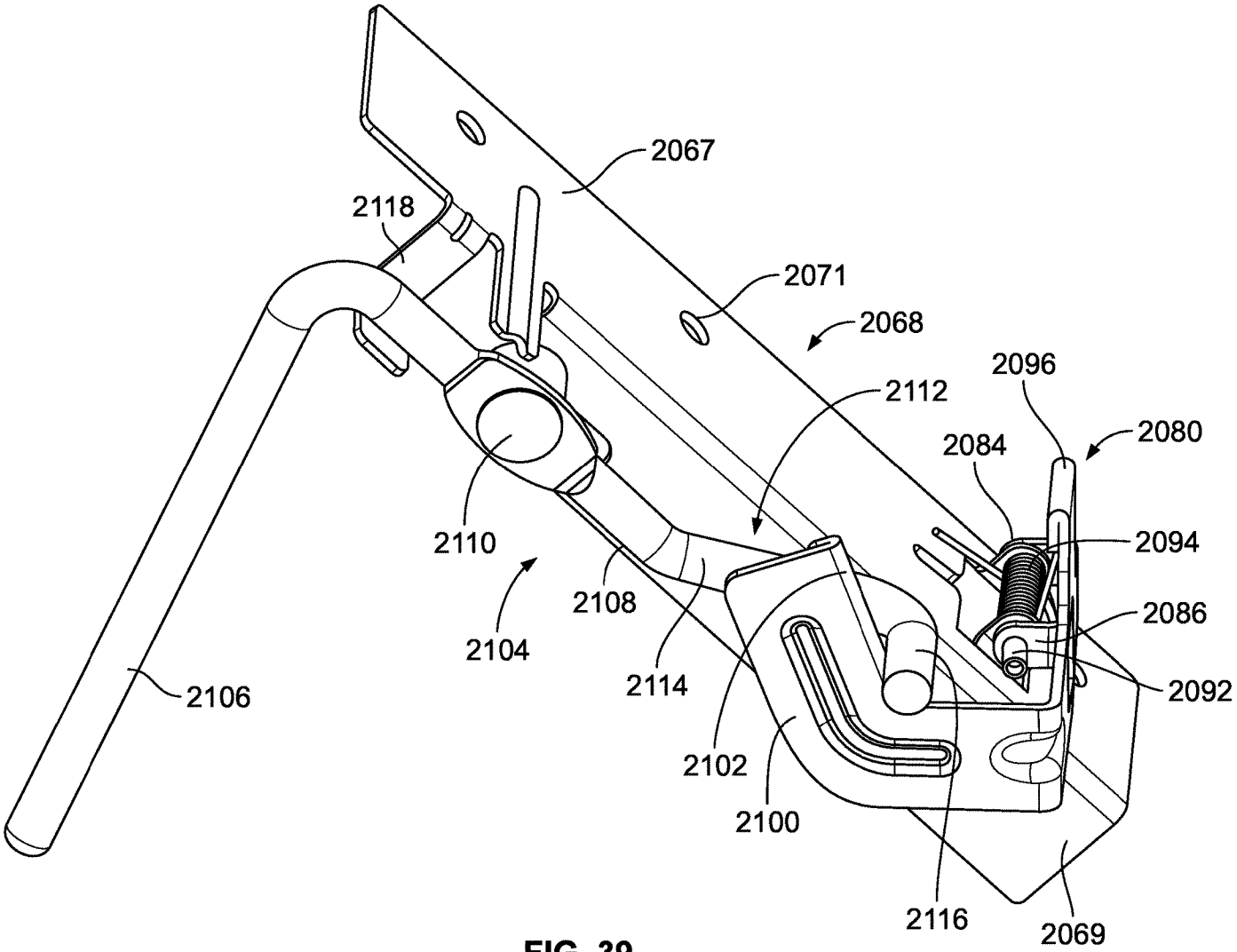
FIG. 39 is an alternative, underside view of the release mechanism shown in FIG. 38.

In addition to the flipper mechanism 2080, each of the retention/release devices 2062 includes what could be characterized as a formed release leg 2104. Each of the release legs 2104 has the shape and structural configuration as shown in a number of the drawings, including FIGS. 38 and 39. With reference to the drawings, the formed release leg 2104 includes an actuating user lever 2106. Connected to or otherwise integral with the user lever 2106 is a pivot arm 2108 having a substantially "straight line" configuration. The pivot arm 2108 can be pivotably coupled to the horizontally disposed portion 2069 of the attachment plate 2065 through a pivot coupling 2110 as shown in FIGS. 38 and 39. Connected to or otherwise integral with one end of the pivot arm 2108 is a portion of the release leg 2104 which can be characterized as a guide section 2112. The guide section 2112 includes a horizontally disposed leg 2114 connected to or otherwise integral with the pivot arm 2108. At the end of the horizontal leg 2114, and connected thereto or otherwise integral therewith, is a downwardly projecting abutment post 2116. As further shown in FIGS. 38 and 39, the abutment post 2116 is configured so as to slide along the guide surface 2102 of the guide flange 2100. In addition to the formed release leg 2104, the retention/release devices 2062 can also utilize metal posts, such as the posts 2118 shown in FIGS. 38 and 39. The metal posts 2118 may extend downwardly from the attachment plates 2065, and can be used so as to act as additional abutment points for the formed release legs 2104. Still further, if desired, the flipper mechanisms 2080 may utilize strengthening ribs for purposes of improving durability.

FIGS. 43, 44 and 45 illustrate configurations associated with the coupling of the subframe 2040 to retaining ribs on the walls of an oven liner. As shown in these drawings, an oven liner 2120 includes a series of liner ribs 2004. The liner ribs 2004 include a series of protruding forms 2122, as shown in FIGS. 43, 44 and 45. When the subframe 2040 is secured to the liner ribs 2004 of the oven liner 2120, the protruding forms 2122 interact with forms 2124 (FIGS. 43 and 45) which are positioned along the side portions 2044. With reference, for example, to FIG. 43, the form 2124 will interact with the protruding form 2122 immediately above the form 2124, so as to prevent tipping when the oven rack 2008 of the oven rack assembly 2000 is in the extended position. Further, the protruding forms 2122 can be utilized to provide an abutment with the retainer tabs 2096 when the subframe 2040 is to be "locked" in a retracted position within the oven liner 2120.

In accordance with all of the foregoing, with the subframe 2040 in a retracted position, the retention spring 2094 will essentially maintain the flipper mechanism 2080 in a retaining position, with the retainer tabs 2096 in the positions shown in FIGS. 38, 39 and 40. When it is desired to release the subframe 2040, the user can exert forces on the user lever 2106 of each of the formed release legs 2104. The exerted forces will be in a direction which opposes the retaining forces of the retention springs 2094. The forces will cause the abutment post 2116 of each of the guide sections 2112 to move along the guide surfaces 2102 of the guide flanges 2100. This movement will exert forces on the guide flanges 2100, opposing the forces of the retention springs 2094, and cause the retainer tabs 2096 to rotate so as to no longer be in abutment with the liner ribs or other retaining components of the oven liner. With this rotation of the retainer tabs 2096, the user can then pull the subframe 2040 outwardly to a released position. When manually exerted forces are removed from the user levers 2106, the forces exerted by the retention springs 2094 will then cause the retainer tabs 2096 to again move to their "retaining" positions.

A further embodiment of an oven rack assembly in accordance with the invention is illustrated in FIGS. 46-58 and referred to herein as oven rack assembly 3000. The oven rack assembly 3000 has some substantial similarities to the oven rack assembly 2000 previously described herein. However, with the oven rack assembly 3000, the configuration of the oven rack is somewhat different than the configuration of the oven rack described with respect to the oven rack assembly 2000. Also, while the oven rack assembly 2000 was described with use of an attachment plate 2065, the oven rack assembly 3000 in accordance with the invention is described without the use of an attachment plate. A number of the components of the oven rack assembly 3000 are somewhat similar to components of known oven rack assemblies and related oven elements as previously described herein. Accordingly, such elements will not be described in any substantial detail in subsequent paragraphs herein with respect to the oven rack assembly 3000.

Figure 46:
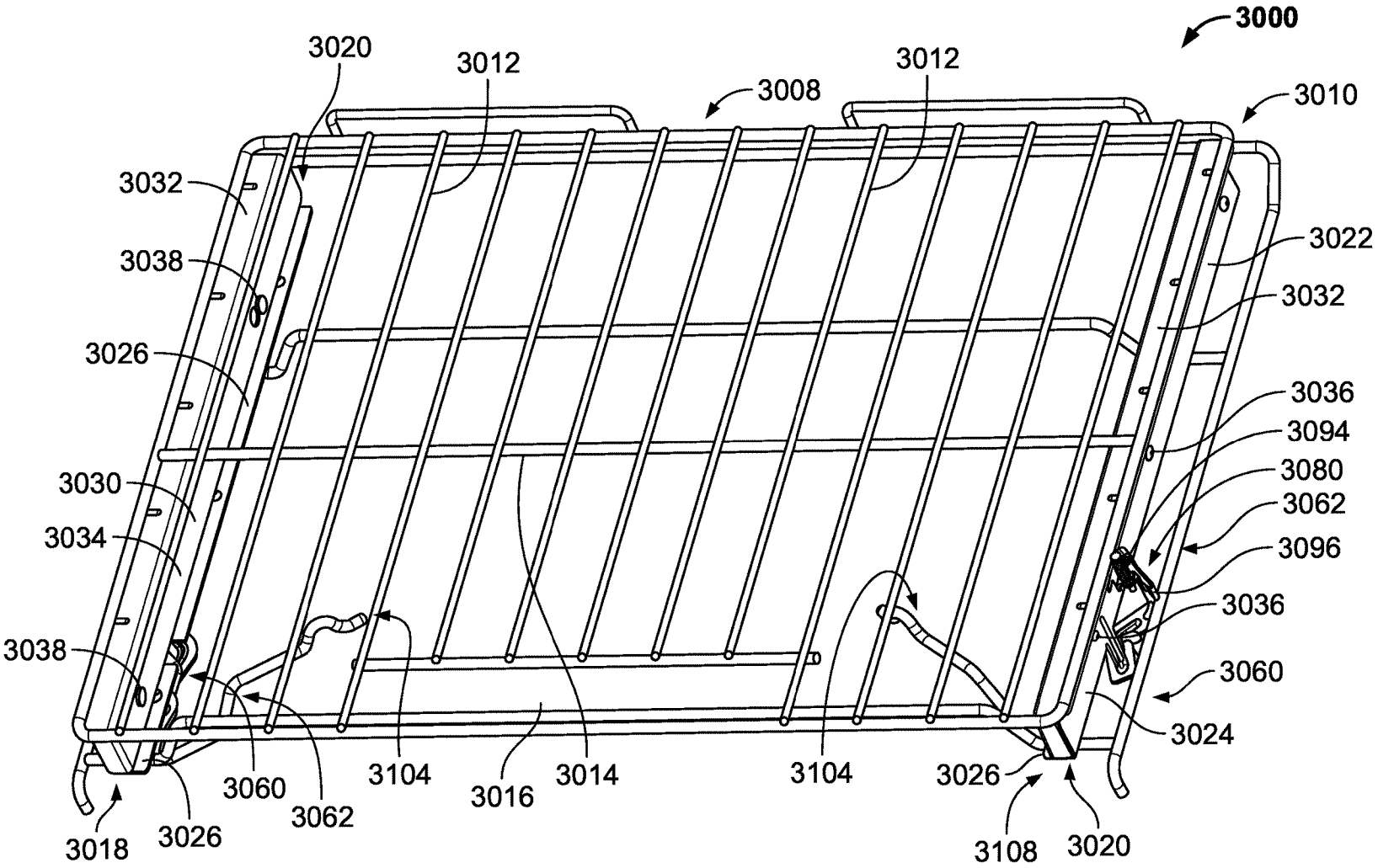
FIG. 46 is a perspective view of a second embodiment of an oven rack assembly having a release mechanism in accordance with the invention.

Turning first to FIG. 46, the oven rack assembly 3000 can be used with a conventional oven, such as the oven 128' previously described herein with respect to the oven rack assembly 100'. The oven 128' can include oven interior surfaces, such as the oven interior surface or oven liner 2120 previously described herein and illustrated in FIG. 43. Further, integral with or otherwise mounted in any suitable manner to the side of an interior surface liner 2120 can be a set of liner ribs such as the liner ribs 2004 projecting therefrom is also shown in FIG. 43. These liner ribs 2004 can be vertically staffed for purposes of providing the capability of adjusting the height of the oven rack assembly 3000 within the oven 128'. As described in subsequent paragraphs herein, and in accordance with the invention, the liner ribs 2004 can act in cooperation with release mechanisms of the oven rack assembly 3000 (subsequently described herein) so as to maintain the oven rack assembly 1000 in a stationary state, until a user wishes to remove an oven rack or subframe from the oven 128'.

Reference will now be made with respect to FIGS. 46, 47, 49, 50 and 51 with respect to description of certain components of the oven rack assembly 3000. More specifically, the oven rack assembly 3000 includes an oven rack 3008. The oven rack 3008 includes a formed wire which comprises a continuous outer wire frame 3010. The outer wire frame 3010 forms the front, sides and rear of the surface area of the oven rack 3008. The oven rack 3008 also includes the series of parallel and spaced apart transverse wires 3012. The surface of the oven rack 3008 is also formed by a set of parallel and spaced apart cross wires 3014. The cross wires 3014 may be preferably welded to the sides of the outer wire frame 3010. Correspondingly, the transverse wires 3012 may also be welded or otherwise secured to the front and rear portions of the outer frame 3010, and also at intersecting transverse wires 3012. If desired, a handle 3016 can be formed at the front portion of the oven rack 3008.

Figure 47:
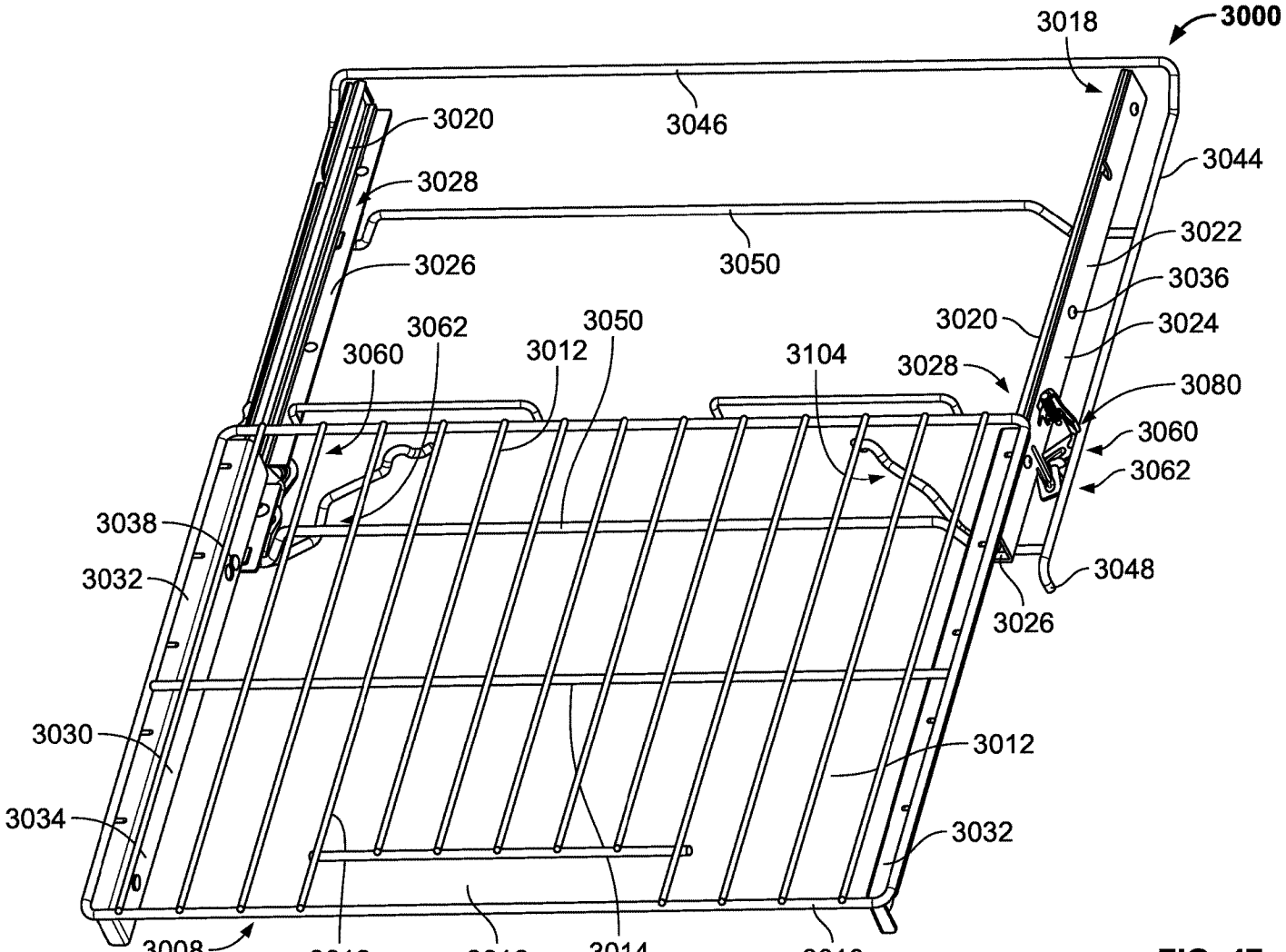
Figure 48:
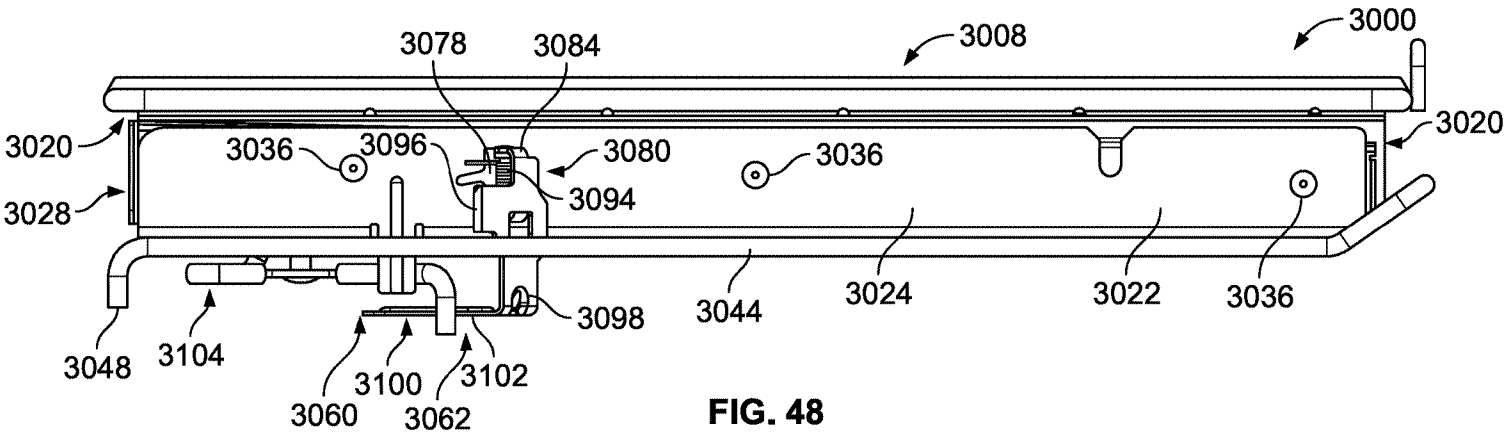
FIG. 48 is a right-side, elevation view of the oven rack assembly shown in FIG. 46, and showing one of the release mechanisms.
Figure 49:
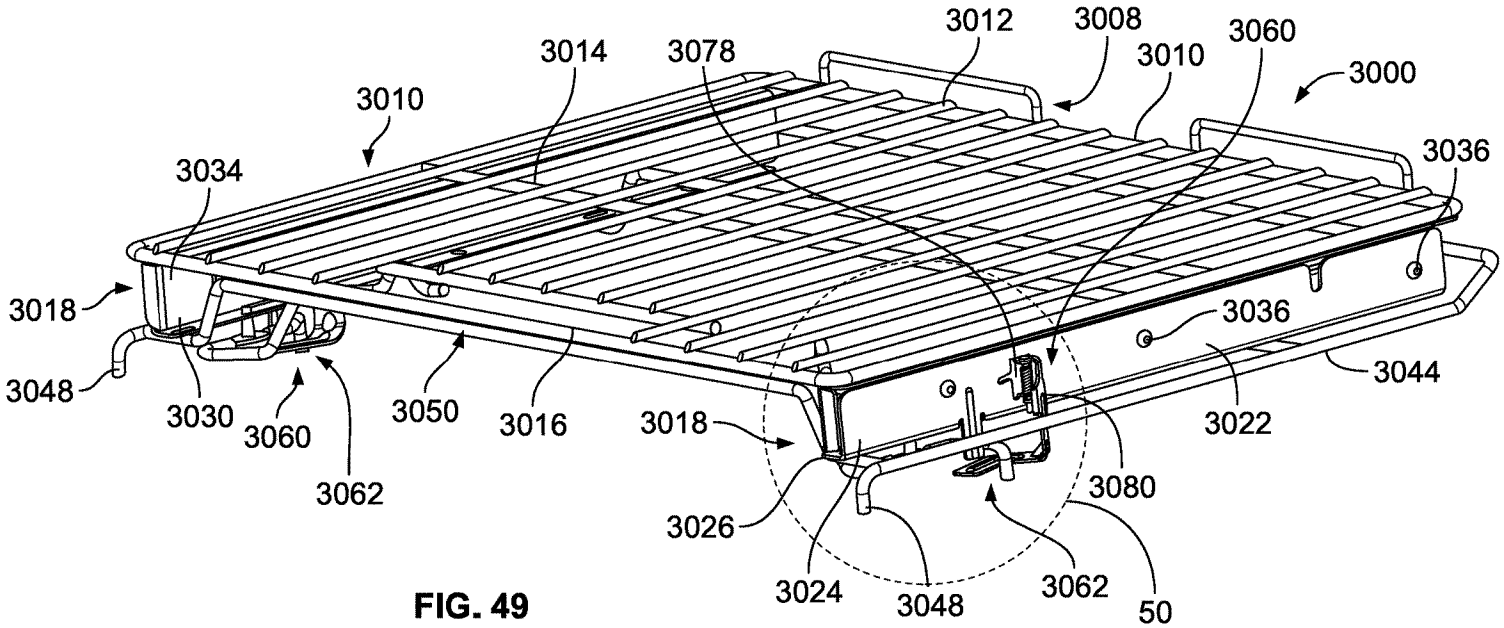
FIG. 49 is a right-side, perspective view of the oven rack assembly and release mechanism shown in FIG. 46.
Figure 50:
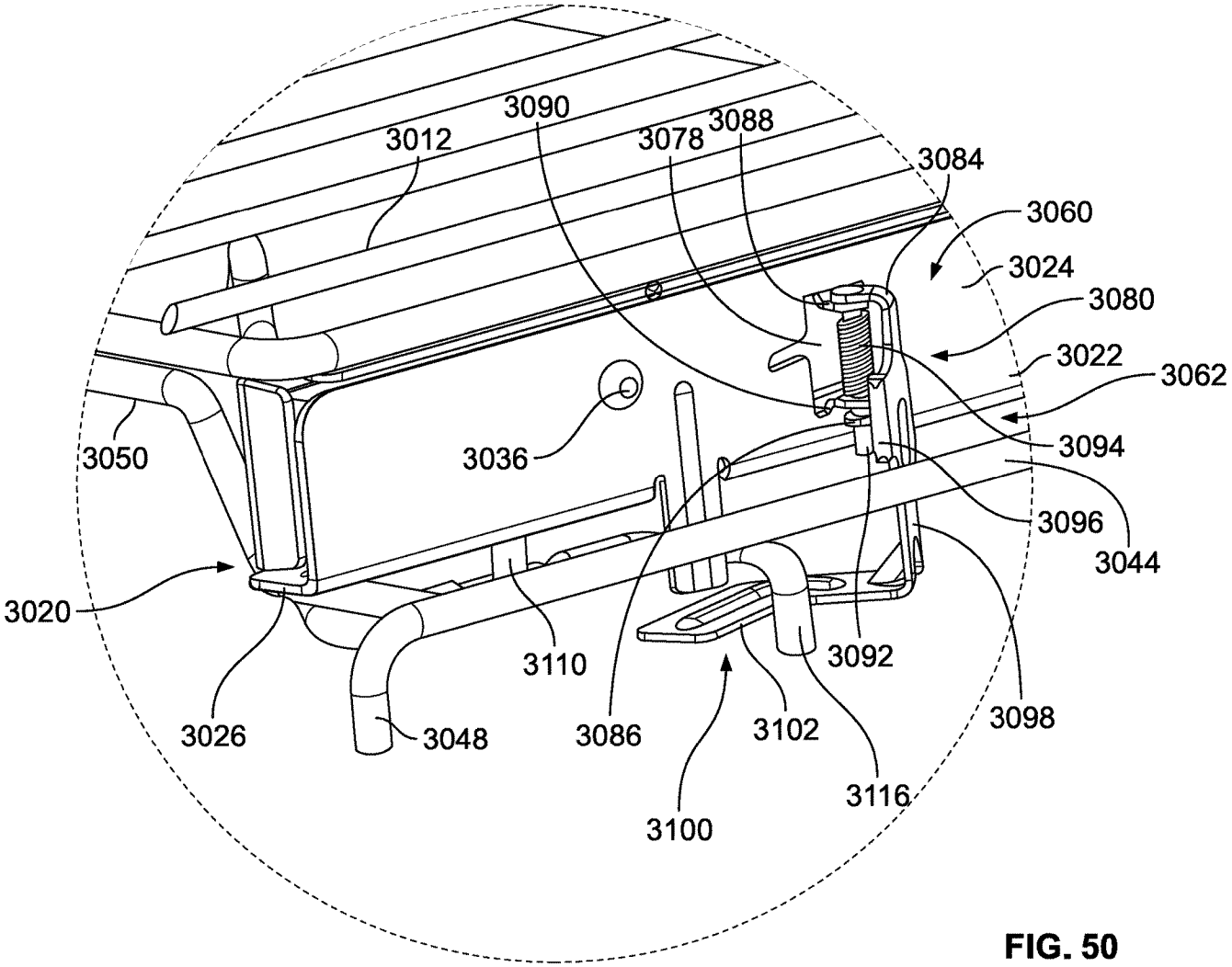
FIG. 50 is an enlarged and perspective view of one of the release mechanisms of the oven rack assembly shown in FIG. 49, and representative of the circular area referenced in FIG. 49 with the numerical reference "50"

Still further, the oven rack assembly 3000 includes a slide system 3018. With reference primarily to FIGS. 46, 47 and 49, the slide system 3018 includes a pair of slide devices 3020 positioned at opposing sides of the oven rack 3008. Each of the slide devices 3020 includes an L-shaped outer side stamping 3022. Each side stamping 3022 includes a vertically disposed side portion 3024, and a lower horizontally disposed portion 3026 (primarily shown in FIG. 52). In addition to the outer side stamping 3022, each of the slide devices 3020 also includes a ball bearing slide 3028. The ball bearing slides 3028 are primarily visible in FIG. 47. The ball bearing slides 3028 can be substantially similar to the ball bearing slides 114' previously described in detail herein, and illustrated in FIG. 18. The ball bearing slides 3028 can be coupled in part to the vertically disposed side portions 3024 of the outer side stampings 3022 through the use of screws 3036, which could also be rivets or the like.

Figure 51:
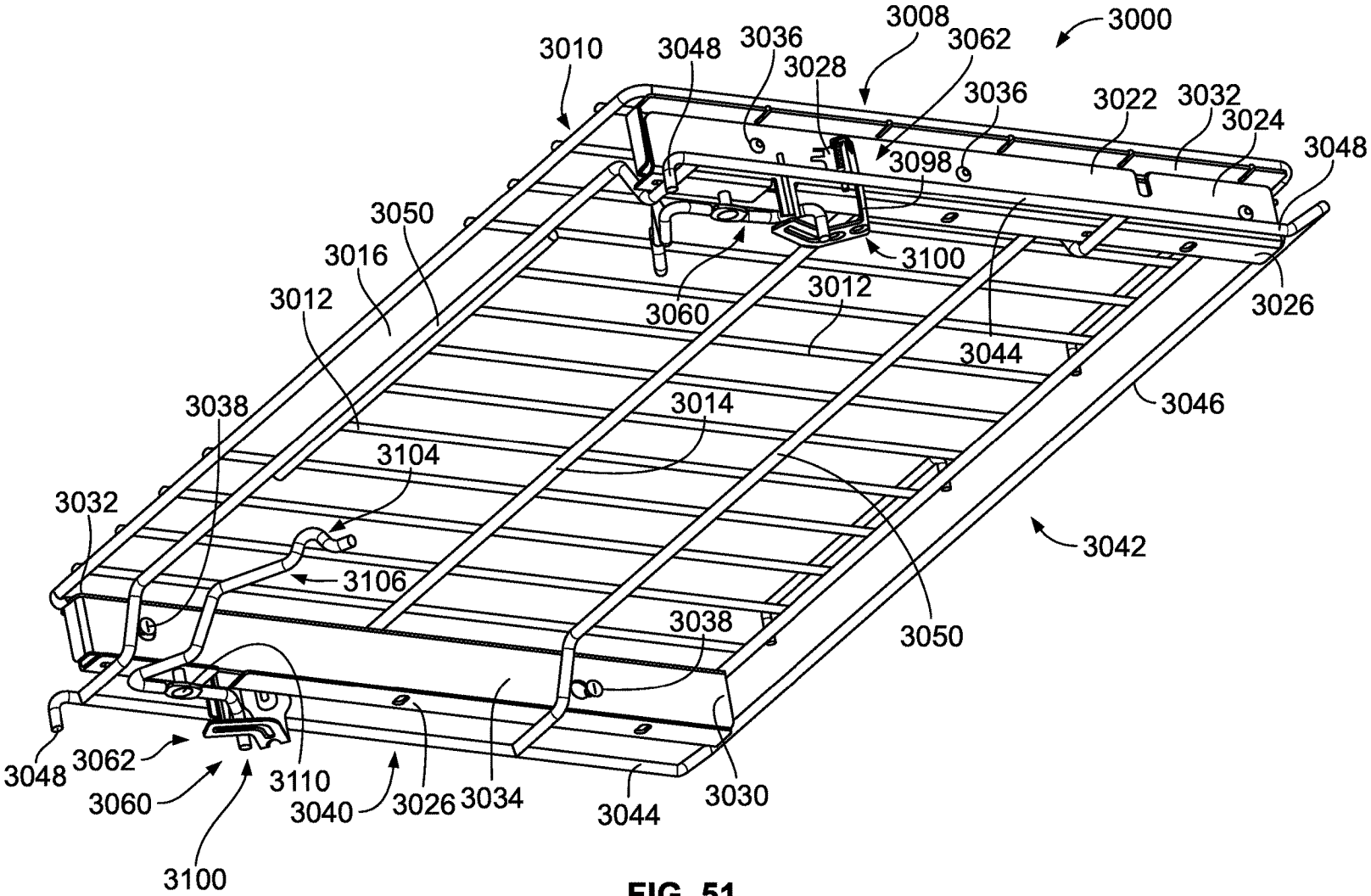
FIG. 51 is an underside, perspective view of the oven rack assembly shown in FIG. 46, and showing various components of the pair of release mechanisms.
Figure 52:
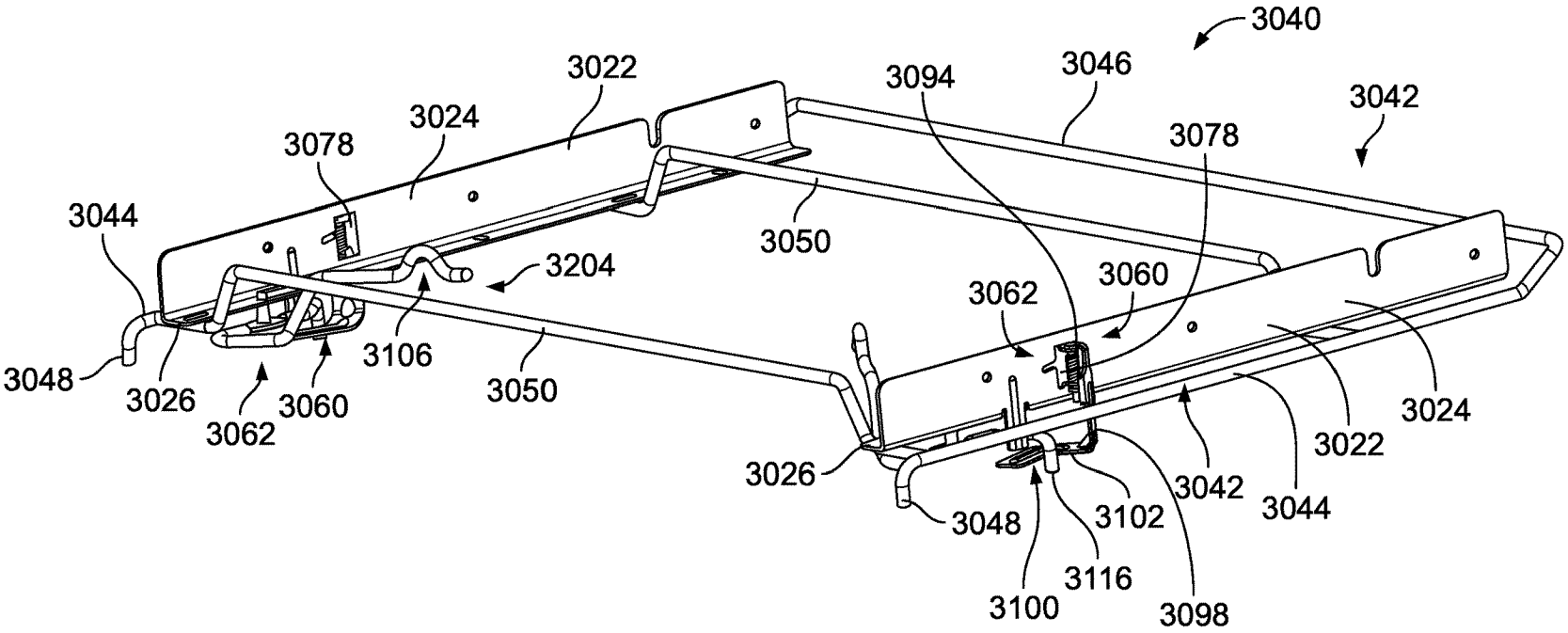
FIG. 52 is an underside, perspective view of the components of the oven rack assembly, in the absence of the oven rack itself.
Figure 53:
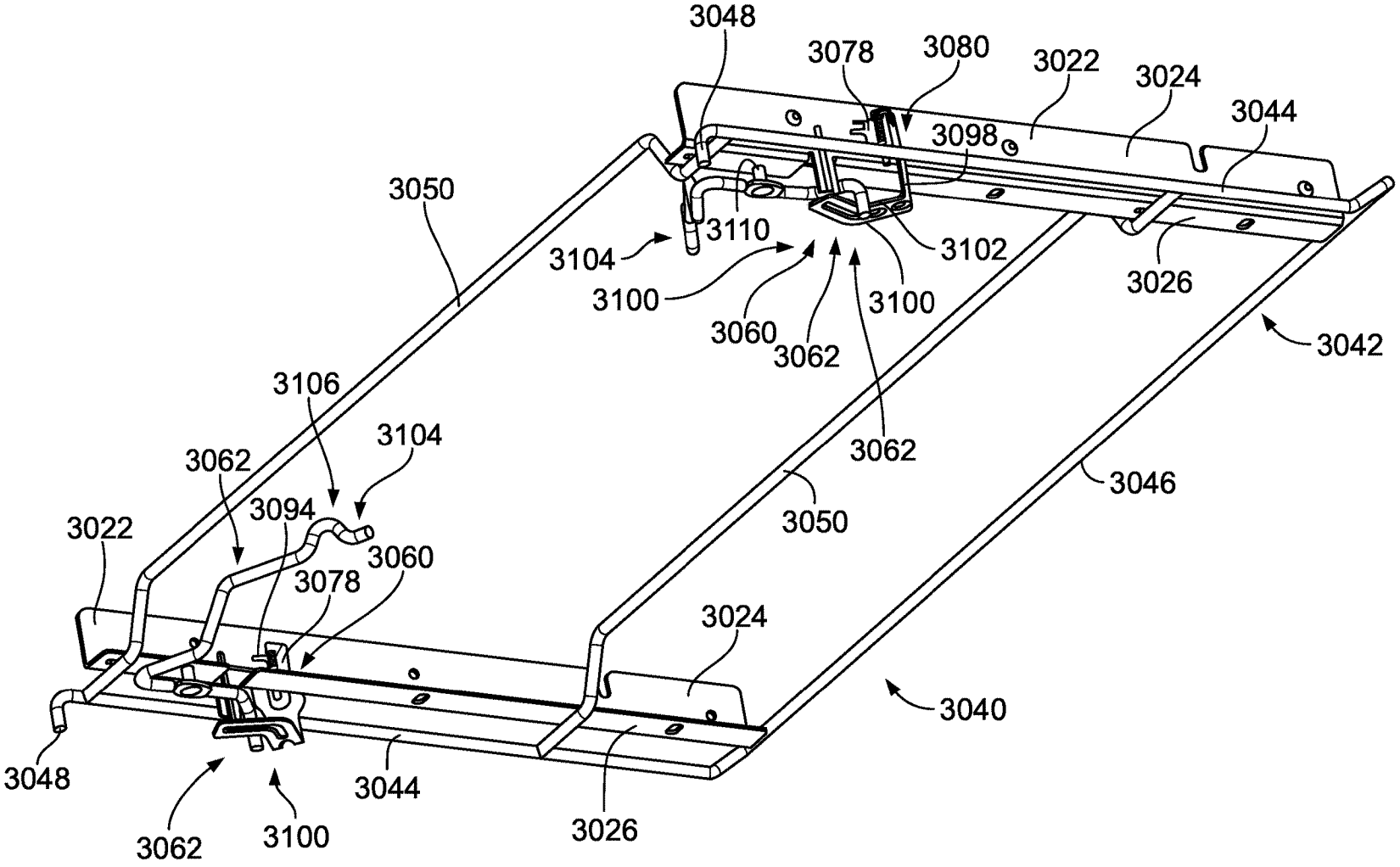
FIG. 53 is an underside, perspective view of the portion of the oven rack assembly shown in FIG. 52.
Figure 54:
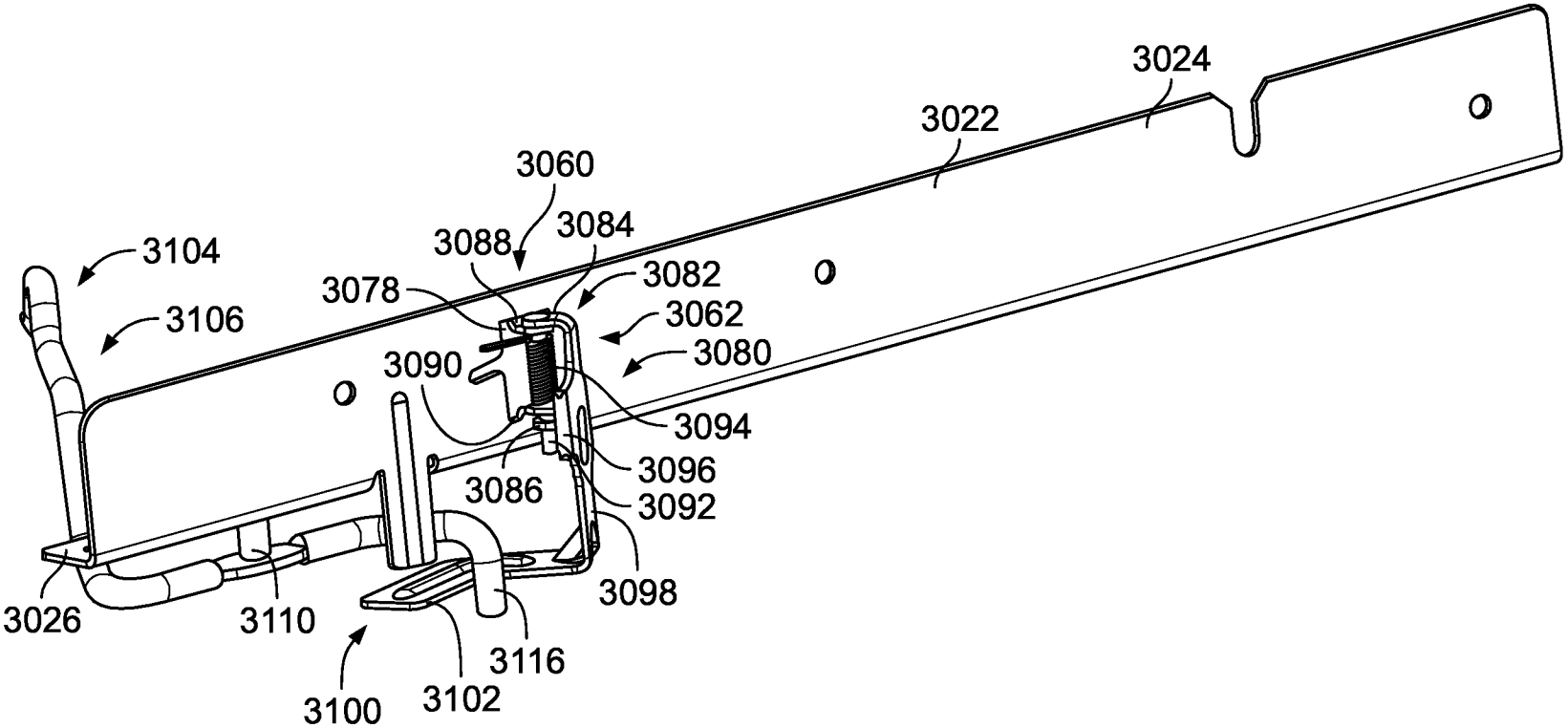
FIG. 54 is a right-side perspective view showing the respective relationship of one of the release mechanisms and one of the side stampings of one of the slide systems.

Each of the slide devices 3020 further includes an inner L-shaped stamping 3030, shown primarily in FIGS. 46 and 51. Each of the inner L-shaped stampings 3030 can include a top horizontal portion 3032 and a vertically extending side portion 3034. Certain elements of the ball bearing slides 3028 can be coupled to the vertical side portions 3034 of the inner stampings 3030 through the use of screws 3038, which could also be rivets or the like. Again, the details of the ball bearing slides 3028 can substantially correspond to those previously described herein with respect to the ball bearing slides 114' illustrated in FIG. 18.

In addition to the aforedescribed elements, the oven rack assembly 3000 also includes a subframe 3040. The subframe 3040 is primarily shown in FIGS. 47, 52 and 53. More specifically, the subframe 3040 is primarily formed as a rectangle with an outer wire frame 3042. The outer wire frame 3042 includes a pair of opposing side portions 3044 and a rear portion 3046 integral therewith. At the forward most sections of the side portions 3044, a pair of front and downwardly depending hooks 3048 are formed. In addition, the subframe 3040 also includes a pair of cross bars 3050 extending transversely between the opposing side portions 3044 of the wire frame 3042. Cross bars 3050 provide rigidity and support for the subframe 3040, and may be welded or otherwise connected to the side portion 3044. When the oven rack assembly 3000 is positioned in place within the oven, each of the side portions 3044 of the wire frame 3042 is supported on the top of a liner rib, such as the liner ribs 2004 described with respect to the oven rack assembly 2000. With this configuration, the downwardly depending front hooks 3048 are positioned at the front ends of the liner ribs. Still further, the subframe 3040 can be securely connected to the slide system 3018 through weldments or other securing means connecting the crossbars 3050 to the lower horizontal portions 3026 of the outer side stampings 3022. With these couplings between the subframe 3040, and the slide system 3018, and the oven rack 3008 and the slide system 3018, the oven rack 3008 can be extended or retracted through operation of the ball bearing slides 3028, with the L-shaped outer side stampings 3022 and the subframe 3040 remaining in place.

In addition to the aforedescribed elements of the oven rack assembly 3000, and in accordance with the invention, the oven rack assembly 3000 further includes a retention/release assembly 3060 which provides means for facilitating retention of the position of the subframe 3040 on the liner ribs, and also facilitating release of the subframe 3040 from the liner ribs when a user wishes to remove the subframe 3040 from the oven.

The retention/release assembly 3060 includes a pair of retention/release devices 3062 one of which is mounted on each of the opposing sides of the oven rack assembly 3000. Because the retention/release devices 3062 are substantially identical and basically comprise "mirror" images of each other, only one of the retention/release devices 3062 will be described in detail herein. More specifically, each of the retention/release devices 3062 interacts with and catches on a side wall of an oven liner. This action prevents the sliding oven rack 3008 from essentially "falling out" of the interior of the oven itself. By manual activation of each of the retention/release devices 3062 as described herein, the subframe 3040 can be placed in a retaining or release position within the oven liner.

In the oven rack assembly 2000 previously described herein with respect to FIGS. 35-45, each of the retention/release devices 2062 associated therewith was integrated or otherwise connected to a formed or stamped attachment plate 2065. In contrast, with the oven rack assembly 3000, the retention/release devices 3062 are integrated with or otherwise connected directly to corresponding ones of the L-shaped outer side stampings 3022. For purposes of description of the retention/release assembly 3060 and the retention/release devices 3062, the illustrations of FIG. 50 and FIGS. 54-58 will primarily be used. However, the retention/release devices 3062 are shown in a number of the drawings which comprise the set of FIGS. 46-58.

As shown in the drawings, each of the retention/release devices 3062 includes a flipper mechanism 3080. The flipper mechanism 3080 can be described as having an upper securing flange 3084 with an aperture extending therethrough. The mechanism 3080 also includes a lower and horizontally disposed securing flange 3086 also having an aperture extending vertically therethrough. The aperture in the upper securing flange 3084 is coaxial with the aperture in the lower securing flange 3086. As further shown in the drawings, extending outwardly from the vertically disposed side portion 3024 of each of the L-shaped outer side stampings 3022 is a pair of horizontal flanges 3082. The horizontal flanges 3082 include an upper horizontal flange 3088 and a lower horizontal flange 3090. Each of these flanges 3082 also include apertures therein. For purposes of securing the flipper mechanism 3080 to the corresponding side stamping 3022, the apertures in the upper and lower securing flanges 3084, 3086, respectively of the flipper mechanism 3080 can be aligned with the apertures in the upper horizontal flange 3088 and lower horizontal flange 3090 of the horizontal flanges 3082. A pin 3092 can then be received in the apertures of the aforedescribed flanges.

Still further, a retention spring 3094 can be secured and received around the pin 3092. The retention spring 3094 is positioned between the upper horizontal flange 3088 and the lower horizontal flange 3090 of the horizontal flanges 3082. As will be apparent from subsequent description herein, the retention spring 3094 is utilized to provide continuous forces exerted on the flipper mechanism 3080, so as to maintain the flipper mechanism 3080 in a "retaining position" until such time as a user would exert external forces so as to rotate the flipper mechanism 3080 to a position where the subframe 3040 could be extended and removed from the oven liner. It should be noted that although the flipper mechanisms 3080 are shown with the retention springs 3094, retention/release devices functioning in accordance with a number of the concepts of the invention do not necessarily require the retention springs 3094. Instead, the functions performed by the retention springs 3094 could be achieved through the use of similar types of elements mounted elsewhere on the oven rack assembly 3000, or the spring function could possibly be eliminated entirely.

As further shown in the drawings, positioned within the vertically disposed side portions 3024 of each of the outer side stampings 3022, and at the locations of the horizontal flanges 3082, is an aperture 3078. The apertures 3078 provide a means for facilitating assembly and installation of the oven rack assemblies 3000.

In describing the remaining components of the retention/release devices 3062, it should be emphasized that with the configuration of the horizontal flanges 3082 associated with the side stampings 3022, and the upper and lower securing flanges 3084, 3086, respectively of the flipper mechanism 3080, the flipper mechanism 3080 is free to rotate with the pin 3092 when forces are exerted on the flipper mechanism 3080. However, as earlier described, the retention spring 3094 exerts forces on the flipper mechanism 3080 so as to maintain the mechanism in the position shown, for example, in FIGS. 54, 56 and 57, absent forces externally applied by a user. In this position, the flipper mechanisms 3080 will abut the oven liner in a manner so as to prevent the subframe 3040 from being removed from the oven liner.

Figure 57:
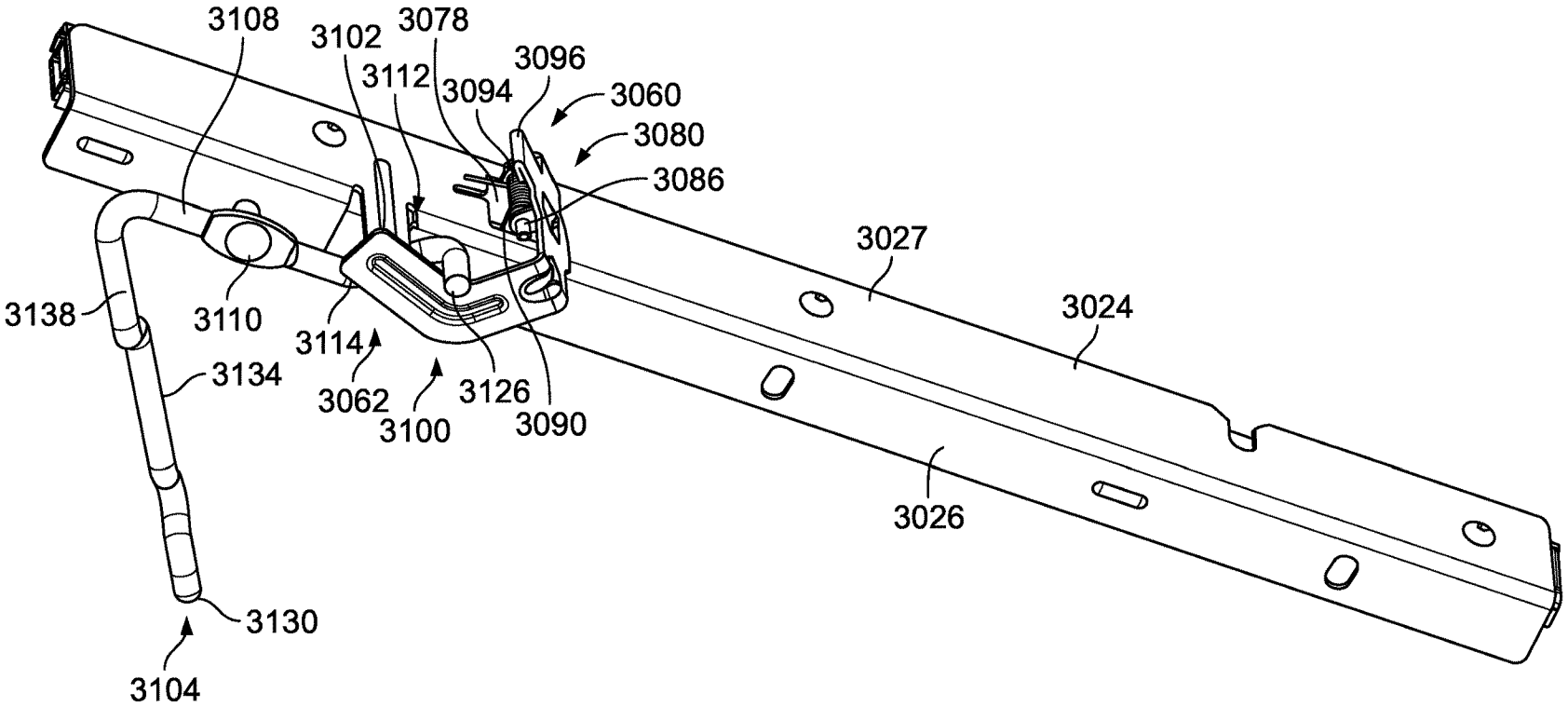
FIG. 57 is an underside and perspective right-side view of the right-side release mechanism as it is associated with the side stamping.
Figure 58:
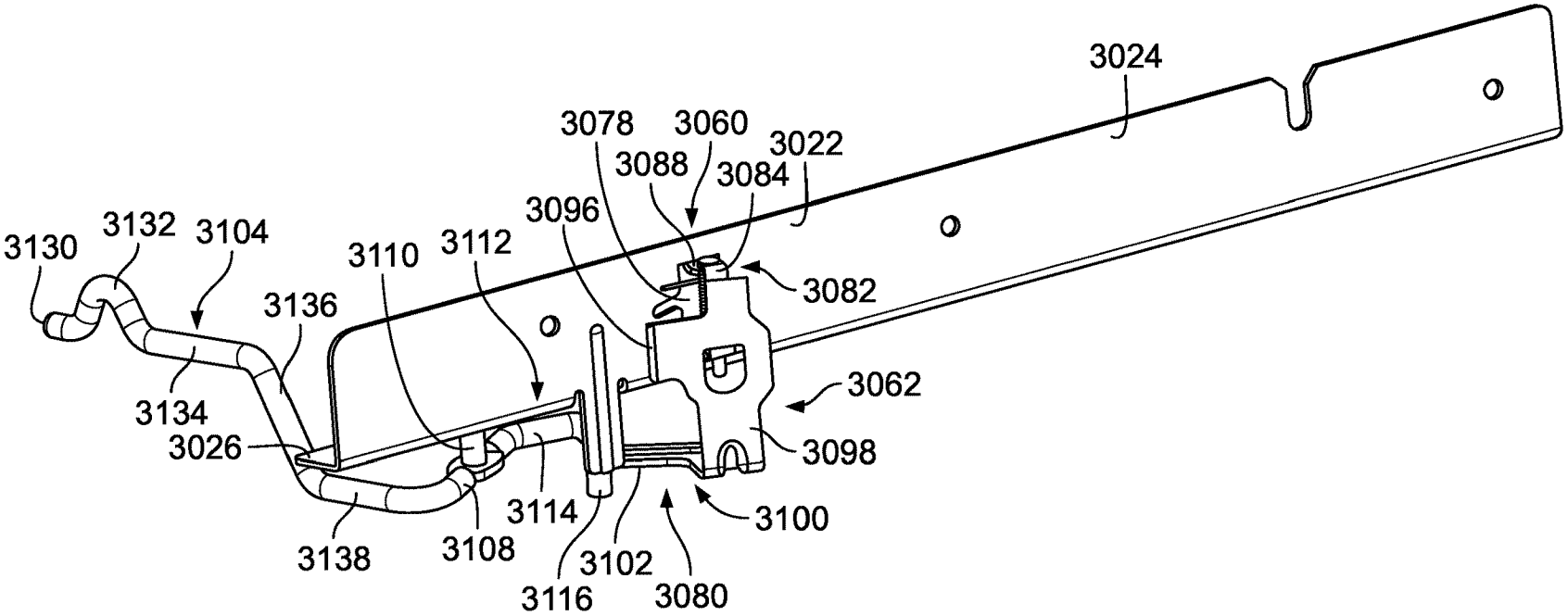
FIG. 58 is a right-side and perspective view showing the right-side release mechanism and the right-side side stamping, with the release mechanism in a position so as to permit movement of the subframe.

Integral with or otherwise connected to the upper securing flange 3084 and lower securing flange 3086 is a retainer tab 3096 having the shape and configuration primarily shown in FIG. 58. The retainer tabs 3096 are the actual components which abut the oven liner so as to prevent movement of the subframe 3040 from a retracted position within the oven liner. It should be noted that the retainer tab 3096 shown in FIG. 58 is in what could be characterized as a "released" position. That is, the retainer tab 3096 is in a position which would permit a user to remove the subframe 3040 from the interior of the oven. In contrast, the view of the retainer tab 3096 as shown, for example, in FIG. 57, represents the position of the retainer tab 3096 when it is in a "retaining" position, whereby the tab 3096 would abut portions of the oven liner in a manner so as to prevent a user from removing the subframe 3040 from the oven interior, unless the user would actuate the retention/release devices 3062. As further shown in FIGS. 50 and 54-58, positioned below the retainer tab 3096 is a lower and vertically disposed section 3098 of the flipper mechanism 3080. Integral with or otherwise connected to the lower vertical section 3098 is a lower and horizontally disposed component which may be characterized as a guide flange 3100. The guide flange 3100 has an arcuate shape and configuration as primarily shown in FIGS. 56 and 57. The guide flange 3100 includes what may be characterized as a guide surface 3102. The relevance of the guide surface 3102 will be explained in subsequent paragraphs herein.

In addition to the flipper mechanism 3080, each of the retention/release devices 3062 includes a formed release leg 3104. As shown in particular in FIG. 55, each of the release legs 3104 has an end nodule 3130. The end nodule 3130 is connected to or otherwise integral with a curved section 3132. At an opposing end of the curved section 3132 is a straight section 3134. At the opposing end of the straight section 3134 is an angled section 3136, which angles downwardly from the horizontal plane of the oven rack assembly 3000. At the opposing end of the angled section 3136 is a further straight section 3138. The portion of each of the formed release legs 3104 which comprises the end nodule 3130, curved section 3132, straight section 3134, angled section 3136 and further straight section 3138 can be characterized in combination as an actuating user lever 3106.

Figure 55:
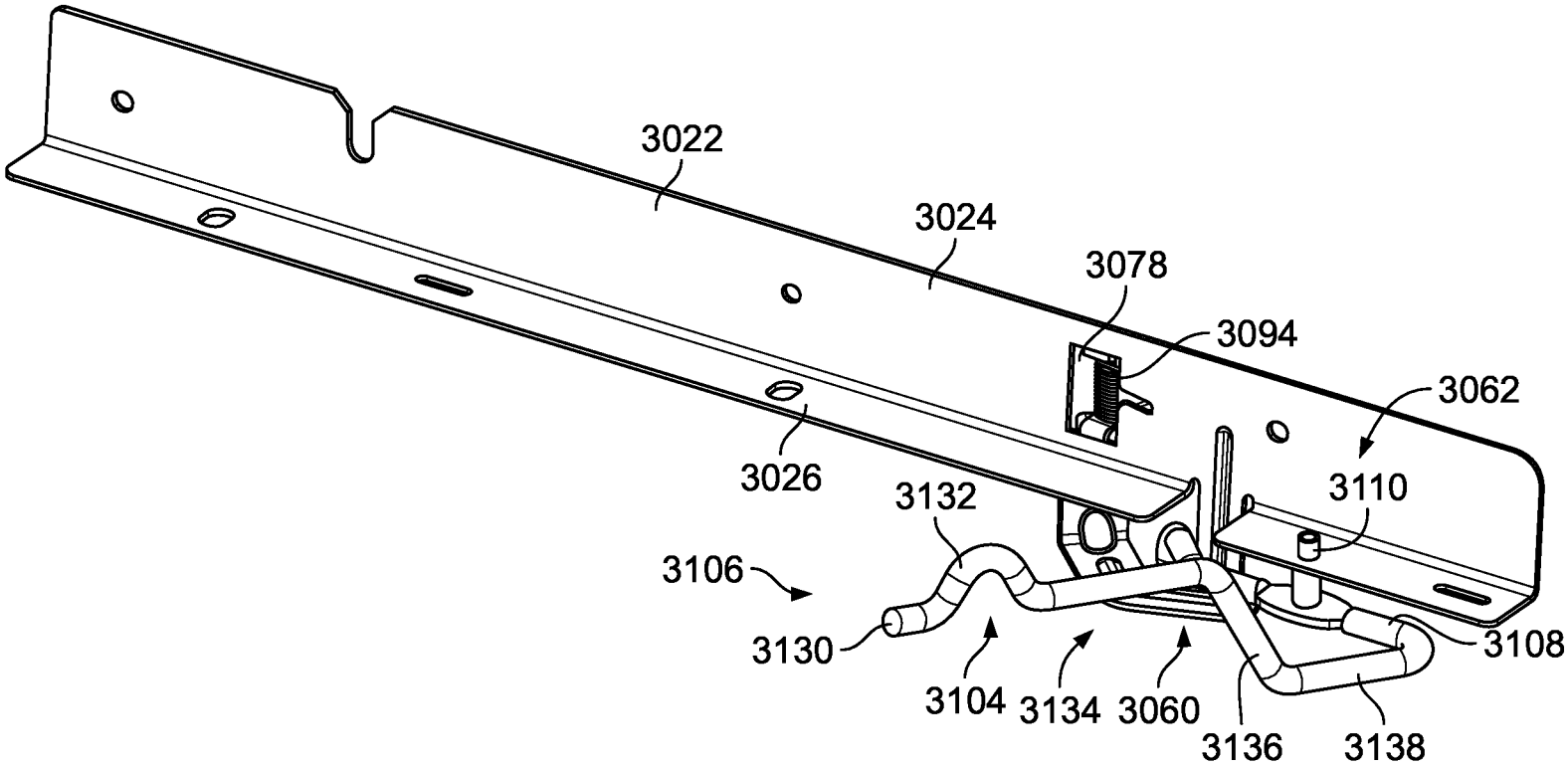
FIG. 55 is an underside and left-side perspective view of the release mechanism and side stamping shown in FIG. 54.
Figure 56:
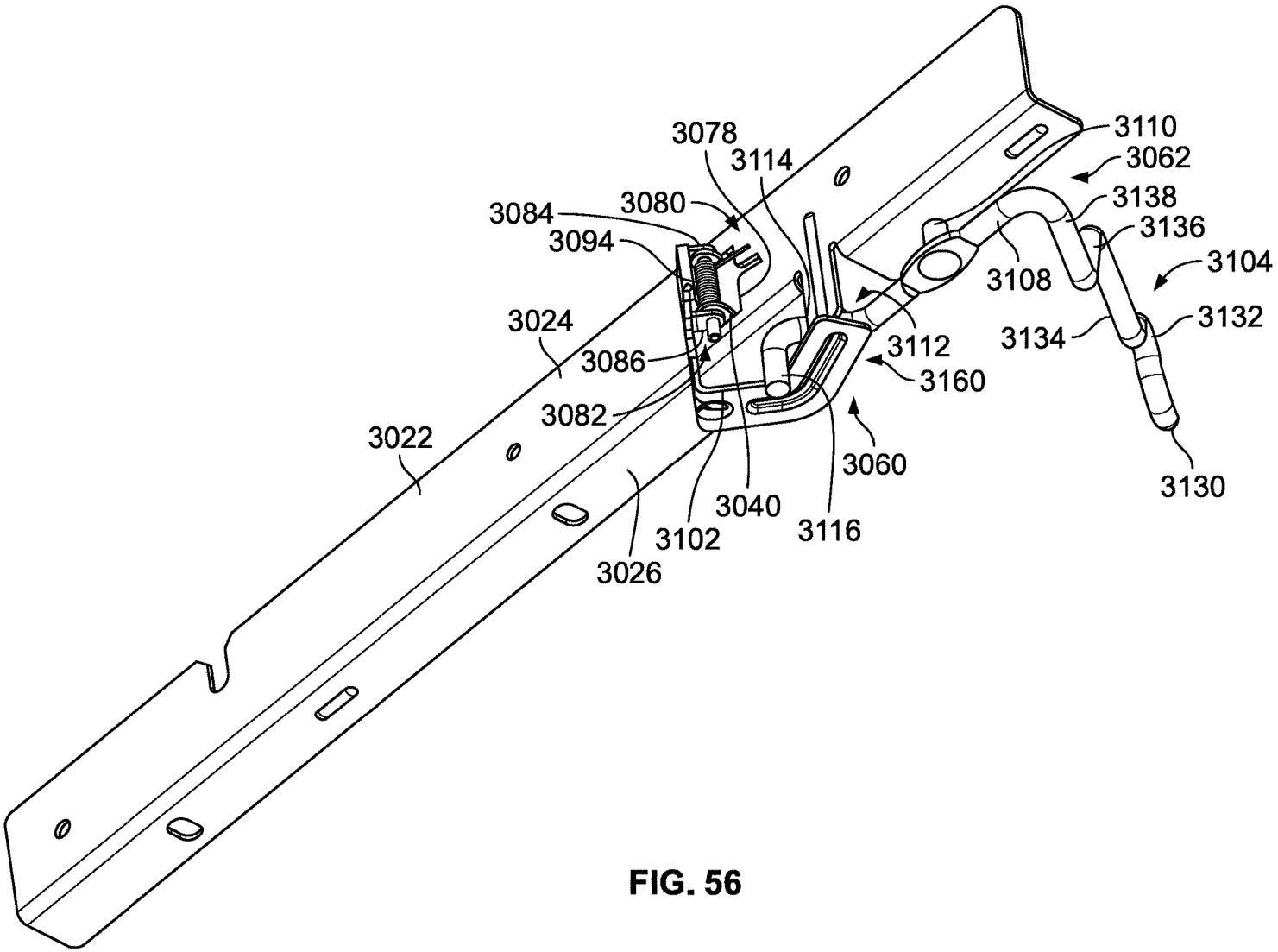
FIG. 56 is an underside and left-side perspective view of the release mechanism associated with the left-side side stamping of the oven rack assembly.

As shown primarily in FIGS. 55, 56 and 57, connected to or otherwise integral with the further straight section 3138 of each of the release legs 3104 is a pivot arm 3108 having a substantially "straightline" configuration. The pivot arm 3108 can be pivotably coupled to the horizontally disposed lower side portion 3026 of the associated outer side stamping 3022. This occurs through a pivot coupling 3110. This configuration is shown primarily in FIGS. 56, 57 and 58. Connected to or otherwise integral with one end of the pivot arm 3108 is a portion of the release leg 3104 which may be characterized as a guide section 3112. The guide section 3112 includes a horizontally disposed leg 3114 connected to or otherwise integral with the pivot arm 3108. At the end of the horizontal leg 3114, and connected thereto or otherwise integral therewith, is a downwardly projecting abutment post 3116. As further shown in particular in FIGS. 56, 57 and 58, the abutment post 3116 is configured so as to slide along the guide surface 3102 of the guide flange 3100.

In accordance with all of the foregoing, and with the subframe 3040 in a retracted position, the retention springs 3094 will essentially maintain the flipper mechanisms 3080 in a retaining position, with the retainer tabs 3096 in the position as shown in FIGS. 56 and 57. When it is desired to release the subframe 3040, the user can exert forces on the user lever 3106 of each of the formed release legs 3104. The exerted forces will be in a direction which opposes the retaining forces of the retention springs 3094. The forces will cause the abutment post 3116 of each of the guide sections 3112 to move along the guide surfaces 3102 of the guide flanges 3100. This movement will exert forces on the guide flanges 3100, opposing the forces of the retention springs 3094, and causing the retainer tabs 3096 to rotate so as to no longer be in abutment with the liner ribs or other retaining components of the oven liner. This position of one of the retainer tabs 3096 is shown in FIG. 58. With this rotation of the retainer tabs 3096, the user can then pull the subframe 3040 outwardly to a released position. When manually exerted forces are removed from the user levers 3106, the forces exerted by the retention springs 3094 will then cause the retainer tabs 3096 to again move to their "retaining" positions.

It will be apparent to those skilled in the pertinent arts that other embodiments of oven rack assemblies in accordance with the invention can be designed. That is, the principles of oven rack assemblies are not limited to the specific embodiments described herein. Accordingly, it will be apparent to those skilled in the art that modifications and other variations of the above-described illustrative embodiments of the invention may be effected, without departing from the spirit and scope of the novel concepts of the invention.

The invention claimed is:

1. An oven rack assembly adapted for use within an oven cavity having a ribbed liner with liner ribs, said oven rack assembly comprising: an oven rack comprising means for supporting items to be cooked or otherwise heated within said oven cavity, said oven rack being manually extendable between a retracted position within said oven cavity and an extended position where said oven rack has moved forwardly relative to said oven cavity; a slide system coupled to said oven rack for providing the capability of said oven rack to move between said retracted position and said extended position; a subframe coupled to said slide system and normally positioned in a first location within said oven cavity; retention/release means for facilitating retention of said subframe in said first location within said oven cavity, and for facilitating release of said subframe from said first location within said oven cavity, when a user wishes to remove said oven rack assembly from said oven cavity, said retention/release means comprising a pair of retention/release devices, each of said devices being located on an opposing side stamping of said over rack assembly, and each of said retention/release devices comprising: a flipper mechanism rotatable about a vertical axis between a retaining position and a full release position, wherein when said mechanism is in said retaining position, said mechanism abuts one of said liner ribs so as to prevent movement of said subframe within said oven cavity and to maintain said subframe in said first location within said oven cavity, absent application by a user of externally applied forces to said flipper mechanism, wherein each of said retention/release devices further comprises; a formed release leg manually operable by a user, said release leg being pivotably coupled directly or indirectly to said outer side stamping and moveable by a user between first and second positions, and associated with said flipper mechanism in a manner so that when said user moves said release leg from said first position toward said second position, said release leg causes said flipper mechanism to move from said retaining position toward said full release position, and wherein said release leg is structured so that said leg is not directly connected to any elements of said flipper mechanism, but instead is caused to move said flipper mechanism when said user applies forces to said release leg through an abutment coupling of said release leg to said flipper mechanism.

2. An oven rack assembly in accordance with claim 1, characterized in that each of said retention/release devices further comprises means for providing a vertical pivot axis about which said flipper mechanism can rotate between said retaining position and said full release position, with said flipper mechanism being rotatable relative to a direct or indirect connection to elements of said outer side stamping.

3. An oven rack assembly in accordance with claim 2, characterized in that said means for providing said vertical axis comprises a vertically disposed pin rotatably secured within apertures of connecting flanges which are directly or indirectly connected to other elements of said outer side stamping.

4. An oven rack assembly in accordance with claim 2, characterized in that each of said retention/release devices comprises means for urging said flipper mechanism toward said retaining position, absent the application of externally applied forces by a user to said flipper mechanism.

5. An oven rack assembly in accordance with claim 4, characterized in that: said means for providing said vertical axis about which said flipper mechanism rotates between said retaining position and said full release position comprises a vertically disposed pin; and said means for urging said flipper mechanism to said retaining position comprises a retention spring positioned on said pin.

6. An oven rack assembly in accordance with claim 1, characterized in that said release leg is pivotably coupled to said outer side stamping through a vertically disposed post directly or indirectly connected to elements of said outer side stamping.

7. An oven rack assembly in accordance with claim 1, characterized in that said release leg comprises: an actuating user lever operable by a user; a pivot arm connected to or otherwise integral with said user lever, said pivot arm being pivotably coupled to said subframe through a pivot coupling; a guide section connected to or otherwise integral with one end of said pivot arm; and said guide section comprises a downwardly projecting abutment post configured so as to contact a guide surface of a guide flange of said flipper mechanism.

8. An oven rack assembly in accordance with claim 7, characterized in that each of said retention/release devices further comprises one or more metal posts which extend downwardly from elements of said subframe, and act as additional abutment points for said formed release leg.

9. An oven rack assembly in accordance with claim 1, characterized in that each of said flipper mechanisms comprises: securing flanges connecting said flipper mechanism directly or indirectly to elements of said outer side stamping; a retainer tab rotatable about a vertical axis between said retaining position and said full release position; a pin coupled to said securing flanges and to said retainer tab for providing said vertical axis; and means for urging said retainer tab toward said retaining position, in the absence of the application of externally applied forces by a user to said retainer/release device.

10. An oven rack assembly in accordance with claim 9, characterized in that said flipper mechanism further comprises: a horizontally disposed guide flange positioned below said retainer tab; and said guide flange comprises a vertically disposed guide surface.

11. An oven rack assembly in accordance with claim 10, characterized in that each of said retainer/release devices further comprises: a release leg operable by a user to cause said flipper mechanism to move between said retaining position and said full release position; said release leg is pivotably coupled directly or indirectly to said outer side stamping; and said release leg comprises a guide section having a vertically disposed post which, when said user manually operates said release leg, said post is caused to abut said vertically disposed guide surface and exert forces on said guide surface so as to cause said flipper mechanism to move from said retaining position toward said full release position.

12. An oven rack assembly in accordance with claim 9, characterized in that said flipper mechanism further comprises means for causing said retainer tab to move from said full release position toward said retaining position when said user manually releases forces exerted on said release leg.

13. An oven rack assembly adapted for use within an oven cavity having a ribbed liner with liner ribs, said oven rack assembly comprising: an oven rack comprising means for supporting items to be cooked or otherwise heated within said oven cavity, said oven rack being manually extendable between a retracted position within said oven cavity and an extended position where said oven rack has moved forwardly relative to said oven cavity; a slide system coupled to said oven rack for providing the capability of said oven rack to move between said retracted position and said extended position; a subframe coupled to said slide system and normally positioned in a first location within said oven cavity; retention/release means for facilitating retention of said subframe in said first location within said oven cavity, and for facilitating release of said subframe from said first location within said oven cavity, when a user wishes to remove said oven rack assembly from said oven cavity, said retention/release means comprising a pair of retention/release devices, each of said devices being located on an opposing side stamping of said over rack assembly, and each of said retention/release devices comprising: a flipper mechanism rotatable about a vertical axis between a retaining position and a full release position, wherein when said mechanism is in said retaining position, said mechanism abuts one of said liner ribs so as to prevent movement of said subframe within said oven cavity and to maintain said subframe in said first location within said oven cavity, absent application by a user of externally applied forces to said flipper mechanism, wherein each of said retention/release devices further comprises; a formed release leg manually operable by a user, said release leg being pivotably coupled directly or indirectly to said outer side stamping and moveable by a user between first and second positions, and associated with said flipper mechanism in a manner so that when said user moves said release leg from said first position toward said second position, said release leg causes said flipper mechanism to move from said retaining position toward said full release position, and said release leg comprises: an actuating user lever operable by a user; a pivot arm connected to or otherwise integral with said user lever, said pivot arm being pivotably coupled to said subframe through a pivot coupling; a guide section connected to or otherwise integral with one end of said pivot arm; and said guide section comprises a downwardly projecting abutment post configured so as to contact a guide surface of a guide flange of said flipper mechanism.

14. An oven rack assembly in accordance with claim 13, characterized in that each of said retention/release devices further comprises means for providing a vertical pivot axis about which said flipper mechanism can rotate between said retaining position and said full release position, with said flipper mechanism being rotatable relative to a direct or indirect connection to elements of said outer side stamping.

15. An oven rack assembly in accordance with claim 14, characterized in that said means for providing said vertical axis comprises a vertically disposed pin rotatably secured within apertures of connecting flanges which are directly or indirectly connected to other elements of said outer side stamping.

16. An oven rack assembly in accordance with claim 14, characterized in that each of said retention/release devices comprises means for urging said flipper mechanism toward said retaining position, absent the application of externally applied forces by a user to said flipper mechanism.

17. An oven rack assembly in accordance with claim 16, characterized in that: said means for providing said vertical axis about which said flipper mechanism rotates between said retaining position and said full release position comprises a vertically disposed pin; and said means for urging said flipper mechanism to said retaining position comprises a retention spring positioned on said pin.

18. An oven rack assembly in accordance with claim 13, characterized in that said release leg is pivotably coupled to said outer side stamping through a vertically disposed post directly or indirectly connected to elements of said outer side stamping.

19. An oven rack assembly in accordance with claim 13, characterized in that each of said retention/release devices further comprises one or more metal posts which extend downwardly from elements of said subframe, and act as additional abutment points for said formed release leg.

20. An oven rack assembly in accordance with claim 13, characterized in that each of said flipper mechanisms comprises: securing flanges connecting said flipper mechanism directly or indirectly to elements of said outer side stamping; a retainer tab rotatable about a vertical axis between said retaining position and said full release position; a pin coupled to said securing flanges and to said retainer tab for providing said vertical axis; and means for urging said retainer tab toward said retaining position, in the absence of the application of externally applied forces by a user to said retainer/release device.

21. An oven rack assembly in accordance with claim 20, characterized in that said flipper mechanism further comprises: a horizontally disposed guide flange positioned below said retainer tab; and said guide flange comprises a vertically disposed guide surface.

22. An oven rack assembly in accordance with claim 21, characterized in that each of said retainer/release devices further comprises: a release leg operable by a user to cause said flipper mechanism to move between said retaining position and said full release position; said release leg is pivotably coupled directly or indirectly to said outer side stamping; and said release leg comprises a guide section having a vertically disposed post which, when said user manually operates said release leg, said post is caused to abut said vertically disposed guide surface and exert forces on said guide surface so as to cause said flipper mechanism to move from said retaining position toward said full release position.

23. An oven rack assembly in accordance with claim 20, characterized in that said flipper mechanism further comprises means for causing said retainer tab to move from said full release position toward said retaining position when said user manually releases forces exerted on said release leg.

* * * * *